US005701554A

United States Patent [19]

Tanaka et al.

[11] Patent Number: 5,701,554

[45] Date of Patent: Dec. 23, 1997

[54] FIXING APPARATUS HAVING CONTROLLER FOR SETTING A TARGET TEMPERATURE AND FOR ESTIMATING THE AMOUNT OF HEAT TRANSFERRED TO A PRESSURE ROLLER

[75] Inventors: Hiroshi Tanaka; Toru Fujita; Tahei Ishiwatari, all of Nagano, Japan

[73] Assignee: Seiko Epson Corporation, Tokyo, Japan

[21] Appl. No.: 489,478

[22] Filed: Jun. 12, 1995

[30] Foreign Application Priority Data

| | | | |
|---|---|---|---|
| Jun. 10, 1994 | [JP] | Japan | HEI 6-129293 |
| Nov. 18, 1994 | [JP] | Japan | HEI 6-284822 |
| Mar. 24, 1995 | [JP] | Japan | HEI 7-066571 |

[51] Int. Cl.[6] ..... G03G 15/20

[52] U.S. Cl. ..... 399/69

[58] Field of Search ..... 355/282, 285, 355/289, 290; 219/216; 399/68, 69, 330–332

[56] References Cited

U.S. PATENT DOCUMENTS

| | | | |
|---|---|---|---|
| 3,833,790 | 9/1974 | Quant et al. | 219/216 |
| 4,905,051 | 2/1990 | Satoh et al. . | |
| 5,329,343 | 7/1994 | Saito | 355/290 |
| 5,436,430 | 7/1995 | Baruch et al. | 219/216 |
| 5,464,964 | 11/1995 | Okuda et al. | 219/216 X |
| 5,465,141 | 11/1995 | Asano et al. | 355/285 |

FOREIGN PATENT DOCUMENTS

| | | |
|---|---|---|
| 0 546 545 A2 | 10/1992 | European Pat. Off. . |
| 4437055A1 | 5/1995 | Germany . |
| 55-181258 | 6/1954 | Japan . |
| 56-198684 | 12/1956 | Japan . |
| 57-24546 | 5/1982 | Japan . |
| 5-19659 | 1/1993 | Japan . |
| 5-165368 | 7/1993 | Japan . |
| 5-273890 | 10/1993 | Japan . |
| 5-289562 | 11/1993 | Japan . |
| 6-175535 | 6/1994 | Japan . |

*Primary Examiner*—Robert Beatty

*Attorney, Agent, or Firm*—Sughrue,Mion,Zinn,Macpeak & Seas, PLLC

[57] ABSTRACT

A fixing apparatus including a heating member and a pressurizing member that are in contact with each other under pressure to define a nip through which a sheet carrying an unfixed toner image is passed and a temperature sensor for sensing the temperature of the heating member. The fixing apparatus further includes a temperature controller for proportionally controlling an electric power supplied to the heating member, based on the sensed temperature supplied from the temperature sensor, and for controlling the temperature of the heating member so that it is at a predetermined target temperature, and a heating condition changing device for changing a heating condition based on the target temperature and the sensed temperature when the temperature of the heating member is sensed. The electric power supplied to a halogen lamp functioning as a heat source of the heating roller is controlled in proportion to the temperature difference between the sensed temperature and the target temperature of the heating roller. The temperature of the pressurizing roller is estimated from the sensed temperature of the heating roller and the target temperature at a time when the sensing is performed. Then, heating conditions (such as the target temperature of the heating roller) which are suitable for the temperature of the pressurizing roller are reset.

33 Claims, 25 Drawing Sheets

FIXING APPARATUS HAVING CONTROLLER FOR SETTING A TARGET TEMPERATURE AND FOR ESTIMATING THE AMOUNT OF HEAT TRANSFERRED TO A PRESSURE ROLLER

BACKGROUND OF THE INVENTION

1. Field of the Invention

The invention relates particularly to a thermal fixing apparatus which is used in an image forming apparatus using the electrophotographic technique. More particularly, the invention relates to a fixing apparatus comprising a heating member and a pressurizing member which are in contact with each other under pressure, and further comprising temperature sensing means for sensing the temperature of the heating member or a heating element. The fixing apparatus proportionally controls the electric power supplied to a heat generating member in accordance with the output result of the temperature sensing means, so as to control the heating member to a target temperature. A material to be heated and carrying an unfixed toner image is nipped by and transported through the pressurized contact portion between the heating member and the pressurizing member, whereby the toner image is fixed onto the heated material.

2. Related art

Conventionally, a thermal fixing apparatus using a heat roller, a heat belt, or the like is generally used as a fixing apparatus. Such a fixing apparatus involves the following drawbacks. An excessively low temperature of a pressurizing member may cause faulty fixing. In contrast, an excessively high temperature of the pressurizing member may cause a heated material (a paper sheet) to be crinkled, or may cause the toner to be stuck to the heating member (high-temperature offset).

To solve the problems, Published Unexamined Japanese Utility Model Application No. Sho. 55-181258 discloses a method of controlling the temperature of the heating roller in which the temperature of the heating roller is set at a first set temperature in the printing operation from power on till a predetermined number of prints is produced, and it is set at a second set temperature in the subsequent printing operation. This technique is based on the concept that the temperature of the heating roller is reduced by the quantity of an increase of the temperature of the pressurizing roller, which results from the progression of the printing operation.

Published Unexamined Japanese Utility Model Application No. Sho. 60-169664 discloses another temperature control in which when during a period from the end of supplying electric power to the fixing unit to a preset time point, the electric power is supplied again to the fixing unit, the fixing temperature is set at a first predetermined temperature. After the preset time point, the fixing temperature is set at a second predetermined temperature higher than the first one. This technique is based on the concept that the fixing unit will be cooled after the predetermined time elapses from the end of the fixing operation, and hence it must be set at a temperature higher than the predetermined fixing temperature.

Published Unexamined Japanese Patent Application No. Hei. 5-273890 discloses a temperature control method in which a set temperature of the heating roller is controlled at a temperature different from a predetermined temperature for a fixed time interval, on the basis of the roller temperature before the copying operation starts. This technique is based on the concept that whether or not the fixing unit is cooled is judged on the basis of the roller temperature.

The temperature control method in which the control temperature is switched to another on the basis of the number of prints has the following drawbacks.

The printer which receives print data from a host computer, for example, and develops the print data into an image pattern before its printing, or a facsimile which receives compressed image data through a telephone line and expands the compressed image data to develop it into an image pattern before its print, prints the print data of plural pages in a manner that before it discharges a print of a page, it starts the printing operation of the next page. In other words, the printer operates in a successive print mode.

When the printer operates in the successive print mode, the time taken for the transfer of the print data or the development of the print data varies depending on the print contents and the ability of the computer which produces the print data. Accordingly, the paper passage time varies and the temperature rise of the pressurizing roller also varies depending on those factors.

Under this condition, if the set temperature is switched to another depending on the number of prints, the temperature of the pressurizing roller rises when the paper passage time is long, thereby causing crinkle of the paper sheet. When the paper passage time is short, the roller temperature is low, thereby causing fixing faulty.

The temperature control method in which the set temperature is switched depending on the sensed temperature of the heating roller immediately before the print operation starts or the elapsing time after the print operation, has the following drawbacks.

FIG. 26 is a graph showing how the temperature of the heating roller and the pressurizing roller fall after the printing operation ends. As shown, the temperature falling curve, indicated by a solid line, after one print is completed, is greatly different in shape from the temperature falling curves, indicated by broken lines, after a number of prints are completed.

If a cooled state of the fixing unit is judged depending on whether or not the sensed temperature of the heating roller immediately before the print operation starts is equal to or higher than 90° C. or lower than 90° C., and the heating roller is set to a temperature on the basis of the judgement, the temperature of the heating roller is 65° C. (P2) after one print is completed, and 85° C. (P1) after a number of prints are completed. These values of temperature are greatly different from each other. In this case, when the temperature of the heating roller is relatively low, it is mistakenly judged that the fixing unit is satisfactory heated. Conversely, when it is relatively high, it is mistakenly judged that the fixing unit is cooled. This results in fixing faulty, crinkle of paper sheet, and the like.

The same mistaken judgement also occurs also in a case where the cooled state of the fixing unit is judged on the basis of the elapsing time from the end of the printing operation.

In a case where the cooled state of the fixing unit is judged depending on whether or not 10 minutes elapses after the printing operation ends, the temperature of the heating roller is 65° C. (P4) after one print is completed, and 85° C. (P3) after a number of prints are completed. These values of temperature are also greatly different from each other.

One of the possible ways to avoid the mistaken Judgement is such that a point P5, for example, in the figure is selected for checking whether or not the fixing unit is cooled so that in any case, the temperature of the pressurizing roller, and the elapsing time and the temperature of the heating roller are related in one-to-one correspondence. As also seen from FIG. 18, such a heating roller temperature is low in most cases, only the judgement as to whether or not the fixing unit is extremely cooled is allowed.

In an extremely limited case, it is used as information to switch the set temperature of the heating roller. Such an elapsing time is long, several tens minutes, so that it cannot be used for the information to switch the set temperature of the heating roller till the elapsing time terminates.

In a case that the printing operation is intermittently repeated at the intervals of print rest of several tens minutes or shorter, the information on whether or not the fixing unit is cooled cannot be used for the information to switch the set temperature of the heating roller. As a result, when the printing operation is intermittently repeated, the paper sheet will be curled or the gloss level will occur to greatly vary the picture quality. Additionally, crinkle and fixing faulty will be caused.

On the other hand, an image forming apparatus such as a printer or a facsimile apparatus which receives image data transmitted from an external apparatus and performs internal processing of the image data has the following problem. When images are to be formed successively, a time interval from the previous image output (the n-th sheet) to the next image output (the (n+1)th sheet), i.e., a time interval between sheets which are successively fed to the fixing apparatus, is not constant depending on the amount and the type of image data. In the fixing apparatus, therefore, the temperature of the pressurizing member is varied depending on the time interval between sheets, which results in faulty fixing, the formation of paper crinkles or high-temperature offset. For example, in the case where the amount of image data is so large that a long time is required to transmit the image data and to develop the image data in the apparatus, or in the case where the image data, such as graphic image data, are complicated so that a long time is required for the processing thereof, it takes a long time to output the subsequent image, and hence the time interval between sheets is prolonged.

In most image forming apparatuses, in order to shorten the start-up time of the fixing apparatus, the temperature of the heating member in the interval between sheets is maintained equal to or slightly lower than the temperature during the image forming operation. For the purpose of realizing the above, the electric power supply to the heating member and the rotation driving of the heating roller are performed irrespective of whether a paper sheet is present in the fixing apparatus or not. As a result, if the time interval between sheets is long, the temperature of the pressurizing member is raised by the heat transferred from the heating member, so that paper crinkles and high-temperature offset may occur. In contrast, if the time interval between sheets is short, the amount of heat transferred from the pressurizing member to a paper sheet during a period in which the paper sheet is present in the fixing apparatus (a sheet-feeding period) is larger than the amount of heat supplied from the heating member to the pressurizing member during the time interval between sheets. Thus, the temperature of the pressurizing member is lowered, and faulty fixing may occur.

Thus, as described above, the temperature of the pressurizing member seriously affects the characteristics of fixing the toner image onto the heated material.

In view of the above-mentioned problems, it is desirable that the temperature of the heating member is appropriately set in accordance with the temperature of the pressurizing member. For example, Japanese Patent Publication (Kokai) No. SHO 50-39554 discloses an arrangement in which a temperature sensing means is disposed in the pressurizing member as well as in the heating member, and the temperature control is performed as follows. When the temperature of the pressurizing member is low, the temperature of the heating member is raised, and, when the temperature of the pressurizing member is high, the temperature of the heating member is lowered.

Recently, at home or at a workplace, there arises a situation where one person uses one or more image forming apparatuses such as a printer, a facsimile apparatus, and a copy machine. In such a usage environment, it is requested to shorten the waiting time which extends from the power-on of an image forming apparatus to a time when the image formation is actually enabled (quick start property), or to reduce the power consumption of the image forming apparatus.

In order to realize the quick start, it is necessary to shorten the warm-up time of a fixing apparatus (a time required for reaching a temperature at which a fixing process can be done). In order to reduce the power consumption, the power supply to the fixing apparatus must be stopped in a time period during which the image forming operation is not actually performed (waiting time), or the temperature of the heating member must be controlled so as to be lower than that attained during the image forming process. When the fixing apparatus is configured so that the power supply to the fixing apparatus is stopped or reduced in level, however, the operation of warming up the fixing apparatus must be performed each time when the image forming process is to be started. Also in this case, the quick start property is still essential for the image forming apparatus.

When the temperature of the pressurizing member is sensed and the heating member is controlled in accordance with the sense result, it may be possible to shorten the warm-up time of a fixing apparatus, and in turn improve the quick start property.

The temperature of the pressurizing member depends on the use history of the image forming apparatus (for example, the time period during which the apparatus was operated in the previous image forming process, the time period between the end of the previous operation and the start of the next operation, the waiting time after the apparatus is powered on, and the time during which the image forming operation is continuously performed as a result of a successive sheet supply). In a system wherein only the temperature of the heating member is used as the judgment criterion, however, the set temperature of the heating member is determined in consideration of the case where the temperature of the pressurizing member is low, and hence the required warm-up time is almost constant in a manner substantially irrespective of the temperature of the pressurizing member. By contrast, in a system wherein the temperature of the heating member is controlled in accordance with that of the pressurizing member, for example, the fixing apparatus can perform the fixing operation even when the temperature of the heating member is low, as far as that of the pressurizing member is high. In this system, therefore, the operation of warming up the fixing apparatus can be completed in a shorter time than that in the system wherein only the temperature of the heating member is used as the judgment criterion. In the case where the temperature of the pressurizing member is low, furthermore, the temperature of the heating member must be raised. In this case, the required warm-up time is comparative to that in the system wherein only the temperature of the heating member is used as the judgment criterion. In the case where the temperature of the pressurizing member is low, however, the warm-up time can be made shorter than that required in the system wherein only the temperature of the heating member is used as the judgment criterion, by, for example, performing a control such as that an electric power greater in amount than the usual one is supplied to the heating member.

As the system of controlling the temperature of the fixing apparatus in consideration of the use history of the image forming apparatus, various methods have been proposed. In such methods, the temperature of a fixing apparatus is controlled based on a certain judgment criterion, for example, each time when the operating time of the apparatus exceeds a predetermined value, or when the number of image forming operations is greater than a predetermined value. However, use histories of image forming apparatuses are different in a various manner. In personal uses each conducted by one person, particularly, use histories are widely varied by various reasons such as the difference in usage environment, for example, indoor use or outdoor use, or in frequency of use, for example, use at home or use at a workplace. Therefore, it is difficult to conduct the control based on a single judgment criterion with respect to all use histories of various image forming apparatuses.

In order to control the temperature of a fixing apparatus correctly in accordance with the use history of an image forming apparatus, consequently, it is indispensable to actually sense the temperatures of a heating member and a pressurizing member and conduct the control based on the sense result.

Japanese Patent Publication (Kokai) No. HEI5-289562 discloses a technique in which, when a fixing apparatus (a pressurizing member, etc.) is cold, an electric power must be supplied in a larger amount to a heating member so that the temperature of the heating member is maintained at a given level, and, when the fixing apparatus is warm, an electric power can be supplied in a smaller amount to the heating member. The publication discloses a fixing apparatus which uses a heating member consisting of a film of a small heat capacity, and a heating element (film heating method), and also a system in which the temperature of the fixing apparatus must be sensed with the objective of preventing the heating element from being over-heated. As the method of sensing the temperature of a fixing apparatus, the publication discloses the following methods: a fixed amount of electric power is supplied to a heating element when a heating element is to start the operation, and the temperature rising rate of the heating element at this time is sensed; the power supply to a heating element is stopped between sheets which are successively supplied to the fixing apparatus (between sheets), and the temperature lowering rate when the heat of the heating element is dissipated is sensed; the power supply to the heating element between sheets is controlled so as to have either of two levels of HIGH/LOW, and the temperature variation (temperature ripple) of the heating element is sensed; and an electric power supplied to the heating element in a sheet passing period during which a sheet passes through the fixing apparatus is sensed.

On the other hand, in view of the demand for electric power saving in recent years, the electric power supply to the fixing apparatus is cut off after the printing is finished. In this case, depending on the printing history, the temperature of the pressurizing roller is inconsistently varied, and hence the fixing characteristic is also varied. Accordingly, in order to improve the technique, a technique for estimating the temperature of the pressurizing roller is proposed.

Further, Japanese Patent Publication (Kokai) No. HEI. 5-289562 discloses a technique in which the power supply to a heating element is terminated between successively fed sheets and a temperature lowering rate is sensed as the heat of the heating element dissipates.

As described above, it is essential for a fixing apparatus to appropriately set the temperature of the heating member in a manner which is dependent on the temperature of the pressurizing member.

However, if the temperature sensing means is provided for sensing the temperature of the pressurizing member as disclosed in Japanese Patent Publication (Kokai) No. SHO 50-39554, the construction of the fixing apparatus becomes complicated. In general, the temperature sensing means is of the contact type, and the pressurizing member is made of a soft elastic material. For these reasons, in a portion of the pressurizing member with which the temperature sensing means is in contact, a pressurizing roller wears or is partly broken, and the pressurizing force cannot be obtained in that portion. As a result, there arise problems of the occurrence of faulty fixing and paper crinkles.

Moreover, Japanese Patent Publication (Kokai) No. HEI5-289562 discloses several methods of sensing the temperature of a pressurizing member. In the case where the temperature rising rate of a heating element is sensed when a fixed amount of electric power is supplied to the heating element, for example, the supply of the fixed amount of electric power is conducted irrespective of the set temperature to which the heating member must eventually reach. Therefore, a time period for sensing the temperature rising rate of the heating element must always be elapsed before the heating element is controlled to the set temperature. In such a method, if the heating element heats the material to be heated via a film having a small heat capacity as in the case of the film heating method, the temperature of the heating member is easily raised. Accordingly, the sensing of the temperature rising rate can easily be performed in a short time. In a generally used thermal fixing apparatus such as a heating roller, however, the heat capacity of the heating member is so large that it is impossible to sense the rising of the temperature of the heating member in a short time with high accuracy.

Similary, as in the case of Japanese Patent Publication (Kokai) No. HEI. 5-289562 in which the power supply to the heating element is stopped between successively fed sheets, and the temperature lowering rate of the heating element is sensed, if the heating element (a heat generating element) supplies the heat to the material to be heated via a film having a small heat capacity in the same way as in the film heating method, the temperature of the heating member is easily lowered. Accordingly, the sensing of the temperature lowering rate can easily be performed in a short time, and the temperature of the heating member can easily be raised again to the target temperature after the temperature is once lowered. In a generally used thermal fixing apparatus such as a heat roller, however, the heat capacity of the heating member is so large that it is impossible to sense the lowering of the temperature of the heating member in a short time period with a high degree of accuracy. Moreover, a control arrangement in which the temperature of the heating member is once lowered and then raised to the target temperature wastefully consumes electric power and time, and hence such a control is not desirable.

Also in the case where the electric power supply to the heating element between sheets is controlled so as to have either of two levels of HIGH/LOW and the temperature variation (temperature ripple) of the heating element is sensed, if the heating element heats the material to be heated via a film having a small heat capacity in the same way as in the film heating method, the temperature of the heating member is easily varied. Accordingly, the sensing of the temperature variation can easily be performed in a short time. In a generally used thermal fixing apparatus such as a heating roller, however, the heat capacity of the heating member is so large that it is impossible to sense the temperature variation of the heating member in a short time with high accuracy.

In the case where an electric power supplied to the heating element in a period during which a sheet passes through the fixing apparatus is sensed, the sheet functions as a heat insulator during the period so that the heat of the heating member is hardly transferred to the pressurizing member, and the amount of heat transferred from the heating member varies depending on the moisture content and the temperature of the sheet. Therefore, it is impossible to accurately sense the temperature of the pressurizing member based on the sensed electric power.

It is an object of the invention to provide a fixing apparatus which has a simple construction without additionally requiring means for sensing the temperature of a pressurizing member, but can sense the temperature of the pressurizing member with high accuracy, and which can appropriately set the temperature of a heating member in accordance with the temperature of the pressurizing member.

SUMMARY OF THE INVENTION

It is an object of the invention to provide a fixing apparatus which has a simple construction without additionally requiring means for sensing the temperature of a pressurizing member directly, but can sense the temperature of the pressurizing member with high accuracy indirectly, and which can appropriately set the heating conditions such as the temperature of a heating member in accordance with the temperature of the pressurizing member.

The fixing apparatus of the invention is an apparatus which comprises a heating member and a pressurizing member that are in contact with each other under pressure, in which a material to be heated and carrying an unfixed toner image is nipped by and transported through a pressurized contact portion between the members, wherein the apparatus further comprises: temperature sensing means for sensing a temperature of the heating member; and temperature control means for controlling an electric power supplied to the heating member, based on a temperature sense result supplied from the temperature sensing means, and for controlling the heating member to a predetermined set temperature, the set temperature of the heating member being changed, based on an amount of electric power which is supplied from the temperature control means to the heating member when a material to be heated is not present in the pressurized contact portion between the heating member and the pressurizing member.

The fixing apparatus of the invention further comprises state judging means for judging whether a state where the material to be heated is transported to the fixing apparatus exists or not, and the set temperature of the heating member is changed based on an amount of electric power which is supplied from the temperature control means to the heating member in a period between an elapse of a predetermined time period after the state judging means judges that the state where the material to be heated is transported to the fixing apparatus exists, and a time when the material to be heated enters the pressurized contact portion between the heating member and the pressurizing member.

In the fixing apparatus of the invention, the set temperature of the heating member is changed, based on an amount of electric power which is supplied from the temperature control means to the heating member, and a temperature of the heating member to which the amount of electric power is supplied.

The present invention has been conducted with paying attention to the fact that, under the condition that a sheet is not present in the pressurized contact portion between the heating member and the pressurizing member, the heat dissipation condition of the heating member, or the amount of electric power required for maintaining the temperature of the heating member to a constant level largely depends on the temperature of the pressurizing member which is in contact with the heating member. During when a sheet passes through the apparatus, it is difficult to accurately sense the temperature of the pressurizing member because of the moisture content and the temperature of the sheet. According to the invention, however, the temperature of the pressurizing member can accurately be sensed by sensing an electric power supplied to the heating member in a time interval between sheets, without additionally providing means for sensing the temperature of the pressurizing member.

According to the present invention, while an electric power is supplied so as to hold the heating member to a set temperature at which the fixing can satisfactorily be performed (in the case where the pressurizing member is in the specific temperature range), an electric power at that time is sensed. The operation of raising or lowering the temperature of the heating member is not conducted irrespective of the fixing-enabled temperature range. Consequently, the temperature of the pressurizing member can accurately be sensed, particularly even in the case where the heat capacity of the heating member is large. Furthermore, the temperature of the heating member can stably be maintained with respect to the set temperature.

The present invention has been conducted in view of the fact that, in the case where, when the temperature of the pressurizing member is to be sensed under the condition that a sheet is not present in the pressurized contact portion between the heating member and the pressurizing member, an unnecessarily long period is elapsed after the temperature of the pressurizing member is sensed and before a sheet actually enters the pressurized contact portion between the heating member and the pressurizing member, the temperature of the pressurizing member is varied as a result of an elapse of a period after the temperature of the pressurizing member is sensed and before the sheet actually enters the pressurized contact portion between the heating member and the pressurizing member, resulting in that the heating member, and the pressurizing member have inappropriate temperatures when the sheet actually enters the pressurized contact portion between the heating member and the pressurizing member. (For example, a case where, in a successive sheet supply, the temperature of the pressurizing member is sensed at an elapse of a predetermined time after the previous sheet has passed through the fixing apparatus will be considered. When the set temperature of the heating member is raised with respect to the sensed temperature of the pressurizing member, the pressurizing member receives the heat from the heating member and its temperature is raised during the period before the next sheet actually enters the fixing apparatus. When the time interval between sheets is long (particularly, in an image forming apparatus in which the time interval between sheets is not constant), therefore, the temperature of the pressurizing member when the sheet actually enters the fixing apparatus is raised to a value which is considerably greater than the sensed value, resulting in that paper crinkles or high-temperature offset occurs. In contrast, when the set temperature of the heating member is lowered with respect to the sensed temperature of the pressurizing member, the temperature of the pressurizing member when the sheet actually enters the fixing apparatus is lowered to a value which is considerably greater than the sensed value, with the result that faulty fixing occurs.)

In other words, it is an object of the present invention to set the timing of sensing the temperature of the pressurizing member so that the pressurizing member has an appropriate temperature when a sheet actually enters the fixing apparatus. Specifically, judgment on whether a state where a paper sheet which is the material to be heated is transported to the fixing apparatus exists or not is conducted. If it is judged that the state where the sheet is transported to the fixing apparatus exists, the temperature of the pressurizing member is sensed. Therefore, the temperature of the pressurizing member can be sensed at an instant which is immediately before and as close as possible to the entrance of the sheet into the fixing apparatus.

According to the invention, if it is judged that the state where a sheet is transported to the fixing apparatus exists, the temperature of the pressurizing member is sensed. Therefore, the time delay from the sensing of the temperature of the pressurizing member to the instant when the sheet actually enters the fixing apparatus can be set to be short and always substantially constant regardless of, for example, variation of the time interval between sheets. Consequently, the temperature of the pressurizing member when the sheet actually enters the fixing apparatus is prevented from being made largely different from the sensed temperature of the pressurizing member, so that the temperatures of the heating member and the pressurizing member when the sheet actually enters the fixing apparatus can be set appropriately.

The present invention has been conducted in view of the following fact: Generally, the amount of heat transferred between objects is proportional to the temperature gradient between the objects, and hence the amount of heat transferred between the heating member and the pressurizing member (or the amount of electric power consumed for maintaining the heating member to be a set temperature) is proportional to the temperature gradient between the heating member and the pressurizing member and dose not depend on the absolute value of the temperature of the heating member or the pressurizing member. In other words, when the temperature of the pressurizing member is to be sensed based on the amount of electric power supplied for maintaining the heating member to be the set temperature, the temperature of the pressurizing member cannot be sensed with higher accuracy unless also the temperature of the heating member when the temperature of the pressurizing member is sensed (when the amount of electric power supplied to the heating member is sensed) is considered.

That is, according to the present invention, since the temperature of the pressurizing member which corresponds to the amount of electric power supplied to the heating member is varied depending on the temperature of the heating member at that instance, the temperature of the pressurizing member is sensed based on both the amount of electric power supplied to the heating member, and the temperature of the heating member at that instance, and the set temperature of the heating member is changed based on the sense result. Therefore, the temperature of the heating member with respect to that of the pressurizing member can appropriately be set.

According to an aspect of the present invention, there is provided an image forming apparatus having a process unit for forming an unfixed toner image on a sheet, a fixing unit for fixing the unfixed toner image onto said sheet, by passing the unfixed toner image through a nip of a fixing roller pair consisting a heating roller and a pressurizing roller, a temperature sensing element for sensing temperature of the heating roller, and control means for controlling the temperature of the heating roller to a plural number of set temperature values in accordance with the output signal of the temperature sensing element, the improvement wherein the image forming apparatus comprises: first means for detecting the rotation of the fixing roller pair; and second mens for detecting the presence or absence of the sheet at the nip of the fixing roller pair, in which the control means estimates the quantity of heat accumulated in the pressurizing roller during the period that the rotation of the fixing roller pair is detected and the absence of the sheet at the nip is detected, and switches a set temperature of the fixing roller pair to another in accordance with the estimated value of the heat accumulated in the pressurizing roller.

In the image forming apparatus according to the present invention, the control means controls the temperature of the pressurizing roller by a quantity of heat applied to the heating roller, integrates the quantity of heat applied to the heating roller during the period that the rotation of the fixing roller pair is detected and the absence of the sheet at the nip is detected, and uses the integrated value of the quantity of applied heat for the estimated value of the quantity of the heat accumulated in the pressurizing roller.

In the image forming apparatus according to the present invention, the control means integrates the time that the rotation of the fixing roller pair is detected and the absence of the sheet at the nip is detected, and uses the integrated time for the estimated value of the quantity of the heat accumulated in the pressurizing roller.

In the image forming apparatus according to the present invention, the control means generates a signal for driving the fixing roller pair, and the means for detecting the rotation of the fixing roller pair detects the rotation of the fixing roller pair in accordance with the drive signal generated by the control means.

In the image forming apparatus according to the present invention, the means for detecting the presence or absence of the sheet at the nip of the fixing roller pair detects the presence or absence of the sheet at the nip of the fixing roller pair by a signal from a sensor provided in the paper supply unit of the image forming apparatus.

In the image forming apparatus according to the present invention, the control means retains the estimated value of the quantity of the heat accumulated in the pressurizing roller when the temperature control of the heating roller ends, corrects the estimated value of the quantity of the heat accumulated in the pressurizing roller on the basis of the estimated value that is retained when the temperature control of the heating roller starts, and estimates the estimated value as an initial value of the estimated value.

In the image forming apparatus according to the present invention, the control means estimates estimated value using the elapsing time from the end of the temperature control of the heating roller to correct the estimated value of the quantity of the heat accumulated in the pressurizing roller.

In the image forming apparatus according to the present invention, the control means estimates the estimated value using the output signal of the temperature sensing element at the time of starting the temperature control of the heating roller to correct the estimated value of the quantity of the heat accumulated in the pressurizing roller.

In the image forming apparatus according to the present invention, the control means retains the estimated value of the quantity of the heat accumulated in the pressurizing roller when the temperature control of the heating roller ends, and when the temperature control of the heating roller starts, the control means compares a predetermined temperature determined by the retained estimated value with the sensed temperature outputted from the temperature sensing element, and corrects the estimated value of the quantity of the heat accumulated in the pressurizing roller on the basis of the predetermined temperature when the sensed temperature is higher than the predetermined temperature, and on the basis of the sensed temperature when the sensed temperature is lower than the predetermined temperature.

In the image forming apparatus according to the present invention, wherein the control means estimates the estimated value by gradually varying the estimated value of the quantity of the heat accumulated in the pressurizing roller in accordance with the output signal during the period that the temperature control of the heating roller is not performed.

According to the present invention, the temperature of the pressurizing roller sharply rises when the pressurizing roller rotates in cooperation with the heating roller in a state in which no paper sheet is present therebetween, viz., in an idle rotation of the fixing unit, and the temperature of the pressurizing roller varies little depending on the time that the sheet is present in the nip between the rollers but varies depending on the time of the idle rotation of the fixing unit. This fact was confirmed by our careful study in which the successive printing operations were performed at various paper passage intervals and the temperature rise of the pressurizing roller was carefully analyzed and studied.

A temperature of the pressurizing roller can be predicted by estimating the quantity of heat applied to the pressurizing roller during the idle-rotation time. Accordingly, the heating roller may be set to a proper temperature on the basis of the temperature prediction.

According to the present invention, the thing which absorbs heat from the heating roller during the idle-rotation period is only the pressurizing roller. When the heating roller is controlled to a set temperature, the heating roller is heated by the quantity of heat absorbed by the pressurizing roller. Therefore, the quantity of heat accumulated in the pressurizing roller can be predicted by integrating the quantity of heat applied to the heating roller.

According to the present invention, the quantity of the accumulated heat is related to the integrated value of the idle-rotation time in one to one correspondence.

According to the present invention, after the printing operation ends, the temperature of the pressurizing roller gradually decreases. In this case, the temperature decreasing rate depends on the quantity of heat stored in the pressurizing roller. As recalled, the heat is accumulated mainly during the idle-rotation time. Therefore, the quantity of heat may be determined on the basis of the quantity of heat stored in the pressurizing roller during the idle-rotation time and the idle-rotation period.

According to the present invention, the temperature of the pressurizing roller is predicted on the basis of the information on the time elapsing from the printing operation ends, and the idle-rotation time is corrected using the prediction result. Accordingly, even in the intermittent printing operation, the heating roller can be set to a proper temperature.

According to the present invention, when the heating of the heating roller is stopped after the printing operation ends, the sensed temperature values of the pressurizing roller and the heating roller progressively decrease in a mutual relation. The mutual relation is also influenced by the quantity of heat accumulated in the pressurizing roller. In the image forming apparatuses, the heat quantity is determined by the idle-rotation time, and a temperature relation between the pressurizing roller and the heating roller is predicted on the basis of the determined heat quantity, and the temperature of the pressurizing roller is predicted on the basis of the information of the sensed temperature of the heating roller. Accordingly, even in the intermittent printing operation, the heating roller can be set to a proper temperature.

The fixing apparatus of the invention is an apparatus which comprises a heating member and a pressurizing member that are in contact with each other under pressure, in which a material to be heated which carries an unfixed toner image is nipped by and transported through a pressurized contact portion between the members, and which comprises temperature sensing means for sensing the temperature of the heating member. The fixing apparatus further comprises: temperature control means for proportionally controlling an electric power supplied to the heating member, based on the sensed temperature supplied from the temperature sensing means, and for controlling the temperature of the heating member so that it is at a predetermined target temperature; and heating condition changing means for changing a heating condition based on the target temperature and the sensed temperature when the temperature of the heating member is sensed.

The fixing apparatus of the invention comprises heating condition changing means for estimating the temperature of a pressurizing roller from the target temperature and the sensed temperature when the temperature of the heating member is sensed, and for changing the heating condition based on the estimated temperature of the pressurizing roller.

The fixing apparatus of the invention comprises target temperature changing means for changing a next target temperature based on the target temperature and the sensed temperature.

In the fixing apparatus of the invention, at least the pressurizing member is a rotating body, and the fixing apparatus comprises rotation time setting means for setting a time period during which the rotating body is rotated before the material to be heated reaches the pressurized contact portion, based on the target temperature and the sensed temperature.

The fixing apparatus of the invention comprises no-power supply time setting means for setting a time period during which no electric power is supplied to the heating member, based on the target temperature and the sensed temperature.

The function of the invention will be described by way of an example of a fixing apparatus in which a heating roller is used as the heating member, a halogen lamp disposed in the heating roller is used as the heating element, and a pressurizing roller is used as the pressurizing member, and in which the temperature of the heating roller is sensed by the temperature sensing member, and the amount of electric power supplied to the heating element is proportionally controlled in accordance with the temperature of the heating member, so that the temperature of the heating roller is controlled.

As is well known, in the proportional control, the electric power supplied to the halogen lamp is determined in proportion to the deviation of the temperature of the heating roller sensed by the temperature sensing member from the target temperature.

The heat of the heating roller is dissipated to the pressurizing roller which is in contact with the heating roller, other members which are in contact with the heating roller, and the surrounding air of the heating roller. Specifically, the heat of the heating roller is largely dissipated to the pressurizing roller. Accordingly, if the temperature of the pressurizing roller is low, the amount of heat absorbed from the heating roller into the pressurizing roller is large. In the case of the proportional control, the temperature of the heating roller becomes stable at a low temperature. Conversely, if the temperature of the pressurizing roller is high, the temperature of the heating roller becomes stable at a high temperature. In this way, in the proportional control, the temperature of the heating roller is deviated from the target temperature in proportion to the amount of heat dissipated from the heating roller. It has been found that, by using this phenomenon, the temperature of the pressurizing roller can be estimated from the temperature of the heating roller during the proportional control.

Next, the function of the invention will be described by using expressions.

When the amount of heat supplied to the heating roller is denoted by NI, the amount of heat dissipating from the heating roller is denoted by N0, the heat capacity of the heating roller is denoted by C, and the degree of temperature rise of the heating roller is denoted by ΔT1, the relationship between these values is expressed by the following expression:

$$NI=\Delta 1\cdot C+N0 \quad (1)$$

When the thermally steady state is achieved, the temperature of the heating roller becomes constant and is expressed as follows:

$$\Delta T1=0$$

Accordingly, expression (1) is expressed as:

$$NI=N0 \quad (2)$$

On the other hand, because of the proportional control, the amount NI of heat supplied to the halogen lamp is in proportion to a temperature difference between a target temperature Tc of the heating roller and the current temperature Tm of the heating roller, and is expressed by the following expression:

$$NI=K1\cdot(Tc-Tm)+K2 \quad (3)$$

where K1 and K2 are constants.

The amount N0 of dissipated heat is in proportion to a temperature difference between the temperature Tm of the heating roller and the temperature Tk of the pressurizing roller, so that the amount N0 of dissipated heat is expressed by the following expression:

$$N0=K3\cdot(Tm-Tk) \quad (4)$$

where K3 is a constant.

From expressions (2), (3), and (4), the following expression is obtained:

$$K1\cdot(Tc-Tm)+K2=K3\cdot(Tm-Tk) \quad (5)$$

Expression (5) is changed into the following expression:

$$Tk=(1+K1/K3)\cdot Tm-(K1/K3)\cdot Tc-K2/K3 \quad (6)$$

In the expression above, (1+K1/K3), (K1/K3), and (K2/K3) are constants. When A1, A2, and A3 are substituted therefor, expression (6) is rewritten as follows:

$$Tk=A1\cdot Tm-A2\cdot Tc-A3 \quad (7)$$

From expression (7), it is found that the temperature Tk of the pressurizing roller is obtained from the temperature Tm of the heating roller and the target temperature Tc. That is, the temperature Tk of the pressurizing roller can be estimated with high accuracy from the target temperature Tc and the temperature Tm of the heating roller.

BRIEF DESCRIPTION OF THE DRAWINGS

FIG. 4(*b*) is a graph showing relationships between the temperature of a pressurizing roller and the mean duty in the case where the temperature of a heating roller was 171° C.;

DETAILED DESCRIPTION OF THE INVENTION

Hereinafter, the invention will be described with reference to embodiments and drawings.

Figure 1:
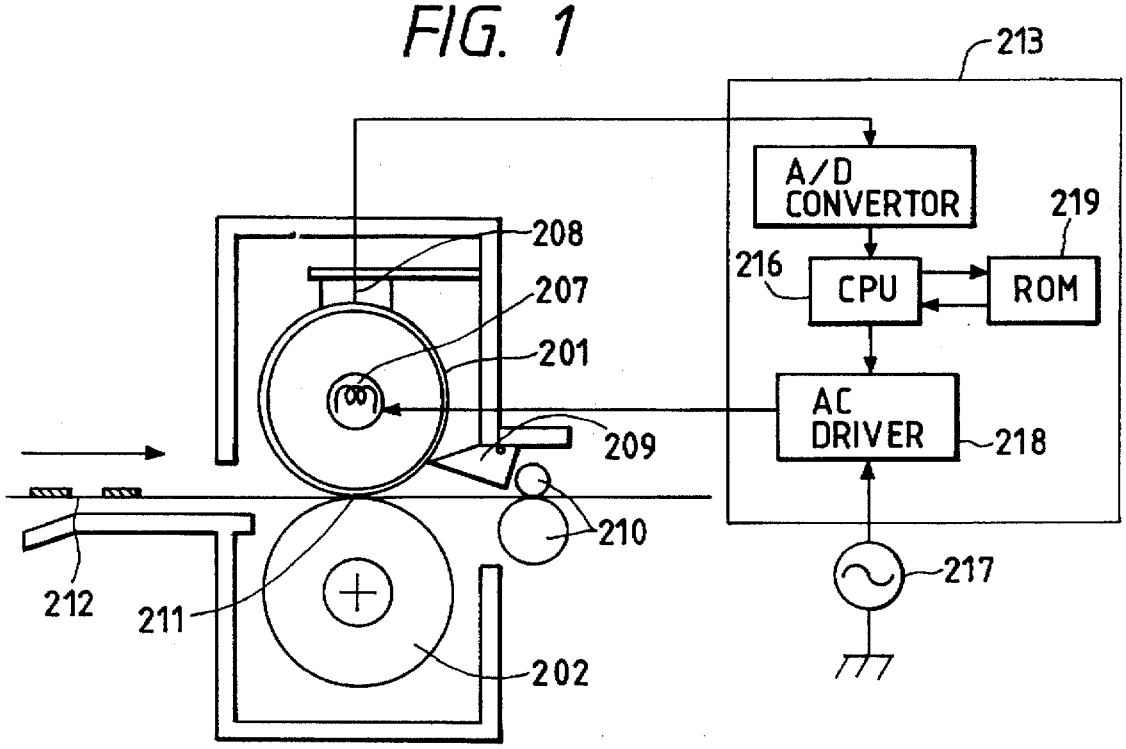
FIG. 1 is a diagram of a fixing apparatus which is an embodiment of the invention.

FIG. 1 is a diagram illustrating a fixing apparatus which is an embodiment of the invention.

The fixing apparatus shown in FIG. 1 is configured by a heating member and a pressurizing member. The heating member comprises a heating roller 201 having a cylindrical shape and made of a metal with good thermal conductivity such as aluminum, and a heating element 207 such as a halogen lamp disposed inside the heating roller 201. The pressurizing member is a pressurizing roller 202 which is formed by surrounding the outer surface of a metal shaft with an elastic material such as silicone rubber. The heating roller 201 and the pressurizing roller 202 are in contact with each other under pressure exerted by loading means (not shown), so as to constitute a pressurized contact portion 211.

In addition, temperature sensing means 208, such as a thermistor, is disposed in contact with the outer surface of the heating roller 201 or in the vicinity of the outer surface of the heating roller 201.

The heating roller 201 and the pressurizing roller 202 are rotated by a driving apparatus (not shown). A paper sheet functioning as a material 212 to be heated enters the pressurized contact portion (nip) between the heating roller 201 and the pressurizing roller 202 along a direction indicated by the arrow. After the fixing is performed in the nip of the fixing apparatus, the paper sheet is discharged from the fixing apparatus.

The fixing apparatus may further comprise as required a peeling claw 209 for peeling the paper sheet from the heating roller 201 after the fixing, a paper discharging roller 210 for smoothly discharging the paper sheet which is discharged from the nip of the fixing apparatus, from the fixing apparatus, and a cleaner such as an oil-impregnated pad for applying a releasing agent such as silicone oil to the surface of the heating roller 201 and for removing the toner stuck to the surface of the heating roller 201.

Next, a method of controlling the temperature of the heating member will be described.

The temperature of the heating member (more specifically, the heating roller 201 which constitutes a part of the heating member) is controlled by the amount of heat dissipated from the heating element 207 disposed inside the heating roller 201. The amount of heat dissipated from the heating element 207 is in turn controlled by the amount of electric power supplied from temperature control means 213. The temperature of the heating roller 201 is sensed by the temperature sensing means 208 which outputs to the temperature control means 213 a signal indicative of the temperature of the heating member. In the temperature control means, a temperature which is to be achieved by the heating member (a temperature which is to be eventually achieved and then maintained by the heating member) is set as the target temperature. In the temperature control means 213, a CPU 216 compares the temperature sensed by the temperature sensing means 208 with the target temperature. The temperature control means 213 controls the amount of electric power supplied to the heating element 207, based on the comparison result.

If the temperature of the heating roller 201 sensed by the temperature sensing means 208 is lower than the target temperature preset in the temperature control means 213, the temperature control means 213 increases the amount of electric power supplied to the heating element 207. Conversely, if the temperature of the heating roller 201 is higher, the temperature control means 213 decreases the amount of electric power supplied to the heating element 207. As a result, the temperature of the heating roller 201 is controlled to be close to the target temperature.

In more detail, a thermistor is used as the temperature sensing means 208. The output of the thermistor is A/D converted by an A/D converter, and then supplied to the CPU 216 functioning as the temperature control means. The CPU 216 compares the output of the thermistor with the target temperature of the heating member stored in a memory (ROM) 219. Based on the comparison result, the CPU 216 controls the electric power supplied to the halogen lamp which is the heating element 207. The temperature control means 213 controls the amount of electric power supplied to the halogen lamp by, for example, controlling the phase and/or the frequency of the AC voltage supplied to the halogen lamp.

An exemplary method of controlling the amount of electric power supplied to the heating element 207 such as a halogen lamp will be described.

A time period during which the electric power is supplied from the temperature control means to the heating element 207 is controlled for each predetermined time interval. Each time interval is referred to as a control period. A ratio of a time period during which the electric power is actually supplied to the heating element 207 to the entire control period is referred to as a duty. If the control period is 1 second and the duty is 10%, for example, the electric power is supplied for 100 ms to the heating element and is not supplied for 900 ms. If the consumed electric power is 400 W at the duty of 100%, the consumed electric power is about 40 W at the duty of 10%. In this way, by changing the duty, the amount of electric power supplied to the heating element 207 can be adjusted so that the temperature of the heating roller 201 is controlled.

Conversely, the electric power supplied to the heating element 207 can be obtained from the duty.

When a halogen lamp is used as the heating element 207, the halogen lamp must be prevented from being supplied with a large current in order to attain a long life period. A halogen lamp has properties that, when the lamp is powered-on, the resistance is low and a large current (inrush current) easily flows. In the case where a halogen lamp is used as the heating element 207, therefore, an inrush current to the halogen lamp is usually suppressed by conducting the zero-cross control, so that the life of the halogen lamp is maintained for a long period. The zero-cross control is a method in which, when an electric power is to be supplied in the form of an AC voltage to the heating element 207, the power supply is not started even when a signal (heater-ON signal) indicating that the power supply to the heating element 207 is started is raised, and the power supply to the heater is started after the AC voltage crosses the zero level. This allows the voltage applied to the heating element 207 to be gradually increased. Therefore, the inrush current is low in level so that the life period of the halogen lamp is prolonged.

Next, the proportional control which is an exemplary method of controlling the amount of electric power supplied to the heating element 207 such as a halogen lamp will be described.

Figure 2:
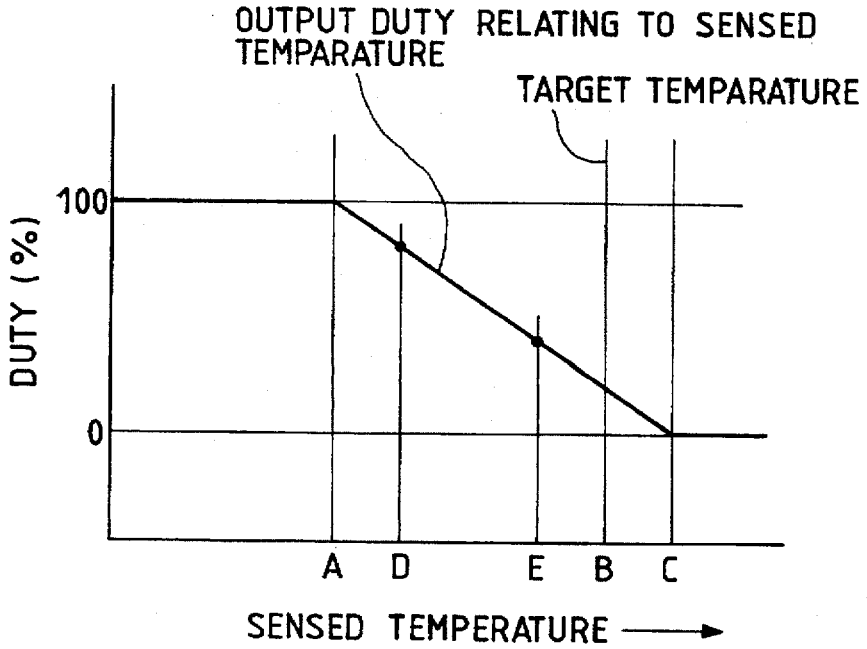
FIG. 2 is a graph showing an exemplary output characteristic of a halogen lamp with respect to a sensed temperature of a heating roller in a proportional control.

In the proportional control, electric power is output in proportion to a difference between the sensed temperature of the heating roller (the temperature sensed by the temperature sensing means 208) and the target temperature. FIG. 2 shows an example of an output characteristic of a halogen lamp with respect to the sensed temperature of the heating roller in the proportional control. The abscissa in FIG. 2 indicates the sensed temperature of the heating roller, and the ordinate indicates the duty.

When the sensed temperature of the heating roller is lower than A, the duty is regarded as 100%, and, when the sensed temperature is equal to or higher than C, the duty is regarded as 0%. Between A and C, a duty which is in proportion to the difference between the sensed temperature of the heating roller and the target temperature B is output. Accordingly, in the proportional control, in the case where the sensed temperature of the heating roller is controlled to the target temperature, when the amount of heat dissipated from the heating roller is large as indicated by point D in FIG. 2, the sensed temperature of the heating roller is low, and a larger amount of electric power is supplied. When the amount of heat dissipated from the heating member is small as indicated by point E in FIG. 2, the sensed temperature of the heating roller is high, and a small amount of electric power is supplied.

Even when the sensed temperature exceeds the target temperature B and stays between B and C, a duty of a small value is required because of the following reason. Since a certain amount of heat is dissipated from the heating roller to the pressurizing roller, a duty corresponding to the amount of dissipated heat is required in order to maintain the steady state.

In addition to the proportional control (P control), a method of outputting an electric power in proportion to an integral of the temperature deviation (I control), and a method of outputting an electric power in proportion to the change rate of a temperature (D control) are known. In general, these P, I, and D controls are used in combination, or the PI control, the PID control, the PD control, and the like are used. It should be understood that the invention can be applied also in the PI control, the PD control, and the PID control which include the P control.

The method of sensing the temperature of the pressurizing member will be described.

The heat of the heating member is dissipated to the surrounding of the heating member, particularly to the pressurizing member with which the heating member is in contact. In the heat dissipation amount of heat dissipated from the heating member depends on the temperature of the pressurizing member (the temperature gradient between the heating member and the pressurizing member).

On the other hand, the amount of electric power supplied to the heating member when the heating member is controlled to the set temperature is in proportion to the amount of heat dissipated from the heating member.

Therefore, the temperature of the pressurizing member can be sensed from the amount of electric power supplied to the heating member.

As described above, the amount of electric power supplied to the heating member can be obtained from the duty of the power supply to the heating member. Consequently, the temperature of the pressurizing member can be sensed based on the duty of the power supply to the heating member, without additionally using power measuring means such as a power meter.

When a sheet passes through the nip of the fixing apparatus, however, the heat of the heating member is hardly transferred to the pressurizing member because the sheet functions as a heat insulator. Furthermore, the amount of heat transferred from the heating member varies depending on the moisture content and the temperature of the sheet. Consequently, it is difficult to accurately sense the temperature of the pressurizing member based on the amount of electric power supplied to the heating member. In order to sense the temperature of the pressurizing member based on the amount of electric power supplied to the heating member, therefore, the amount of electric power supplied to the heating member must be sensed under the state where the amount of heat dissipated from the heating member is substantially controlled by the pressurizing member, i.e., in the period when a sheet is not present in the nip of the fixing apparatus, and the heating member and the pressurizing member are directly in contact with each other.

Accordingly, it is required to judge whether a sheet is present in the nip of the fixing apparatus or not, and sense the temperature of the pressurizing member in a period when a sheet is not present.

As a method of judging whether a sheet is present in the nip of the fixing apparatus or not, the method employed in the embodiment will be described.

Figure 3:
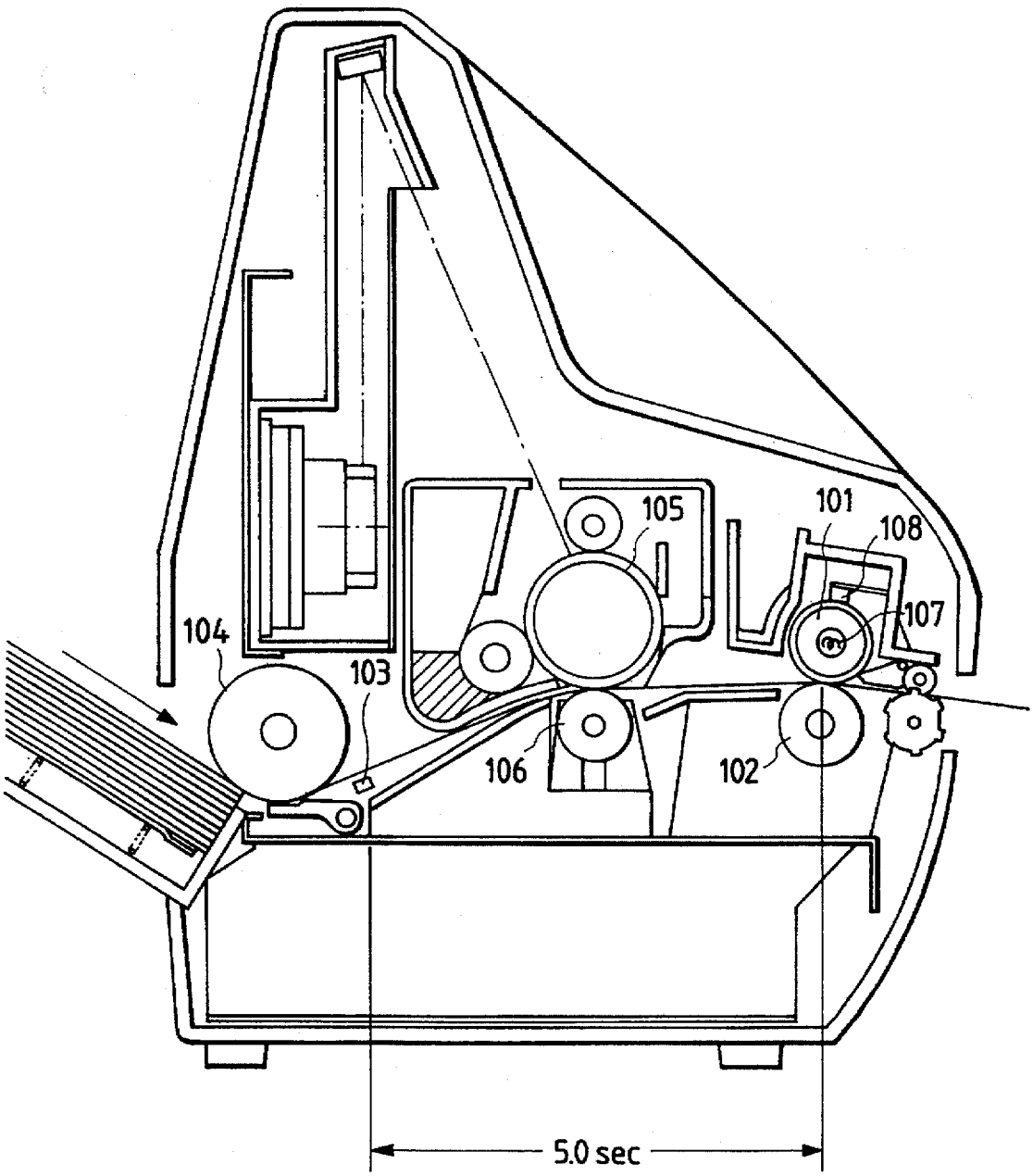
FIG. 3 is a view showing an embodiment of a printer in which the fixing apparatus of the invention is used.

Hereinafter, as an image forming apparatus which uses an embodiment of the fixing apparatus of the invention, an electrophotographic printer will be described. FIG. 3 is a schematic section view of an electrophotographic printer which uses the fixing apparatus of the invention.

As seen from FIG. 3, a paper sheet which is a material to be heated is picked up by a sheet supply roller 104, and the transportation of the sheet to the fixing apparatus is started. The start of the sheet transportation is sensed by state judging means which judges whether a state where the sheet is transported to the fixing apparatus exists or not. In the embodiment, a sheet supply sensor 103 is used as the state judging means. After passing over the sheet supply sensor 103, the sheet is transported to a pressurized contact portion between a photoconductor 105 functioning as an image carrier on which a toner image is formed, and a transfer roller 106 for transferring the toner image on the photoconductor 105 onto the sheet. The toner image is transferred to the sheet in the pressurized contact portion. The sheet onto which the toner image is transferred is further transported to the fixing apparatus, and the toner image is fixed onto the sheet by heat and pressure in a pressurized contact portion between a heating roller 101 and a pressurizing roller 102.

In the printer of the embodiment, the sheet transportation distance between the sheet supply sensor 103 and the nip of the fixing apparatus is 115 mm, and the transportation speed is 23 mm/s. Therefore, a period of 5.0 seconds must be elapsed after the front end of a sheet passes over the sheet supply sensor 103 and before the front end reaches the nip of the fixing apparatus.

In the embodiment, therefore, the state where a sheet is not present in the nip of the fixing apparatus is sensed in the following manner by using the sheet supply sensor 103.

[1] In the start of the printing, a sheet is not present in the nip until a period of 5 seconds is elapsed after the front end of a first sheet passes over the sheet supply sensor 103.

[2] In a successive sheet supply, a sheet is not present in the nip in a period between an instant of an elapse of 5 seconds after the rear end of an n-th sheet passes over the sheet supply sensor, and that of an elapse of 5 seconds after the front end of an (n+1)th sheet passes over the sheet supply sensor.

For example, the time interval between sheets is 3 seconds and a paper sheet of A4-size is transported in the longitudinal direction. It is assumed that the front end of an (n+1)th sheet passes over the sheet supply sensor at an instant of an elapse of 3 seconds after the rear end of an n-th sheet passes over the sheet supply sensor (at this instant, the n-th sheet is present in the nip of the fixing apparatus). When a period of 2 seconds is further elapsed (i.e., at the instant of an elapse of 5 seconds after the rear end of the n-th sheet passes over the sheet supply sensor, or at that of an elapse of 2 seconds after the front end of the (n+1)th sheet passes over the sheet supply sensor), the rear end of the n-th sheet is discharged from the fixing apparatus and the front end of the (n+1)th sheet does not reach the fixing apparatus yet, so that no sheet is present in the nip of the fixing apparatus. When a period of 3 seconds (corresponding to the time interval between sheets) is further elapsed, or when a period of 5 seconds is elapsed after the front end of the (n+1)th sheet passes over the sheet supply sensor, the front end of the (n+1)th sheet reaches the fixing apparatus, resulting in that the (n+1)th sheet is present in the nip of the fixing apparatus.

In the embodiment, in order to conduct judgment on whether a sheet is present in the nip of the fixing apparatus or not, the sheet supply sensor is used as the means for sensing a state where a sheet which is a material to be heated is transported to the fixing apparatus. The invention is not restricted to this. In place of the sheet supply sensor, for example, various control signals such as a sheet supply start signal, and an image formation start signal may be used. Even when a heating member having a large heat capacity is used, the use of such control signals can attain a period during which the temperature of the heating member is sufficiently raised before the transport of a sheet to the fixing apparatus is actually started. In the embodiment, with the objective of maintaining the life of the halogen lamp for a long period, the temperature of the heating member is prevented from being wastefully raised or lowered even when an error occurs in the sheet supply operation and a sheet fails to be supplied. In order to sense that a sheet is surely transported to the fixing apparatus without failure, therefore, the sheet supply sensor senses that a sheet is transported to the fixing apparatus. The sheet supply sensor may be located at any position between the position where the sheet supply is started and the sheet entrance side of the fixing apparatus.

In the embodiment, when the fixing apparatus is rotated, the temperature is controlled to the set temperature, and no sheet is present in the nip of the fixing apparatus, the temperature control means causes the duty of the output to the heating member to be stored in the memory as required. The mean duty is obtained by dividing the total sum of all duties by the total number of outputs from the temperature control means which is stored in the memory. A specific example will be described. In the case where the control period is 1 second and the time interval between sheets is 3 seconds, it is assumed that the duty after 1 second (of an output in a period of 1 second between the instant of an elapse of 0 second after the start of the control and that of an elapse of 1 second) is 60%, the duty after 2 second (of an output in a period of 1 second between the instant of an elapse of 1 second after the start of the control and that of an elapse of 2 seconds) is 55%, and the duty after 3 second (of an output in a period of 1 second between the instant of an elapse of 2 second after the start of the control and that of an elapse of 3 second) is 50%. In this case, the total number of outputs conducted by the temperature control means in the time interval between sheets is three, and the total sum of the duties in the time interval between sheets is 165%. Therefore, the mean duty is 55%. Alternatively, the temperature of the pressurizing member may be sensed based only on the duty of a single specific control period, for example, the duty after 2 seconds. This alternative can obtain a satisfactory result when the temperature variations of the heating member and the pressurizing member of the fixing apparatus are very small or when a toner having excellent fixing and high-temperature offset properties is used. In an actual use, particularly in a usual thermal fixing apparatus using a heating member of a large heat capacity, a temperature variation of plus and minus several degrees centigrade occurs, and hence it is difficult to accurately sense the temperature of the pressurizing member based on one duty. Consequently, the use of a mean value of plural duties is preferable because it can attain a higher accuracy. Also in the embodiment, therefore, the temperature of the pressurizing member is sensed based on a mean duty obtained by averaging plural duties. The invention is characterized in that the temperature of the pressurizing member is sensed in a period during which no sheet is present in the fixing apparatus. Therefore, it is a matter of course that, when a mean duty is to be obtained from plural duties, in a successive sheet supply, the time required for measuring duties which are necessary for obtaining the mean duty (duty measuring time=output number of duties×control period) must not exceed the time interval between sheets, and the control period must sufficiently be shorter than the minimum time interval between sheets.

Generally, a CPU requires a long time for performing a division. In the case where a CPU is used as the temperature control means, therefore, the following countermeasure may be taken. That is, the total sum of duties is calculated in place of calculating a mean value of the duties, and the temperature of the pressurizing member is determined based on the total sum of duties, whereby the burden of the CPU can be reduced and the temperature of the pressurizing member can be sensed more rapidly.

In order to sense the temperature of the pressurizing member based on the amount of electric power supplied to the heating member in the time interval between sheets, the temperature of the pressurizing member, and also electric power supplied to the heating member at which the set temperature of the heating member is to be changed, i.e., the boundary conditions must be defined.

The boundary conditions may be configured in any of various representation forms such as a table, an expression showing the relationships between the temperature of the pressurizing member (and the amount of electric power supplied to the heating member corresponding to the temperature, or the duty of an electric power supplied to the heating member) and the set temperature of the heating member, and an analog circuit.

The method of determining the boundary conditions will be described specifically in First embodiment.

First embodiment

The first embodiment is characterized in that the temperature of the pressurizing member is sensed from the amount of electric power supplied to the heating member in the period when a sheet is not present in the nip of the fixing apparatus, for example, in the time interval between sheets, and the set temperature of the heating member is changed based on the sense result.

In the embodiment, a cylinder made of aluminum (outer diameter: 18 mmϕ, and wall thickness: 0.6 mm) having a covering layer of fluororesin was used as the heating roller 101, and a halogen lamp was disposed as the heating element 107 inside the roller. As the pressurizing roller 102, a roller (outer diameter: 18 mm) in which a silicone rubber layer having 23 degrees of JIS-A hardness was formed on the outer surface of a steel shaft by injection molding was used. The heating roller 101 and the pressurizing roller were in contact with each other under pressure by loading means which is not shown, with total load of 6 kgf.

The electric power supplied to the halogen lamp is controlled by the temperature control means in such a manner that the control period is 1 second and the power supply time is controlled by conducting the duty control.

The way of determining the boundary conditions for changing the set temperature of the heating member will be described.

Figure 4A:
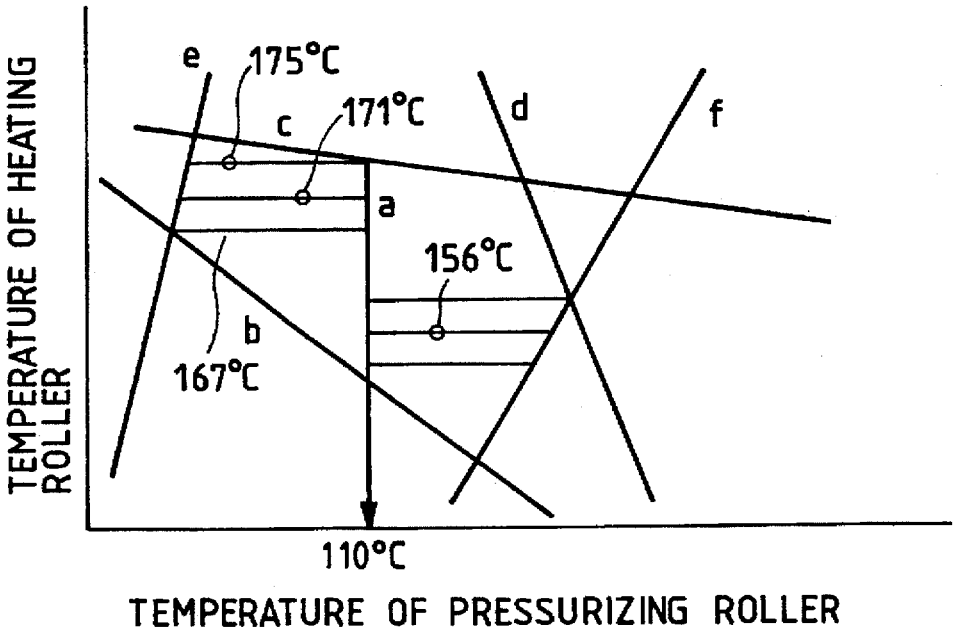
FIG. 4(*a*) is a graph showing occurrence conditions of faulty fixing, paper crinkles and high-temperature offset in the printer used in first embodiment.
Figure 4B:
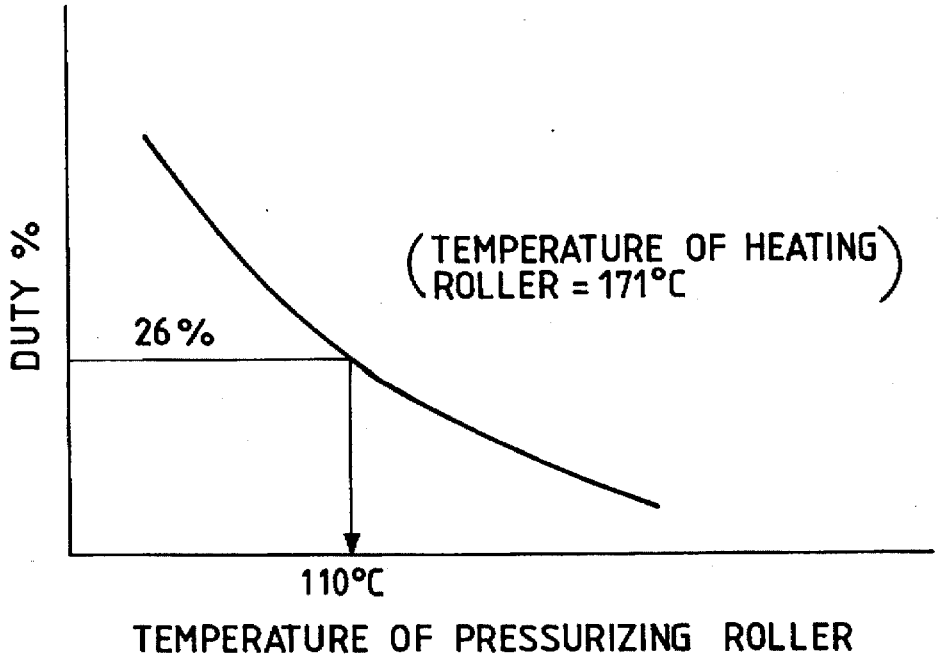

FIG. 4(*a*) is a graph showing occurrence conditions of faulty fixing, paper crinkles and high-temperature offset in the printer used in the embodiment. The abscissa indicates the temperature of the pressurizing roller, and the ordinate indicates the temperature of the heating roller. The temperatures of the pressurizing roller and the heating roller shown in the figure were measured by temperature sensing means which were additionally disposed in the printer only for the purpose of producing FIGS. 4(*a*) and (*b*). The temperature sensing means were removed when images were actually formed in the embodiment.

FIG. 4(*a*) will be described specifically.

When the temperature is lower than line b, faulty fixing occurs, when the temperature is equal to or higher than line c, high-temperature offset occurs, and when the temperature is equal to or higher than line d, paper crinkles occur. The line e indicates the temperature of the pressurizing roller which was obtained immediately before a first sheet entered the fixing apparatus when the printing was started in a state where the pressurizing roller was sufficiently cold. When the printing was successively performed, the temperature of the pressurizing roller was raised, and then saturated. Line f indicates the saturated temperature of the pressurizing roller.

The area wherein faulty fixing, high-temperature offset, and paper crinkles do not occur and the fixing is satisfactorily conducted is a pentagonal area enclosed by lines b to f in FIG. 4(*a*).

FIG. 4(*b*) is a graph showing relationships between the temperature of the pressurizing roller and the mean duty in the case where the temperature of the heating roller was 171° C. The mean duty before a first sheet entered the fixing apparatus was 50 to 60%. In the case such as that the image formation is successively performed, the mean duty is reduced as the temperature of the pressurizing roller is raised. As seen from the figure, when the mean duty corresponding to the amount of electric power supplied to the heating roller is once determined, it is possible to sense the temperature of the pressurizing roller. It will be seen that, in the figure, the temperature of the pressurizing roller is 110° C. when the temperature of the heating roller is 171° C. and the mean duty is 26%.

In the embodiment, the set temperature of the heating roller was first set to be 171° C. so that faulty fixing does not occur even when the pressurizing roller is sufficiently cold (see line e of FIG. 4(*a*)). In the embodiment, however, the variation in the temperature of the heating roller due to the variations in the temperature sensing of the thermistor and the control was ±4 deg. When the set temperature of the heating roller is 171° C., therefore, the actual temperature of the heating roller is 175° C. at the maximum and 167° C. at the minimum.

When the set temperature of the heating roller is 171° C. and the image formation is successively performed, the temperature of the pressurizing roller is raised and then high-temperature offset or paper crinkles occur (see the point of intersection of line c of FIG. 4(*a*) and the maximum value of 175° C. of the variations in the temperature in the case where the set temperature of the heating roller was 171° C.). Consequently, when the temperature of the pressurizing roller is higher than 110° C., the set temperature of the heating roller must be changed from 171° C. In order to prevent high-temperature offset or paper crinkles and faulty fixing from occurring even when the temperature of the pressurizing roller is equal to or higher than 110° C., in the embodiment, the set temperature of the heating roller is changed to 156° C. As seen from FIG. 4(*a*), the change of the set temperature of the heating roller to 156° C. allows the fixing operation to be performed satisfactorily in a state where the temperature of the pressurizing roller is higher than 110° C., even when variations in temperature of the heating roller are considered.

From the above description, it becomes apparent that the fixing operation can always be performed in a satisfactory manner by changing the set temperature of the heating roller to 171° C. or 156° C. in accordance with whether the temperature of the pressurizing roller is higher than 110° C. or not, or whether the mean duty corresponding to the amount of electric power supplied to the heating roller is greater than 26% or not. In the embodiment, the boundary conditions for changing the set temperature of the heating member are determined as shown in Table 1 below.

TABLE 1

| Mean duty | Set temperature |
|---|---|
| 26% or more | 171° C. |
| less than 26% | 156° C. |

It should be noted that all the values shown in FIGS. 4(*a*) and 4(*b*), and Table 1 are those which were experimentally determined for the fixing apparatus having the construction of Embodiment 1. It is a matter of course that, when a fixing apparatus having a different construction is to be used, the boundary conditions must be defined in accordance with the construction of the fixing apparatus with following the procedure of Embodiment 1. (Even in the case where fixing apparatuses are identical in construction, when the kinds of used toner or the like are different from each other, the fixing apparatuses naturally have different boundary conditions.)

In the printer of the embodiment, when the image formation was successively performed, the time interval between sheets was fixed to 3 seconds. In the case where the amount of image data was so large that a long time was required to transfer the image data and to develop the image data and the image formation cannot be completed before an elapse of the 3-second period, or the time interval between sheets, the image formation process was once stopped (waiting state) in order to reduce the power consumption of the printer. After the development of the image data was completed, the image formation was restarted. The waiting state is a state in which the main power source of the printer is turned on but the image forming operation is not performed. In the waiting state, the supply of electric power to the halogen lamp is stopped so as to reduce the power consumption. When the image formation is enabled (in this case, when the development of the image data is completed), the power supply to the halogen lamp is started. Of course, during the time interval between sheets (in the embodiment, fixed to 3 seconds) in the case where the image formation is successively performed, printer is not in the waiting state, and, the image forming operation is continued. Therefore, the power supply to the halogen lamp is conducted also in the time interval between sheets.

Experimental example 1

The example is an experimental example with respect to the start of the image forming operation.

When a printer in the waiting state receives the image formation start signal, the temperature control means first sets the set temperature of the heating roller to 171° C., supplies an electric power to the heating roller (the halogen lamp which is a heating element for heating the heating roller), and controls the fixing apparatus so as to start the operation. Then a paper sheet is supplied. At the same time when the front end of the sheet passes over the sheet supply sensor, duties output from the temperature control means start to be accumulated in the memory. At an elapse of 5 seconds after the front end of the sheet passes over the sheet supply sensor, the mean duty corresponding to the amount of electric power supplied to the heating roller in the period of 5 seconds after the front end of the sheet passes over the sheet supply sensor is calculated. Based on the calculated mean duty, the set temperature of the heating roller was changed in accordance with Table 1 above.

Figure 5:
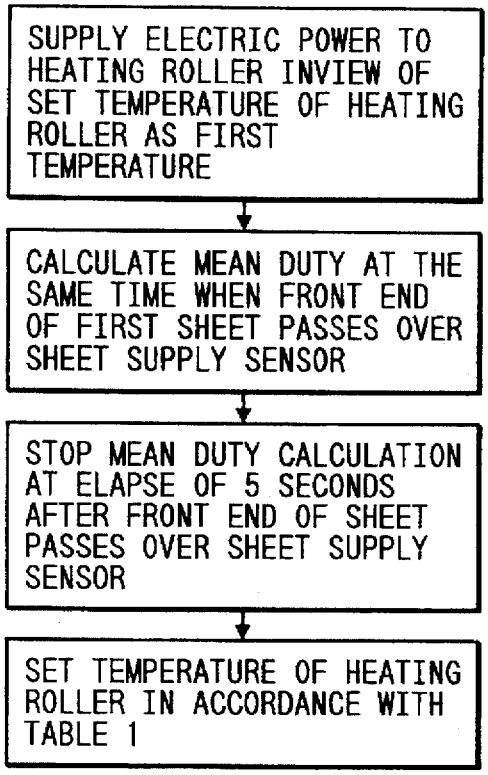
FIG. 5 is a chart of an algorithm showing a method of determining the set temperature for the first sheet in the successive sheet supply according to the invention.

FIG. 5 shows the algorithm of the experimental example, i.e., that for determining the set temperature of the heating roller at the start of the image forming operation.

Hereinafter, the set temperature of the heating roller which is set at the start of the operation of the fixing apparatus when the image forming operation is started is provisionally called the first temperature. In the experimental example, the first temperature was set to 171° C. However, the first temperature may have any value as far as it can be selected as the set temperature of the heating roller (in the experimental example, either of 156° C. and 171° C. listed in Table 1). Since the heating roller, and the pressurizing roller have a substantially low temperature in the waiting state, the first temperature is preferably selected to be the highest set temperature among temperatures selectable as the set temperature of the heating roller, in order to shorten the warm-up time of the fixing apparatus. During an actual fixing operation, the set temperature of the heating roller is not the first temperature, but the set temperature which is determined based on the mean duty corresponding to the amount of electric power supplied to the heating roller which is controlled to the first temperature (in order to distinguish the set temperature from the first temperature, the set temperature is provisionally called the second temperature). It is an object of the invention to accurately control the second temperature in accordance with the temperature of the pressurizing roller. In order to accurately determine the temperature of the pressurizing roller, therefore, it is preferable to conduct the control with using as the set temperature of the heating roller (the first temperature of the experimental example), the temperature of the heating roller which is used as the criterion in the determination of the boundary conditions, i.e., the mean duty of the heating roller corresponding to the temperature of the pressurizing roller (in the experimental example, 171° C., see FIG. 4(*b*)), because the temperature of the pressurizing roller can be sensed more accurately and in turn the set temperature of the heating roller (second temperature) in an actual fixing operation can be determined more correctly. In the experimental example, the first temperature was set to 171° C. because of the reason discussed above.

In the experimental example, even in the case where an image was formed when the pressurizing roller was cold, no faulty fixing occurred. Even in the case where an image was formed when the temperature of the pressurizing roller was high, moreover, paper crinkles and high-temperature offset did not occur.

Experimental example 2

The example is an experimental example with respect to the successive sheet supply (the case where images are formed successively).

Figure 6:
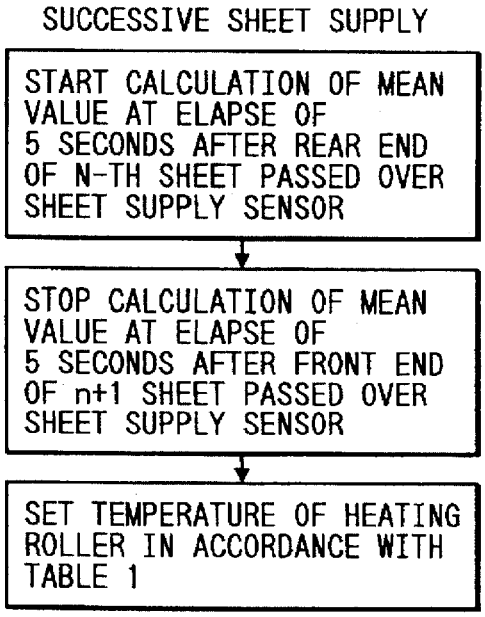
FIG. 6 is a chart of an algorithm showing a method of determining the set temperature in the successive sheet supply according to the invention.

When the image formation is successively performed, the temperature of the pressurizing roller is raised. In the experimental example, therefore, the control temperature of the heating roller was determined in the time interval between sheets from the mean duty as shown in the algorithm of FIG. 6, and then the temperature was adjusted. (In the experimental example, image data are adjusted so as to prevent the printer from entering the waiting state during the successive sheet supply, or to sequentially supply sheets with the time interval of 3 seconds during the successive sheet supply, and the successive sheet supply is performed so that the temperature of the pressurizing roller is raised at the highest rate.)

The mean duty in the example was obtained in the following manner.

The calculation of a mean value of duties was started at an elapse of 5 seconds after the rear end of the n-th sheet passed over the sheet supply sensor. The calculation was ended at an elapse of 5 seconds after the front end of the (n+1)th sheet passed over the sheet supply sensor. Based on the mean duty obtained as a result of the calculation, the temperature of the heating roller was set in accordance with Table 1.

The set temperature of the heating roller for the first sheet was determined in the same manner as Experimental example 1.

In the experimental example, even after the successive supply of 100 sheets, paper crinkles and high-temperature offset did not occur.

In the experimental example, the set temperature of the heating roller at the entrance of the n-th sheet into the fixing apparatus is determined based on the set temperature of the heating roller at the entrance of the (n−1)th sheet into the fixing apparatus, and the set temperature of the heating roller at the entrance of the (n+1)th sheet into the fixing apparatus is determined based on the set temperature of the heating roller at the entrance of the n-th sheet into the fixing apparatus.

It is an object of the invention to, in the time interval between sheets before a sheet actually enters the fixing apparatus, accurately set the set temperature of the heating roller at the entrance of the sheet actually into the fixing apparatus, in accordance with the temperature of the pressurizing roller.

In order to accurately determine the temperature of the pressurizing roller, therefore, it is preferable to conduct the control with using as the set temperature of the heating roller, the temperature of the heating roller which is used as the criterion in the determination of the mean duty of the heating roller corresponding to the temperature of the pressurizing roller (in the experimental example, 171° C., see FIG. 4(*b*)), because the temperature of the pressurizing roller can be sensed more accurately and in turn the set temperature of the heating roller in an actual fixing operation can be determined more correctly.

Therefore, the temperature of the pressurizing roller can be sensed more accurately in the following manner. Namely, the set temperature of the heating roller at the entrance of the n-th sheet into the fixing apparatus is not determined based on the set temperature of the heating roller at the entrance of the (n−1)th sheet into the fixing apparatus. Each time after the (n−1)th sheet is discharged from the fixing apparatus, irrespective of the set temperature of the heating roller at this time, the set temperature of the heating roller is immediately set to the temperature of the heating roller which is used as the criterion in the determination of the boundary conditions (when the description is done in accordance with the experimental example, the set temperature of the heating roller is always set to 171° C. in the time interval between the (n−1)th and n-th sheets), and then the temperature of the pressurizing roller is sensed. When the n-th sheet enters the fixing apparatus, therefore, the more optimum temperature of the heating roller can be set. As compared with the experimental example, the method in which, in order to more appropriately set the set temperature of the pressurizing roller (hereinafter, the description will be done in accordance with the construction of the embodiment), after a sheet is discharged from the fixing apparatus, the set temperature of the heating roller is always set to 171° C. in the time interval between sheets may wastefully consume an electric power in the time interval between sheets and shorten the life period of the heating element because of he following reason. The case where the set temperature of the heating roller when the (n−1)th sheet passes through the fixing apparatus is 156° C., and also the set temperature of the heating roller when the n-th sheet passes through the fixing apparatus is 156° C. will be considered. In the experimental example, the set temperature of the heating roller is required only to be maintained at 156 ° C. during this period. By contrast, in the method in which the set temperature of the heating roller is always controlled to 171° C. in the time interval between sheets, the set temperature of the heating roller is controlled to 171° C. in the time interval between sheets, regardless of the set temperature of the heating roller for the n-th sheet, thereby sometimes causing the wasteful power consumption and the shortened life period of the heating element.

As described above, the selection of the set temperature of the heating roller in the time interval between sheets is conducted in various view points. In the experimental example, since no practically problematic phenomenon occurred at either of the set temperatures of the heating roller in the time interval between sheets, i.e., at either of 156° C. and 171° C., the temperature of the heating roller at the entrance of the n-th sheet into the fixing apparatus was determined based on the set temperature of the heating roller at the entrance of the (n−1)th sheet into the fixing apparatus, and the temperature of the heating roller at the entrance of the (n+1)th sheet into the fixing apparatus is determined based on the set temperature of the heating roller at the entrance of the n-th sheet into the fixing apparatus.

Second embodiment

The second embodiment is different from the first embodiment in the wall thickness of the heating roller, and is characterized in that, when the set temperature of the heating member is to be changed, the change of the set temperature of the heating member is conducted with prospecting the time required for the temperature of the heating member to actually reach the set temperature.

In the embodiment, in order to enhance the temperature stability of the heating roller in a sheet-passing period, the wall thickness of the heating roller is increased to 1.7 mm so that the heat capacity of the heating roller is increased.

Also in the second embodiment, in the same manner as the first embodiment, the boundary conditions, i.e., the mean duty of the heating roller corresponding to the temperature of the pressurizing roller was experimentally obtained, and results similar to those of first embodiment were attained. Also in the embodiment, therefore, the set temperature of the heating roller was determined based on Table 1 in the same manner as first embodiment.

In the embodiment, however, the increased thickness of the heating roller causes the time required for the heating roller to reach the set temperature when the heating roller is controlled to the set temperature, to be longer than that in the first embodiment. Specifically, when the set temperature of the heating roller is changed, the heating roller requires about 3 seconds to reach the changed set temperature.

In the fixing apparatus of the embodiment, therefore, when the set temperature of the heating roller is changed substantially simultaneously with the entrance of a sheet into the fixing apparatus in the same manner as the first embodiment, the heating roller cannot satisfactorily reach the changed set temperature at the time when the sheet actually enters the fixing apparatus.

To comply with the above, in the embodiment, the set temperature of the heating roller is determined 3 seconds before the sheet enters the fixing apparatus, and the determined temperature is then changed as required.

Specifically, the embodiment is different from the first embodiment in the wall thickness of the heating roller, and in that, conforming to the increased thickness, the change of the set temperature of the heating roller is done in advance with prospecting the time required for the temperature of the heating roller to actually reach the set temperature.

The embodiment will be described with respect only to the start of the image forming operation. It is a matter of course that the same effects can be attained also in the case of the time interval between sheets in the successive sheet supply.

When a printer in the waiting state receives the image formation start signal, the temperature control means first sets the set temperature of the heating roller to 171° C., supplies an electric power to the heating roller, and controls the fixing apparatus so as to start the operation. Then a paper sheet is supplied. At the same time when the front end of the sheet passes over the sheet supply sensor, duties output from the temperature control means start to be accumulated in the memory. At an elapse of 2 seconds after the front end of the sheet passes over the sheet supply sensor, the mean duty corresponding to the amount of electric power supplied to the heating roller in the period of 2 seconds after the front end of the sheet passes over the sheet supply sensor is calculated. Based on the calculated mean duty, the set temperature of the heating roller was changed in accordance with Table 1 above.

In the embodiment, faulty fixing, paper crinkles, and high-temperature offset did not occur irrespective of the initial temperature of the pressurizing roller.

Since the heating roller has a large heat capacity and the temperature of the heating roller is stabilized, the temperature of the heating roller was prevented from being lowered at the rear end of a sheet, so as to eliminate faulty fixing, even when the environmental temperature of the printer was low (a thick sheet, or that of a low temperature was passed through), or when a long sheet elongating in the transportation direction of the fixing apparatus (e.g., legal-size paper, or continuous document paper) was used.

Third embodiment

The third embodiment is characterized in that judgment on whether a state where a sheet is transported to the fixing apparatus exists or not is conducted, and, if it is judged that a state where the sheet is transported to the fixing apparatus exists, the temperature of the pressurizing member is sensed, whereby the temperature of the pressurizing member can be sensed at an instant which is immediately before and as close as possible to the entrance of the sheet into the fixing apparatus. The embodiment has effects that, particularly in an image forming apparatus in which the time interval between sheets is not constant, even if the temperature of the pressurizing roller is raised when the time interval between sheets is long, paper crinkles and high-temperature offset do not occur, and that excellent image fixability can be ensured even when the pressurizing roller is cold.

The printer of the embodiment is different from the first embodiment in that the time interval between sheets in the case where the image formation is successively performed is not constant. (However, the time interval between sheets is set to 3 seconds at the minimum.) Specifically, in the printer of the embodiment, even in the case where the amount of image data is so large that a long time is required to transfer the image data and to develop the image data when the image formation is successively performed, the image formation process is not temporarily stopped (after the image formation process is once started, the printer does not enter the waiting state until all the image forming operations are completed). During when the image formation is successively performed, therefore, the printer is in the state where the image forming operation is continued also during the transfer or the development of image data, and the time interval between sheets is not constant. Furthermore, it is needless to say that the supply of an electric power to the halogen lamp is continued in the time interval between sheets.

When the temperature of the pressurizing member is to be sensed in the time interval between sheets during the successive sheet supply, the temperature of the pressurizing member may be sensed as first embodiment by sensing an electric power supplied to the heating member during the whole period of the time interval between sheets. In such a case, when the time interval between sheets is long, the temperature of the pressurizing member is raised before a sheet actually enters the pressurized contact portion between the heating member and the pressurizing member, and hence the temperatures of the heating member and the pressurizing member become inappropriate at the instant when the sheet actually enters between the heating member and the pressurizing member.

To comply with this, in the embodiment, the mean duty corresponding to the amount of electric power supplied to the heating roller is obtained by the following method. Unlike first embodiment in which duties are sampled at each control period during the whole period of the time interval between sheets, duties are sampled only during a predetermined partial period of the time interval between sheets, so that the timing and the number of sampling duties are different from those of first embodiment.

In the embodiment, among a series of duties output from the temperature control means to the heating member in the time interval between sheets, the duty output immediately before a sheet enters the nip of the fixing apparatus, and that output preceding the duty are averaged to obtain a mean value of the two duties. The temperature of the pressurizing roller is sensed based on the mean duty, and the set temperature of the heating roller is determined in accordance with the sense result.

Hereinafter, the embodiment will be described specifically with reference to an experimental example.

Experimental example 3

Figure 7:
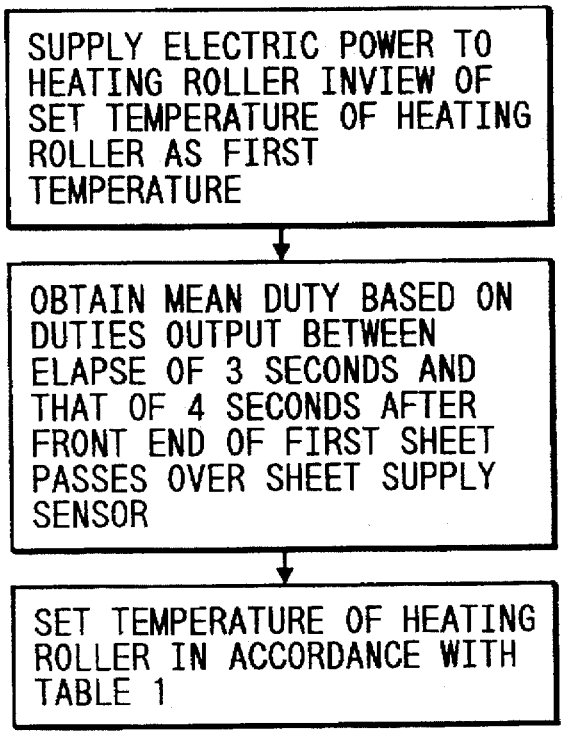
FIG. 7 is a chart of another algorithm showing a method of determining the set temperature for the first sheet in the successive sheet supply according to the invention.

When the image forming operation is to be started, i.e., before a first sheet enters the fixing apparatus, the set temperature of the heating roller is first determined by the algorithm of FIG. 7.

Specifically, when a printer in the waiting state receives the image formation start signal, the first temperature (in the embodiment, 171° C.) is set to be the set temperature, the temperature of the heating roller is raised, and the driving is started. Next, the operation of supplying a first sheet is started. The front end of the sheet enters the nip of the fixing apparatus at an elapse of 5 seconds after it passes over the sheet supply sensor.

In the experimental example, duties which are output at an elapse of 3 seconds and that of 4 seconds after the front end of the sheet passes over the sheet supply sensor (specifically, since the control period of an electric power supplied to the heating member is 1 second, duties output to the heating member between a elapse of 2 seconds and that of 3 seconds after the front end of the sheet passes over the sheet supply sensor, and duties output to the heating member between an elapse of 3 seconds and that of 4 seconds after the front end of the sheet passes over the sheet supply sensor) were averaged, thereby obtaining the mean duty. Based on the mean duty, the set temperature of the heating roller was obtained in accordance with Table 1.

Figure 8:
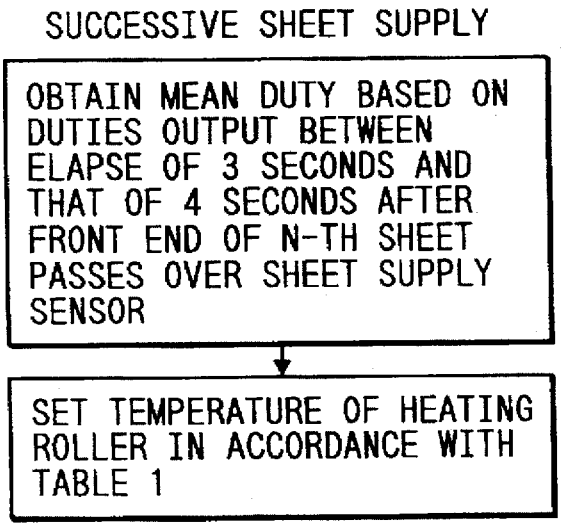
FIG. 8 is a chart of another algorithm showing a method of determining the set temperature in the successive sheet supply according to the invention.

Thereafter, for the second succeeding sheets, the set temperatures of the heating member in the case where the image formation was successively performed were determined by the algorithm of FIG. 8.

In this way, duties output to the heating member at an elapse of 3 seconds and that of 4 seconds after the front end of the n-th sheet passes over the sheet supply sensor were averaged, thereby obtaining the mean duty. From the mean duty obtained as a result of the calculation, the set temperature of the heating roller was obtained in accordance with Table 1. Then the n-th sheet was subjected to the fixing operation.

In the experimental example, even when the amount of image data was large and the time interval between sheets was as long as 30 seconds, paper crinkles and high-temperature offset did not occur. Even when the temperature of the pressurizing roller was low, furthermore, faulty fixing was prevented from occurring.

Experimental example 4

The experimental example is identical with Experimental example 3 except that the control period of an electric power supplied to the heating member was 0.1 seconds, and the minimum time interval between sheets was set to 2 seconds.

From a mean value of duties which were output in a period from 1.5 to 0.5 seconds before a sheet entered the fixing apparatus (a period between an elapse of 3.5 seconds and that of 4.5 seconds after the front end of the sheet passed over the sheet supply sensor) (i.e., duties output in the period between 0.5 seconds before the entrance of the sheet into the fixing apparatus and the entrance of the sheet into the fixing apparatus were not included in the calculation), the temperature of the pressurizing roller was sensed.

Even when the amount of image data was large and the time interval between sheets was as long as 30 seconds, paper crinkles and high-temperature offset did not occur. Even when the temperature of the pressurizing member was low, furthermore, faulty fixing was prevented from occurring. As described above, even the calculation of the mean duty which does not include duties output immediately before the entrance of a sheet does not fall outside the spirit of the invention and can attain the same effects.

Fourth Embodiment

The fourth embodiment is an embodiment which is different from third embodiment in the control period of the power supply to the heating member, and in the number of operations of sampling an electric power supplied to the heating member which is used for determining the set temperature of the heating member. In other words, this embodiment is different from the third embodiment in the time required for measuring necessary duties.

As described above, the set temperature of the heating roller can accurately be determined by using the mean duty obtained averaging plural duties supplied to the heating roller.

When the mean duty is to be obtained from plural duties, however, the time T required for measuring duties which are necessary for obtaining the mean duty (duty measuring time) must be consumed.

$$T=(\text{output number of duties})\times(\text{control period})$$

If the time T is set to be excessively long, the temperature of the pressurizing roller is raised while measuring a plurality of duties, with the result that the temperature of the pressurizing roller at the entrance of a sheet into the fixing apparatus is considerably higher than the temperature of the pressurizing roller corresponding to the mean duty. This may cause the set temperature of the heating roller to be inappropriate so that high-temperature offset or paper crinkles may occur. Therefore, T must be sufficiently short.

To comply with this, in this embodiment, the duty measuring time (i.e., the time required for calculating the mean duty) is considered.

The printer of the embodiment is different from the first embodiment in that the time interval between sheets when the image formation is successively performed is fixed to 20 seconds, and that, even in the case where the amount of image data is so large that a long time is required to transfer the image data and to develop the image data when the image formation is successively performed, the image formation process is not temporarily stopped (the printer does not enter the waiting state, and, when the time interval between sheets exceeds 20 seconds, the image formation process is forcedly started).

In the embodiment, the output number of duties to be averaged was 2, 4, 8, or 16 so that T was 2, 4, 8, or 16 seconds.

The relationship between T and high-temperature offset or paper crinkles will be described. Specifically, results of the fixing state (high-temperature offset and paper crinkles) obtained when the image formation was continuously performed on 100 sheets are listed in Table 2.

In Table 2, the case where high-temperature offset and paper crinkles did not occur is indicated by ○, the case where high-temperature offset or paper crinkles slightly occurred (no problem in a practical view point) is indicated by Δ, and the case where high-temperature offset or paper crinkles seriously occurred (problematic in a practical view point) is indicated by x.

As seen from Table 2, when T was not longer than 4 seconds, high-temperature offset or paper crinkles did not occur.

Therefore, it is preferable to set T to be equal to or shorter than 4 seconds.

TABLE 2

| T | Occurrence of high-temperature offset or paper crinkles |
|---|---|
| 2 seconds | ○ |
| 4 seconds | ○ |
| 8 seconds | Δ |
| 16 seconds | X |

Fifth embodiment

The fifth embodiment is different from first and third embodiments in the boundary conditions for determining the set temperature of the heating roller.

Table 3 below shows relationships between the set temperature of the heating roller and the mean duty of an electric power supplied to the heating roller.

TABLE 3

| Mean duty | Set temperature |
|---|---|
| 33% or more | 170° C. |
| 21% or more less than 33% | 160° C. |
| less than 21% | 140° C. |

In the embodiment, three kinds of set temperatures of the heating roller were used. Namely, irrespective of the set temperature of the heating roller when the temperature of the pressurizing roller was sensed (when the mean duty of an electric power supplied to the heating roller was measured), the set temperature was 170° C. when the mean duty of an electric power supplied to the heating roller was equal to or greater than 33%, 160° C. when the mean duty was equal to or greater than 21% and less than 33%, and 140° C. when the mean duty was less than 21%.

The boundary conditions listed in Table 3 and relating to the set temperature of the heating roller are obtained in the same procedure as that of first embodiment (see FIGS. 4(*a*) and 4(*b*)).

The other portions are configured in the same manner as those of third embodiment (Experimental example 3).

In the embodiment, even in the case where the continuous printing was performed when the pressurizing roller was cold, no faulty fixing occurred. Even in the case where the continuous printing was restarted immediately after the continuous printing was done, paper crinkles and high-temperature offset did not occur.

Sixth embodiment

The sixth embodiment is different from first and third embodiments in the boundary conditions for determining the set temperature of the heating roller. Specifically, in the embodiment, unlike the embodiments described above, in addition to the mean duty of an electric power supplied to the heating roller (corresponding to the temperature of the pressurizing roller), also the set temperature of the heating roller when the mean duty is measured is used as the boundary conditions for determining the set temperature of the heating roller. The set temperature of the heating roller is determined based on both the mean duty and the set temperature of the heating roller. In other words, the embodiment is characterized in that the mean duty for determining the set temperature is varied depending on the set temperature at that time. As described above, the relationships between the temperature of the pressurizing roller and the mean duty of electric power supplied to the heating roller depend on the temperature of the heating roller. Therefore, the construction of the embodiment enables the temperature of the pressurizing roller to be sensed more accurately so that the temperature of the heating roller is set more appropriately.

Table 4 shows relationships in the embodiment between the set temperature of the heating roller, the mean duty of an electric power supplied to the heating roller, and the set temperature of the heating roller when the mean duty is measured.

TABLE 4

| Set temp at measuring mean duty | 170° C. | 160° C. | 140° C. | Set Temp (after Changed) |
|---|---|---|---|---|
| mean duty | 38% or more | 33% or more | 22% or more | 170° C. |
| mean duty | 26% or more and less than 38% | 21% or more and less than 33% | 11% or more and less than 22% | 160° C. |
| mean duty | less than 26% | less than 21% | less than 11% | 140° C. |

The method of determining the set temperature of heating roller will be described with reference to Table 4.

When the set temperature of the heating roller when the mean duty of an electric power supplied to the heating roller is measured is 170° C. and the mean duty at this time is less than 26% (corresponding to the case where the temperature of the pressurizing roller is equal to or higher than 110° C.), for example, the set temperature of the heating roller is set to 140° C. When the set temperature of the heating roller when the mean duty is measured is 160° C. and the mean duty at this time is equal to or greater than 33% (corresponding to the case where the temperature of the pressurizing roller is lower than 90° C.), for example, the set temperature of the heating roller is set to 170° C. When the set temperature of the heating roller when the mean duty is measured is 140° C. and the mean duty at this time is equal to or greater than 11% and less than 22% (corresponding to the case where the temperature of the pressurizing roller is equal to or higher than 90° C. and lower than 110° C.), for example, the set temperature of the heating roller is set to 160° C.

The boundary conditions listed in Table 4 and relating to the set temperature of the heating roller are obtained in the same procedure as that of first embodiment. When also the set temperature of the heating roller when the mean duty is measured is included in the boundary conditions as in the case of the embodiment, however, the temperature of the heating roller which is used as the criterion in the determination of the mean duty of the heating roller corresponding to the temperature of the pressurizing roller (see FIG. 4(*b*)) must be obtained for all the temperatures selectable as the set temperature of the heating roller (in the embodiment, 140° C., 160° C., and 170° C.). According to the embodiment, however, the temperature of the pressurizing roller can be sensed more accurately and in turn the set temperature of the heating roller in an actual fixing operation can be determined more correctly.

The other portions were configured in the same manner as those of third embodiment (Experimental example 3), and then the image forming operations were performed with the result that faulty fixing, paper crinkles, and high-temperature offset did not occur also in the embodiment.

The fixing enabled and excellent area indicated in FIG. 4(*a*) shows the range where faulty fixing, paper crinkles, and high-temperature offset do not occur. When the temperatures of the heating roller and the pressurizing roller are set to be in the range, fixing which is entirely free from a problem in a practical view point can be performed. In order to further improve the quality of a fixed image, gloss unevenness on the surface of a printed object must be prevented from occurring. In order to prevent gloss unevenness from occurring, it is required to sense the temperature of the pressurizing roller further accurately. In the embodiment, no gloss unevenness was observed.

In the above, the embodiments of the invention have been described. The invention is not restricted to them.

Preferably, the heating roller 101 is a cylinder which is made of a metal with good thermal conductivity such as aluminum and has an outer diameter of 10 to 30 mm. As required, the outer diameter at the center along the axial direction may be different from that at an end portion. The pressurizing roller 102 preferably has a construction in which an elastic material such as silicone rubber is formed around a shaft made of a metal such as copper or stainless steel by injection molding or the like. The elastic material preferably has a small degree of compression set, resistances such as that toner is prevented from sticking, an outer diameter of 10 to 30 mm, and a hardness of 16 to 60 degrees in JIS-A. As required, also in the pressurizing roller 102, the outer diameter at the center along the axial direction may be different from that at an end portion.

Although not particularly exemplified, it is a matter of course that, according to the fixing apparatus of the invention, the temperatures of the heating member and the pressurizing member at the entrance of the sheet into the fixing apparatus can be set appropriately, irrespective of the set temperature of the heating member when the image forming apparatus is in the waiting state, or whether the fixing apparatus is rotated at the start of the image forming operation or not.

According to the fixing apparatus of the invention, an electric power supplied to the heating member when in the period when a sheet is not present in the nip between the heating member and pressurizing member is sensed, whereby the temperature of the pressurizing member can accurately be sensed without additionally disposing means for sensing the temperature of the pressurizing member, and without being influenced by a member other than the pressurizing member. Therefore, temperature sensing means of the contact type for sensing the temperature of the pressurizing member is not necessary, and hence the pressurizing member is prevented from being worn or damaged.

According to the fixing apparatus of the invention, the temperature of the heating member can appropriately be set in accordance with the temperature of the pressurizing member. Even when the temperature of the pressurizing member is varied (for example, depending on the use history of the apparatus or the time interval between sheets), therefore, faulty fixing due to insufficient heating, paper crinkles, and high-temperature offset can be prevented from occurring.

In the fixing apparatus of the invention, even when the temperature of the pressurizing member is sensed, an electric power remains to be supplied to the heating member. Therefore, it is easy to control the heating member to have a desired temperature at the entrance of the sheet into the fixing apparatus. When the temperature of the pressurizing member is appropriate with respect to the set temperature of the heating member, moreover, it is possible to immediately start the fixing operation, so that the quick start is enabled. This is effective particularly in a fixing apparatus having a large heat capacity.

Furthermore, the temperature of the pressurizing member is sensed based on both the amount of electric power supplied to the heating member and the temperature of the heating member at that time, and the set temperature of the heating member is changed in accordance with the sense result, whereby the temperature of the heating member with respect to the temperature of the pressurizing member can be set more appropriately. Therefore, also gloss unevenness can be prevented from occurring.

When the invention is applied to an image forming apparatus such as a printer, a facsimile apparatus, or a copy machine, particularly excellent effects can be attained.

Seventh embodiment

Figure 9:
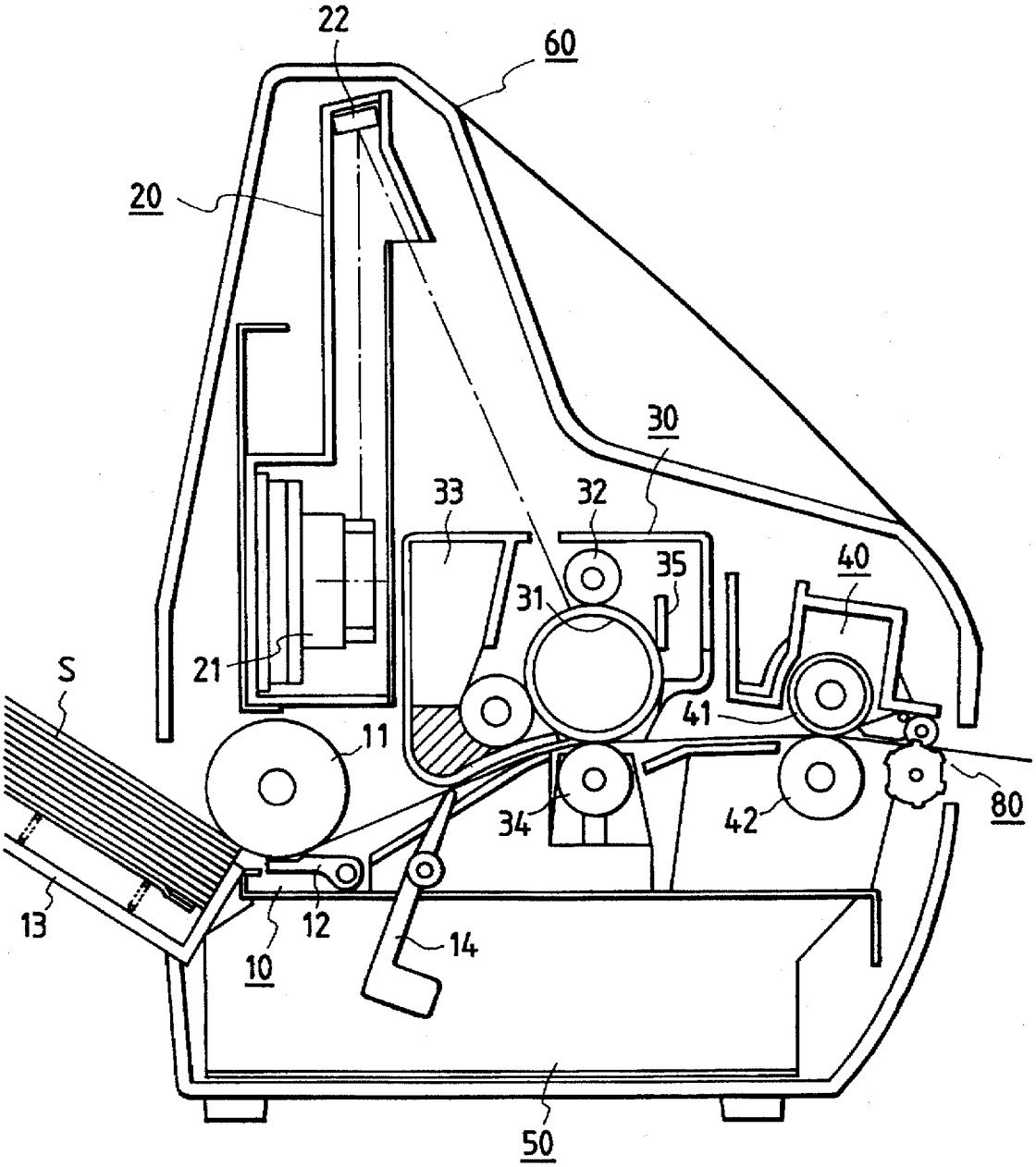
FIG. 9 is a sectional view showing a printer incorporating the present invention.

FIG. 9 is a sectional view showing a printer incorporating the present invention. The printer is made up of a paper supply unit 10, an exposure unit 20, a Xerographic process unit 30, a fixing unit 40, and a control circuit unit 50. These units and the unit are accommodated in a housing 60. The paper supply unit 10 includes a paper supply roller 11 and a separation pad 12. The exposure unit 20 includes a laser light source (not shown), a laser scanner 21, and a return mirror 22. The Xerographic process unit 30 includes a photo receptor drum 31, a charging roller 32, a developing unit 33, a transport roller 34, a cleaner 35, and the like. The fixing unit 40 includes a heating roller 41 which comes in contact with the toner surface, a pressurizing roller 42, and the like. The control circuit unit 50 is provided for the communication with a host computer placed outside the printer, and the control of the fixing unit heater, motor drive, and a power source for the Xerographic process.

When the printer receives print data from the host computer, a control system 51 contained in the control circuit unit 50 develops the print data into image data. When a predetermined amount of image data is accumulated, a drive system 70 (not shown) starts the supply of a paper sheet S as a sheet material. A paper sheet S is pulled out sheet by sheet from a paper supply tray 13 by the combination of the paper feed roller 11 and the separation pad 12, and fed forward by the paper feed roller 11. The advancing paper sheet S is sensed by a paper sensor 14. When the paper sensor 14 senses the paper sheet S, the operation of forming a latent image starts. Specifically, the exposure unit 20 depicts a latent image on the photo receptor drum 31 by a laser beam modulated by the image data. The photo receptor drum 31 is uniformly charged in advance by the charging roller 32. The latent image on the photo receptor drum 31 is developed into a toner image by the developing unit 33.

The toner image reaches a nip between the photo receptor drum 31 and the transport roller 34, with rotation of the photo receptor drum 31. At the nip, the toner image is transferred onto the paper sheet S. The paper sheet S bearing the toner image that is transferred but not yet fixed is transported to the fixing unit 40, by the combination of the transport roller 34 and the photo receptor drum 31, which cooperate with each other. Heat and pressure fix the toner image at the nip portion between heating roller 41 and the pressurizing roller 42. The paper sheet is discharged out of the printer by a discharge roller 80.

When the printer receives print data from the host computer, the exposure unit 20 depicts a latent image on the photo receptor drum 31 by a laser beam modulated by the image data. The photo receptor drum 31 is uniformly charged in advance by the charging roller 32. The latent image on the photo receptor drum 31 is developed into a toner image by the developing unit 33. A paper sheet S as a sheet material is pulled out sheet by sheet from a paper supply tray 13 by the combination of the paper feed roller 11 and the separation pad 12, and fed forward, by the paper feed roller 11, to a nip between the photo receptor drum 31 and the transport roller 34, in synchronism with the operation of forming an image on the photo receptor drum 31. At the nip, the toner image is transferred onto the paper sheet S. The advancing paper sheet S is sensed by a paper sensor 14. The paper sheet S bearing the toner image that is transferred but not yet fixed is transported to the fixing unit 40, by the combination of the transport roller 34 and the photo receptor drum 31, which cooperate with each other. Heat and pressure fix the toner image at the nip portion between heating roller 41 and the pressurizing roller 42. After passing the fixing unit, the paper sheet is discharged out of the printer by a discharge roller 80.

Figure 10:
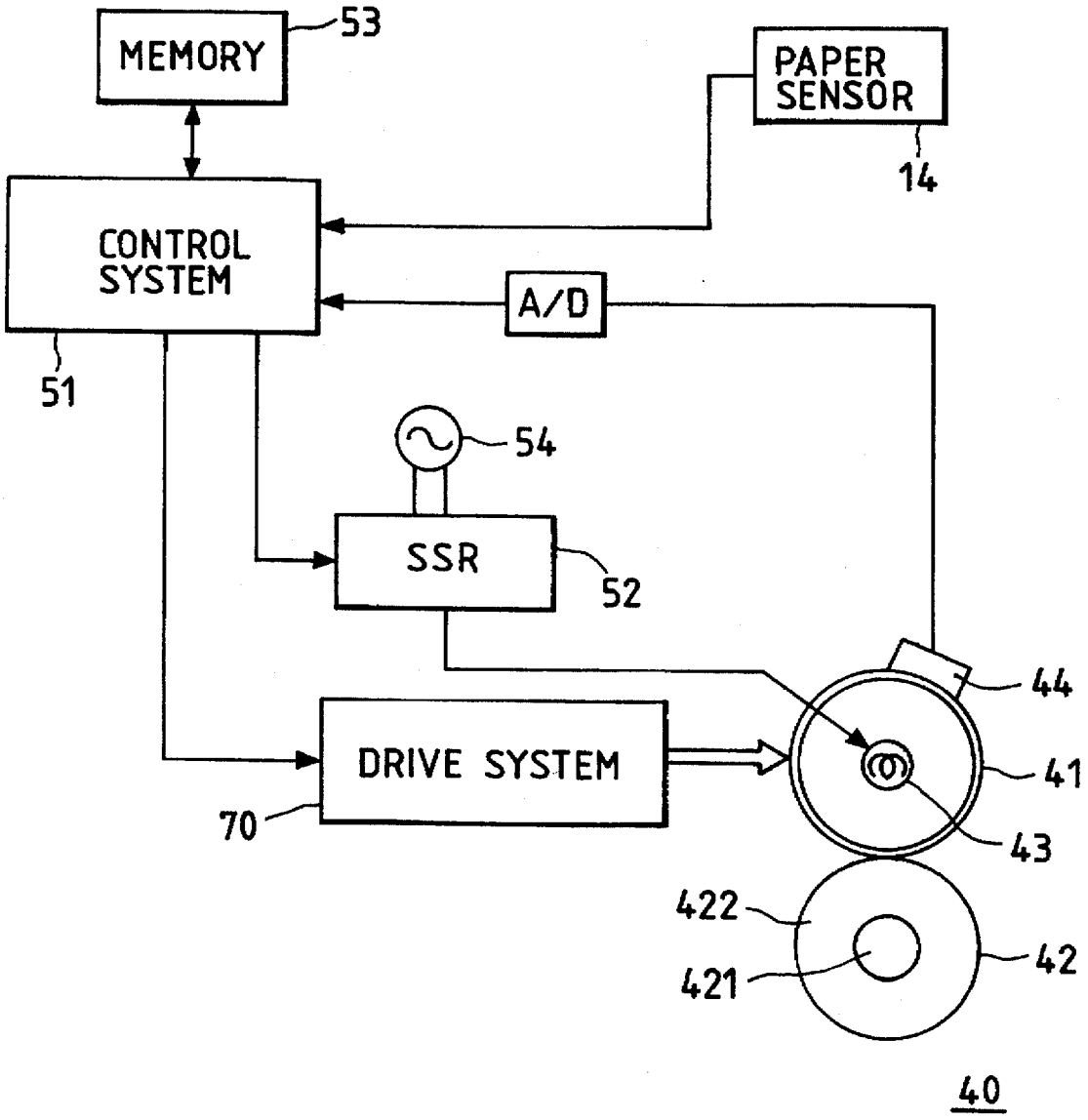
FIG. 10 is a diagram in block and schematic form illustrating a connection of a control system, a paper sensor, and a fixing unit, and the construction of the fixing unit.

FIG. 10 is a diagram in block and schematic form illustrating a connection of the control system 51 as a part of the control circuit unit 50, the paper sensor 14, and the fixing unit 40, and the construction of the fixing unit 40. In the figure, solid lines indicate electrical connections, doubled lines indicate the transfer of a drive force, and an arrow indicates flows of information. The control system is further connected to the respective portions in the Xerographic process unit, but are not illustrated for simplicity.

The heating roller 41 contains a heater 43, and is driven by the drive system 70, through a gear (not shown), provided at the end part thereof. The heating roller 41 is constructed such that a pipe made of aluminum is cut into a desired shape, such as an inverse crown, of which the central portion is 18 mm in diameter, and 0.6 mm thick, and the surface of the thus shaped and sized pipe is coated with PTFE (polytetrafluoroethylene) up to 30±5 μm thick. A thermistor 44 as a temperature sensing element is pressed against the surface of the heating roller 41, to thereby sense temperature on the roller surface. A heater 43 as a halogen heater receives an AC power from an AC power source 54 through an SSR 52, which is turned on and off by a signal from the control system 51. The pressurizing roller 42 is constructed such that an elastic layer 422 made of LTV (low temperature curing silicon rubber) is layered on a metal core bar 421 made of free machining steel to have the outer diameter of 18 mm. The pressurizing roller 42 is pressed against the heating roller 41 by a pressure mechanism (not shown) at the total load of 6 Kgf. When the heating roller 41 is driven to turn, the pressurizing roller 42 is also turned.

In the fixing operation, the heating roller 41 is turned at the circumferential speed of 24 mm/sec by the drive system 70. The heater 43 is turned on and off based on a signal from the thermistor 44, so that a surface temperature of the heating roller 41 is controlled within a predetermined range.

The control system 51, which contains a CPU and a ROM storing programs to be executed by the CPU, receives data from the host computer outside the printer. An output signal of the thermistor 44, which is in contact with the heating roller is A/D converted and applied to the control system 51. The control system 51 further receives on/off information of the paper sensor 14. These pieces of information are processed using the related program, and the image data is transferred to the exposure unit 20, and a signal to drive the fixing roller is transferred to the drive system 70, and a current feed signal for the heater 43 is outputted to the SSR 52.

By using period signals of 10 mS and 1 sec., which are formed by frequency dividing a system clock signal at several MHz, the CPU in the control system 51 is interrupted, so that the interrupt routine is executed. A memory 53 can keep the stored information even if the power source is turned off. NV-RAM may be used for this memory. The memory 53 stores information of a total number of prints, for example. As will be described later, the information used for the temperature control of the fixing unit, for example, the value of an idle timer, may be stored in the memory 53. In this case, even if the power source is accidentally or carelessly turned off, a proper temperature control may be continued using the information before power off.

Figure 11:
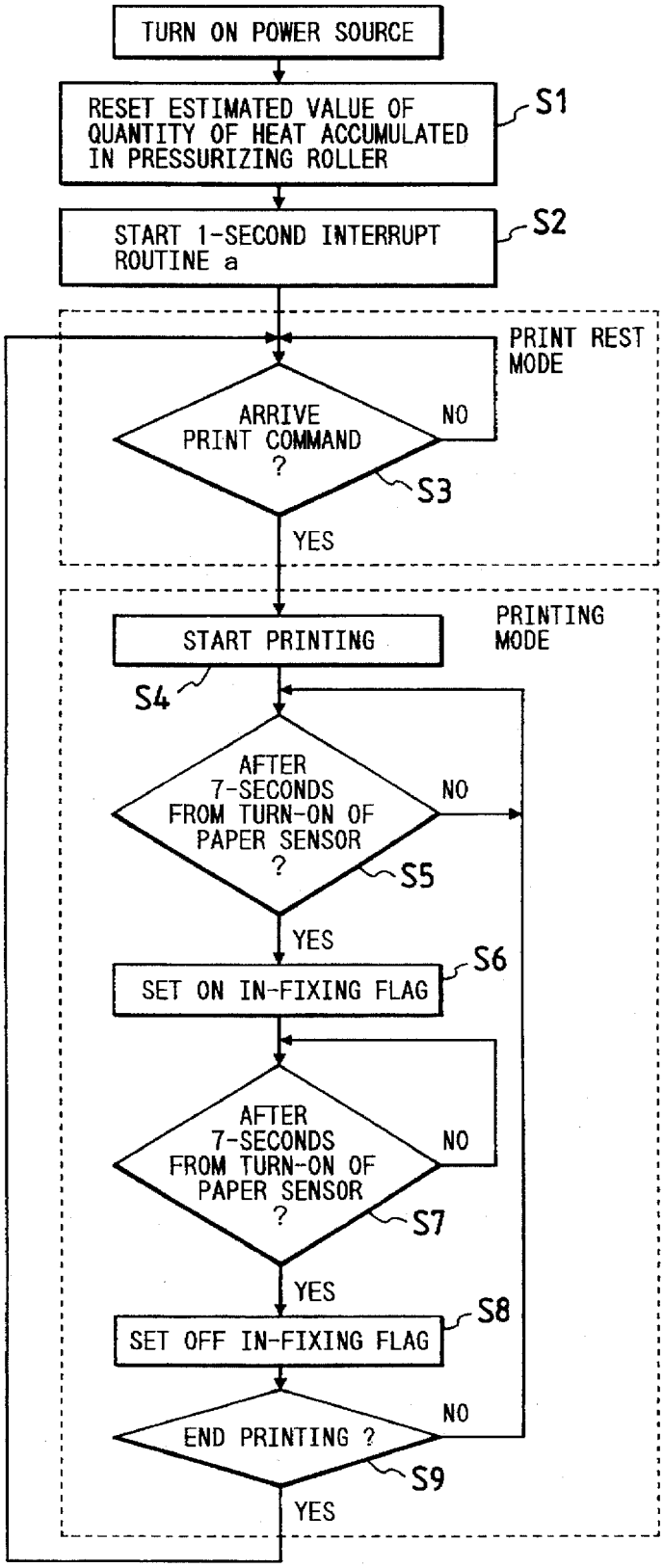
FIG. 11 is a flowchart showing a control process carried out by the control system according to a seventh embodiment of the present invention.
Figure 12:
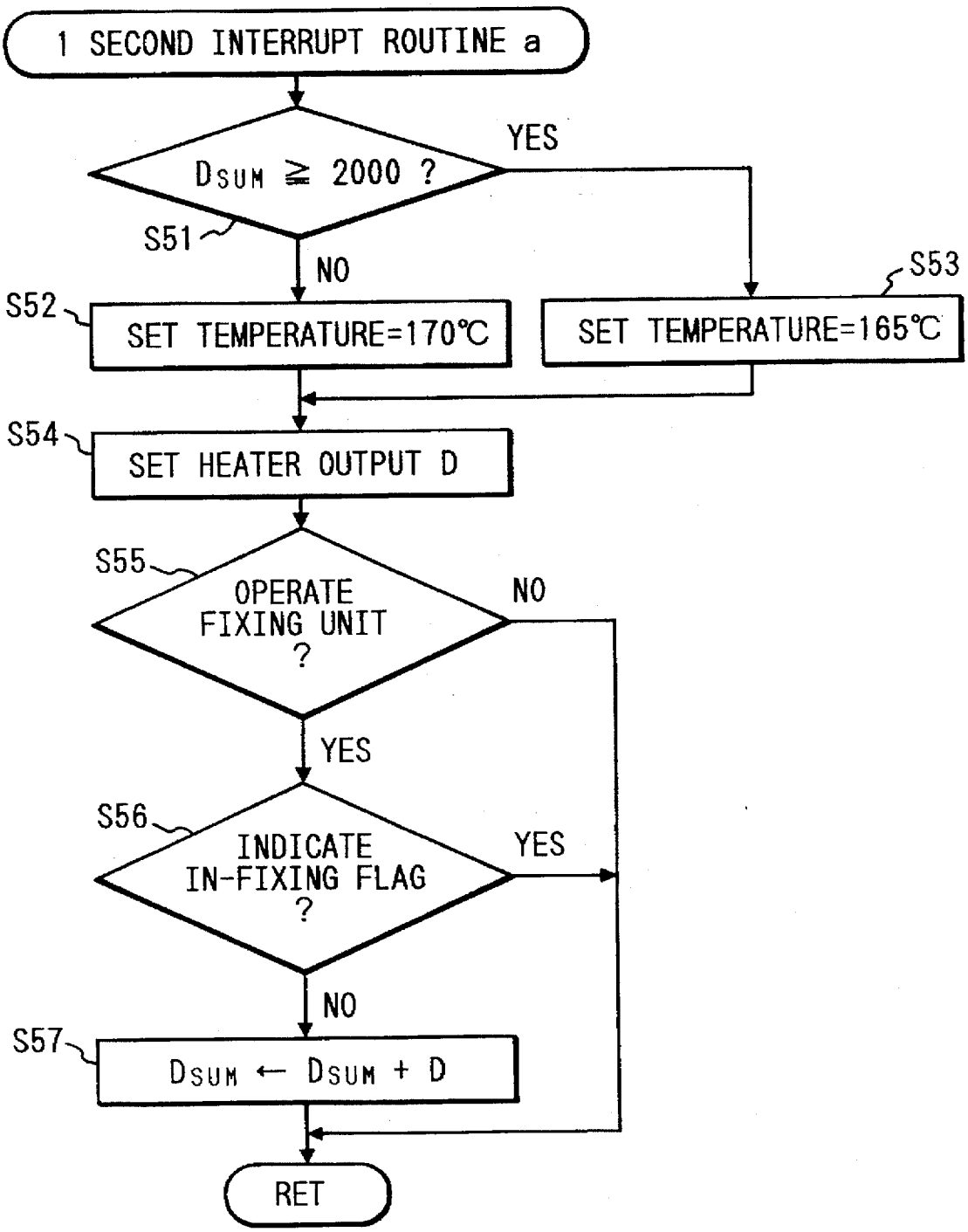
FIG. 12 is a flowchart showing an interrupt routine executed by the control system of the seventh embodiment.

FIG. 11 is a flowchart showing a control process carried out by the control system 51, which is based on the inventive concept of the present invention. FIG. 12 is a flowchart showing a 1-second interrupt routine executed once for one second when the main routine of FIG. 11 is interrupted.

In the main routine of FIG. 11, when the power source is turned on, an estimated value of the quantity of heat accumulated in the pressurizing roller is reset (step S1). In the present embodiment, an integrated power $D_{SUM}$ to the heating roller 41 is used for the estimated value of the quantity of accumulated heat, as will be described later. The system control starts the 1-second interrupt routine a shown in FIG. 12 (step S2). In the 1-second interrupt routine a, a step S51 checks the value of integrated power $D_{SUM}$. If it is 2000 or larger, the set temperature is set to 165° C., and if it is smaller than 2000, the set temperature is set to 170° C. Then, in a step S54, a heater output D is determined on the basis of the set temperature and the temperature sensed by the thermistor 44. During the period that the 1-second interrupt routine a is periodically executed, the fixing unit is heated and undergoes the temperature control. The heater output D indicates a value of duty where current is fed to the heater for the time of D % of one second, and this value is within the range from 0 to 100 (step S54). Then, a step S55 checks whether or not the fixing rollers are rotating. The check is made by checking whether or not the control system 51 per se sends a drive signal to the drive system 70. When the fixing rollers are rotating, a step S56 checks if an in-fixing flag indicating that a paper sheet is present at the fixing portion (nip of the fixing roller). If the flag is not set, viz., the fixing operation does not progress, the heater output D determined in the step S54 is added to the integrated power $D_{SUM}$ (step S57).

Thus, the integrated power $D_{SUM}$ is counted up when the fixing unit is rotating and no paper sheet is present in the fixing unit, viz., the fixing unit is idling. The handling of the in-fixing flag will be described later.

Returning to FIG. 11, the 1-second interrupt routine a starts, the temperature control of the fixing unit starts, and then the printer is placed to a print rest mode and waits for a print command from the host computer (step S3). In the print rest mode, the fixing unit is not rotated, and then the 1-second interrupt routine a continues the temperature control, not changing the estimated value of the amount of heat transferred to pressuring roller $D_{SUM}$. In this case, the control temperature of the heating roller may be decreased to such an extent that the pressurizing roller is not cooled. When a print command arrives, the printer is in a print mode, current is fed to the respective portions in the Xerographic process unit, such as the charging unit and the developing units, a drive signal is sent to the printer, and the feed of a paper sheet starts (step S4). In this state, the fixing unit rotates but the in-fixing flag is not set. Accordingly, in the step S57 of the 1-second interrupt routine a, the $D_{SUM}$ is progressively increased. When the $D_{SUM}$ exceeds 2000, the set temperature is switched in the 1-second interrupt routine a.

When the paper sheet feeding is continued, the paper sensor 14 is turned on. At this time, the paper sheet does not yet reach the fixing unit. In the present embodiment, after 7 seconds from the turn-on of the paper sensor 14, the paper sheet reaches the fixing nip. Accordingly, the control system sets the in-fixing flag after 7 seconds from the turn-on of the paper sensor 14 (steps S5 and S6).

After the in-fixing flag is set, the 1-second interrupt routine a continues the temperature control without increasing the $D_{SUM}$. When the paper sheet is further fed forward, it passes the paper sensor 14, and after 7 seconds it passes the fixing unit. Then, the in-fixing flag is reset (step S8), and the 1-second interrupt routine a increases the $D_{SUM}$ again. The paper sheet is further transported and discharged from the printer. To successively print the next page, the step S9 judges that the print operation does not end yet. The system control returns to the step following the start step S4. When the next page is absent, it is judged that the print operation ends. Current feed to the respective portions in the Xerographic process unit and the drive signal supply are stopped, and the fixing unit also stops its rotation. Thereafter, the printer is placed to the print rest mode till the next print command arrives. The 1-second interrupt routine a continues the temperature control without varying the $D_{SUM}$.

In the present embodiment, to check whether or not the paper sheet is present at the fixing nip, the flag is set after a preset time, in response to the signal from the paper sensor 14. A sensor for sensing present or absence of the paper sheet at a location near the fixing nip may additionally be used. Further, the drive signal for the paper feed roller 11 may be used in place of the signal from the paper sensor. A signal from a paper discharge sensor, usually provided at the paper discharge side of the fixing nip, may also be used. In this method using the signal from the paper sensor 14, if the timing to start the paper feed by the paper feed roller 11 is slightly deviated depending on a stacking state of the paper sheets in the paper supply tray 13, presence or absence of the paper sheet at the fixing nip can exactly be detected since the advancement of the paper sheet per se is detected. Where the signal from the paper discharge sensor provided at the paper discharge side of the fixing nip is used in addition to the signal from the paper sensor 14, if the paper advancement accidentally stops after it passes the paper sensor location, presence or absence of the paper sheet at the fixing nip can exactly be detected.

In the present embodiment, the drive signal that is sent from the control system 51 to the drive system 70 is used for detecting the rotation of the fixing roller. In another possible way, an encoder is attached to one of the shafts for driving the heating roller 41. The output signal of the encoder is used for detecting the rotation of the fixing roller. However, the rotation detecting method which uses the drive signal sent from the control system to the drive system is advantageous since no additional component is required to detect the rotation of the fixing roller.

As described above, an estimated value of the quantity of heat accumulated in the pressurizing roller is integrated only during the period of the idle rotation of the fixing unit after power on. Accordingly, the fixing operation is performed at a proper heating roller temperature and a proper pressurizing roller temperature independently of the paper feed interval, to thereby secure a good fixing quality. In the present embodiment, in the print rest mode, the temperature of the pressurizing roller is maintained. Accordingly, the estimated value of the amount of heat transferred to pressuring roller $D_{SUM}$ is also maintained during the print rest period.

Eighth embodiment

The eighth embodiment is constructed such that the time of the idle rotation of the fixing unit is used for the estimated value of the quantity of accumulated heat of the pressurizing roller. The construction of the printer is the same as of the seventh embodiment. The eighth embodiment of the present invention will be described.

Figure 13:
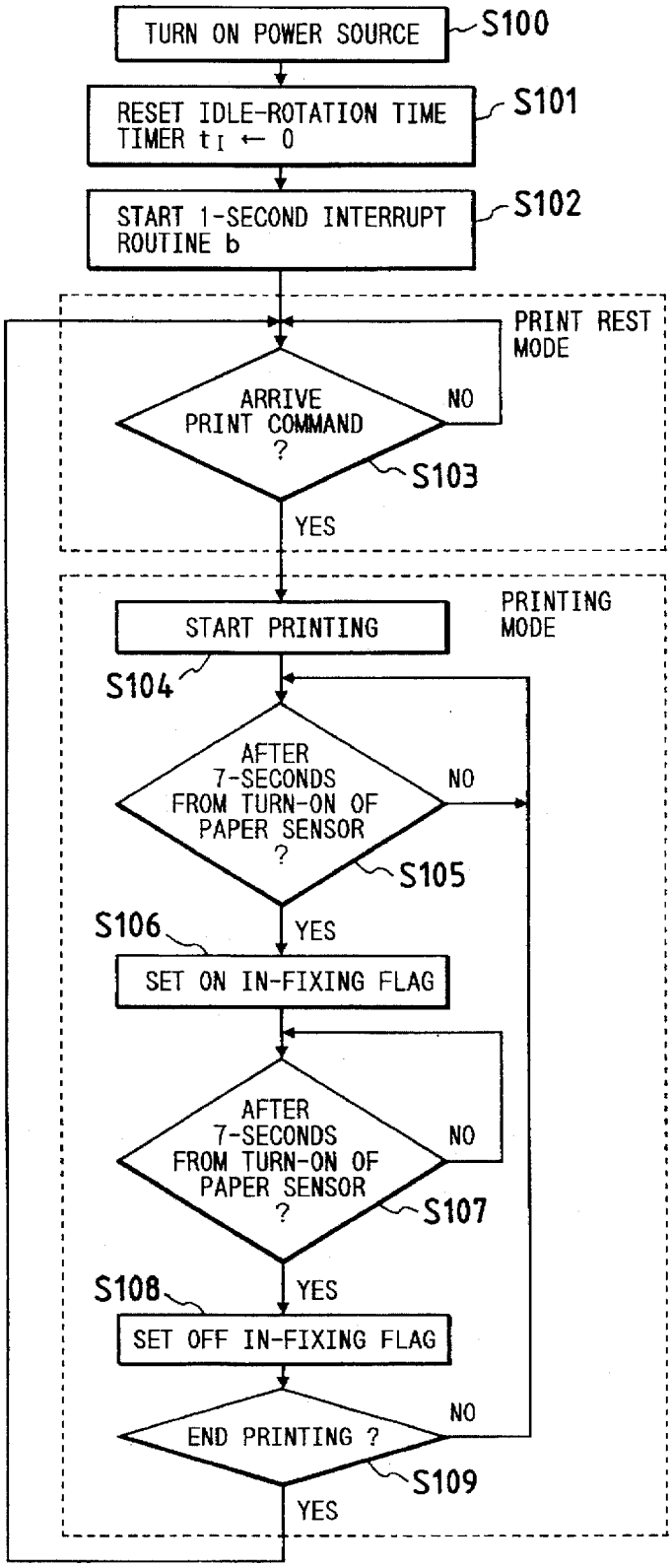
FIG. 13 is a flowchart showing a control process of a control method carried out by the control system in a eighth embodiment according to the present invention.
Figure 14:
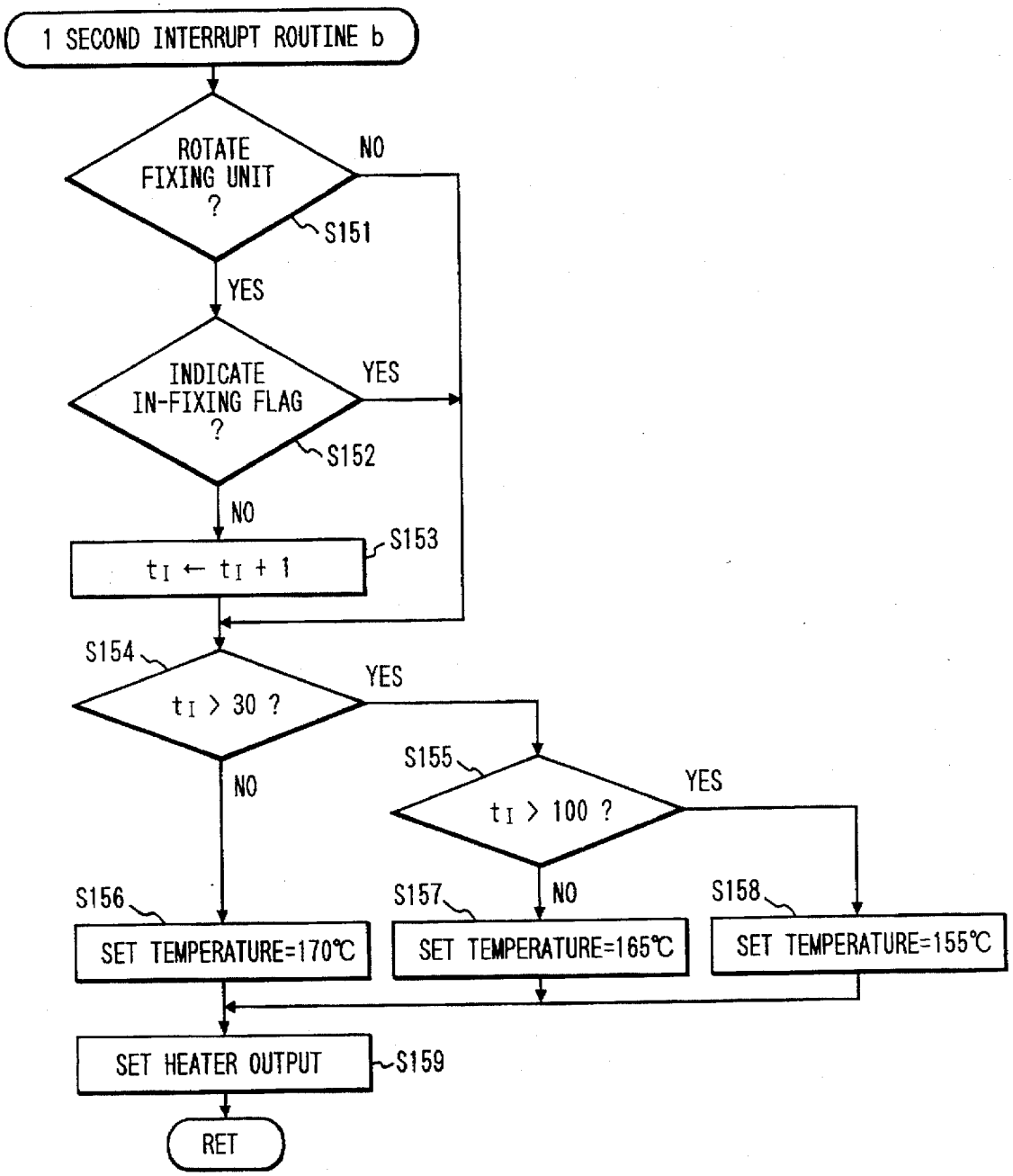
FIG. 14 is a flowchart showing an interrupt routine executed by the control system of the eighth embodiment.

FIG. 13 is a flowchart showing a control process of the eighth embodiment, which is carried out by the control system. FIG. 14 is a flowchart showing a 1-second interrupt routine b used in the main routine of FIG. 13.

In FIG. 13, when the power source is turned on (step S100), an idle-rotation time timer $t_I$ is reset (step S101). When the value of the idle-rotation time timer $t_I$ is stored in the nonvolatile memory 53, an initial value read out of the memory may be set in place of the resetting of the idle-rotation time timer $t_I$. In the description of the specification, the character $t_I$ will frequently indicate the value of the idle-rotation time timer $t_I$. Then, the 1-second interrupt routine b shown in FIG. 14 is caused to run (step S102). In the 1-second interrupt routine b, it is checked if the fixing unit is rotating (step S151). When the fixing unit is rotating, a step S152 checks if the in-fixing flag indicating that the paper sheet is present at the fixing portion, is set. If the flag is not set, the idle-rotation time timer $t_I$ is incremented by one (step S153). Thus, when the fixing unit is rotating but no paper sheet is present at the fixing portion, viz., the fixing unit is in an idle-rotation time rotation, the idle-rotation time timer $t_I$ is counted up, and the 1-second interrupt routine b is executed once for one second. As a result, it shows a value (in second) of the integration continue time of the idle rotation.

After the idle-rotation time timer $t_I$ is incremented, in steps S154 and S155, the control temperature of the fixing unit is determined by the value of the idle-rotation time timer $t_I$. When the value of the idle-rotation time timer $t_I$ is shorter than 30 seconds, the set temperature is set at 170° C.; when it exceeds 30 seconds but is shorter than 100 seconds, the set temperature is set at 165° C. ; when it exceeds 100 seconds, it is set at 155° C. Finally, a step S159 determines the output of the heater 43 for one second immediately thereafter, by a proportional control formula, using a sensed temperature of the fixing unit and the set temperature thereof.

Returning to FIG. 13, in the step S102, the 1-second interrupt routine b is caused to run and the temperature control of the fixing unit starts. The printer is placed to the print rest mode, and waits for a print command from the host computer (step S103). In the print rest mode, the fixing unit is not rotating. Then, in the 1-second interrupt routine b, the temperature control is continued without varying the time of the idle-rotation time timer $t_I$.

When a print command arrives, the printer is placed to the print mode. Current is fed to the respective portions in the Xerographic process unit and the drive signal is sent to the printer, thereby driving the printer. And the paper sheet feed starts (step S104). In this state, the fixing unit rotates but the in-fixing flag is not set. In a step S153 in the 1-second interrupt routine b, the value of the idle-rotation time timer $t_I$ is progressively increased.

When the value of idle-rotation time timer $t_I$ exceeds a switch point, e.g., 30 or 100, the set temperature is switched in the 1-second interrupt routine b. After 7 seconds from the turn-on of the paper sensor, the in-fixing flag is set, the 1-second interrupt routine b continues the temperature control without increasing the value of the idle-rotation time timer $t_I$. The paper sheet is further fed forward and the in-fixing flag is reset (step S108). Then, the 1-second interrupt routine b increases the value of the idle-rotation time timer $t_I$ again. The paper sheet is further transported and discharged from the printer. To successively print the next page, the step S109 judges that the print operation does not end yet. The system control returns to the step following the start step S104.

When the next page is absent, the print operation ends. Current feed to the respective portions in the Xerographic process unit and the drive signal supply are stopped, and the fixing unit also stops its rotation. Thereafter, the printer is placed to the print rest mode till the next print command arrives. The 1-second interrupt routine b continues the temperature control without varying the value of the idle-rotation time timer $t_I$.

As described above, the time of the idle rotation of the fixing unit after power on is integrated. By using the integrated value, the set temperature of the fixing unit is switched to another set temperature. The fixing operation is performed at a proper heating roller temperature and a proper pressurizing roller temperature independently of the paper feed interval, to thereby secure a good fixing quality.

Ninth embodiment

In some type of the printer, the temperature control of the fixing unit is carried out only when the printer operates for printing. When no print command arrives after power on or after the print operation ends, the temperature control is stopped, and the fixing unit is left in a natural heat dissipation state.

In this type of the printer, if the temperature control is carried out in anticipation of a temperature rise of the pressurizing roller, which is based on the idle rotation time, the temperature of the pressurizing roller falls when the printer is at a standstill or in a print rest mode. Therefore, if the temperature is set on the basis of the idle rotation time when the print operation starts again, there is the possibility that the fixing temperature is insufficiently high since the temperature of the pressurizing roller is low. For this reason, when the print operation starts again, it is desirable to correct the idle-rotation time timer $t_I$ so as to secure a proper temperature setting.

Such an idea is realized in a printer according to the ninth embodiment of the present invention, which is to follow. The construction of the printer of the ninth embodiment, which employs an inventive and unique temperature control method, is the same as of the seventh embodiment, and hence no description of the printer construction will be given below.

Figure 15:
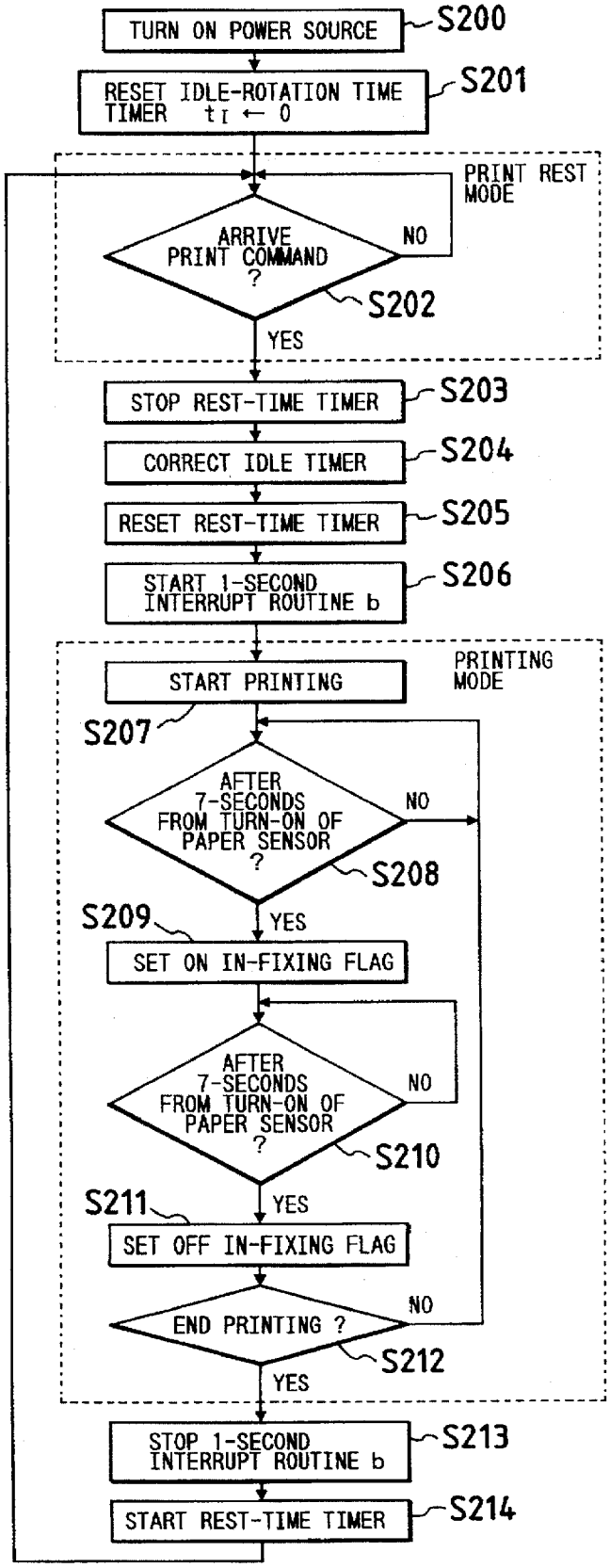
FIG. 15 is a flowchart showing a control process of a control method carried out by the control system in a ninth embodiment according to the present invention.

FIG. 15 is a flowchart showing a temperature control process according to the ninth embodiment of the present invention. When the power source is turned on (step S200), the idle-rotation time timer $t_I$ is reset (step S201), the printer is in the print rest mode, and the system control waits for a print command (step S202). In this state, no temperature control is carried out. When receiving a print command from the host computer, the system control stops a rest-time timer $t_r$ (step S203), and corrects the idle timer $t_I$ before the temperature control of the fixing unit starts (step S204). For the correction, the rest time of the rest-time timer $t_r$ and the following expression (8) are used.

$$t'_I = t_I \times e^{-(r/2000)} \quad (8)$$

where e: base of natural logarithm, and $t'_I$ value of idle-rotation time timer $t_I$ after it is corrected.

Thereafter, the rest-time timer is reset (step S205), and then a 1-second interrupt routine b is caused to run and the temperature control process starts (step S206). The 1-second interrupt routine b is the same as of the eighth embodiment. After the 1-second interrupt routine b starts to run, the printer is in an in-printing state. The in-printing process in steps S207 to S211 is the same as of the eighth embodiment, and hence no further description thereof will be given. If the print end is recognized (step S212), the system control stops the 1-second interrupt routine b, and the temperature control (step S213), while at the same time starts the rest-time timer $t_r$ (step S214). In the temperature control process of the ninth embodiment, the 1-second interrupt routine b is not executed in the print rest mode. Accordingly, the fixing unit is not heated.

As seen from expression (8), the correction of the idle-rotation time timer depends on the idle time $t_I$ even if the elapsing time $t_r$ after the print end are the same. When $t_I$ is large, $t_I$ after the correction is also large. When $t_I$ is small, $t_I$ after the correction is also small.

In the present embodiment, the correction of the idle time is carried out through the calculation. Alternatively, the correction process may be carried out while referring to such a table as to obtain the correction value from the idle time $t_I$ at the print end and the rest time $t_r$.

As seen from the foregoing description, the temperature control method of the present embodiment predicts a temperature falling rate of the pressurizing roller on the basis of the idle time $t_I$, and corrects the idle time $t_I$ by the elapsing time $t_r$ after the print operation ends and the idle time $t_I$ at the end of the print, when the print operation starts again. When the idle rotation time up to the previous print end is long, a large quantity of heat is accumulated in the pressurizing roller. In this case, the temperature falling rate is small, viz., the temperature slowly falls. When the idle rotation time is short and a small quantity of heat is accumulated in the pressurizing roller, the temperature falling rate is high. Thus, the temperature falling rate varies depending on the quantity of heat accumulated in the pressurizing roller. For this reason, the attempt to switch the set temperature to another depending only on the elapsing time from the print end to the print restart, fails. However, the temperature fall of the pressurizing roller can accurately be predicted when information of the idle time is additionally used.

Tenth embodiment

A sensed temperature of the pressurizing roller may be used for the purpose of correcting the idle rotation time at the time of restarting the print, while the elapsing time after the print operation ends is used for the same purpose in the ninth embodiment. The printer according to the tenth embodiment of the present invention realizes such a control. The construction of the printer of the tenth embodiment is the same as of the seventh embodiment, and hence no description of the printer construction will be given below.

Figure 16:
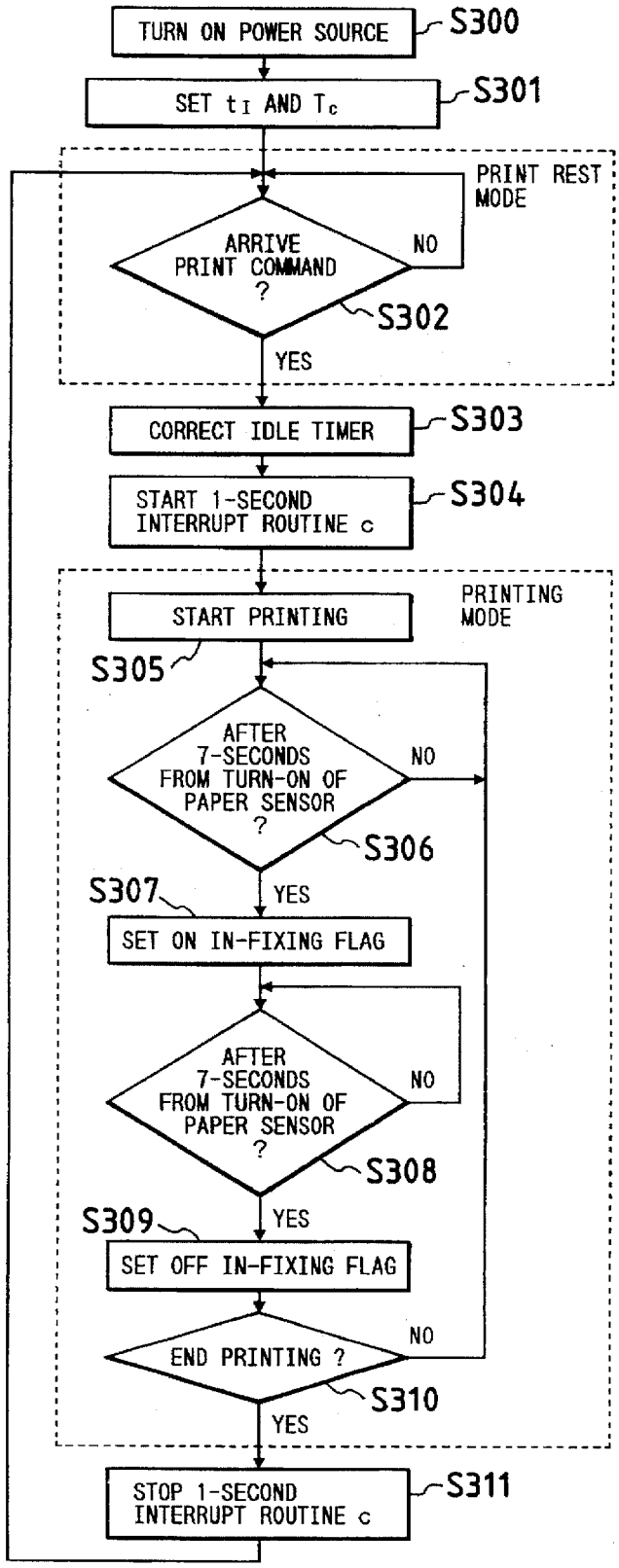
FIG. 16 is a flowchart showing a control process of a control method carried out by the control system in a tenth embodiment according to the present invention.

FIG. 16 shows a flowchart showing a control process of a temperature control method according to the tenth embodiment of the present invention. In the present printer, an idle-rotation time timer $t_I$ and a heating- roller set temperature Tc are stored in the memory 53. When the power source is turned on, the idle-rotation time timer $t_I$ before power on and the set temperature Tc are read from the memory 53 (step S301). The system control of the printer is placed to a print rest mode and waits for a print command. In this state, no temperature control is performed.

When receiving a print command from the host computer, the system control corrects the idle-rotation time timer $t_I$ (step S303) before the temperature control of the fixing unit starts. The correction of the idle-rotation time timer $t_I$ is carried out in accordance with the following expression (9), using a sensed temperature T of the heating roller at this time, viz., immediately before the temperature control starts, the idle-rotation time timer $t_I$ at the end of the previous print, and the set temperature Tc in the previous print. As the result of the correction, a corrected idle-rotation time timer $t_I$ ($t'_I$) is determined.

When T>40° C., $$t'_I = t_I - \{t_I/(Tc-40)\} \times (Tc-T) \quad (9)$$

where Tc: set temperature in the previous print

When T<40° C., $$t'_I = 0$$

Figure 17:
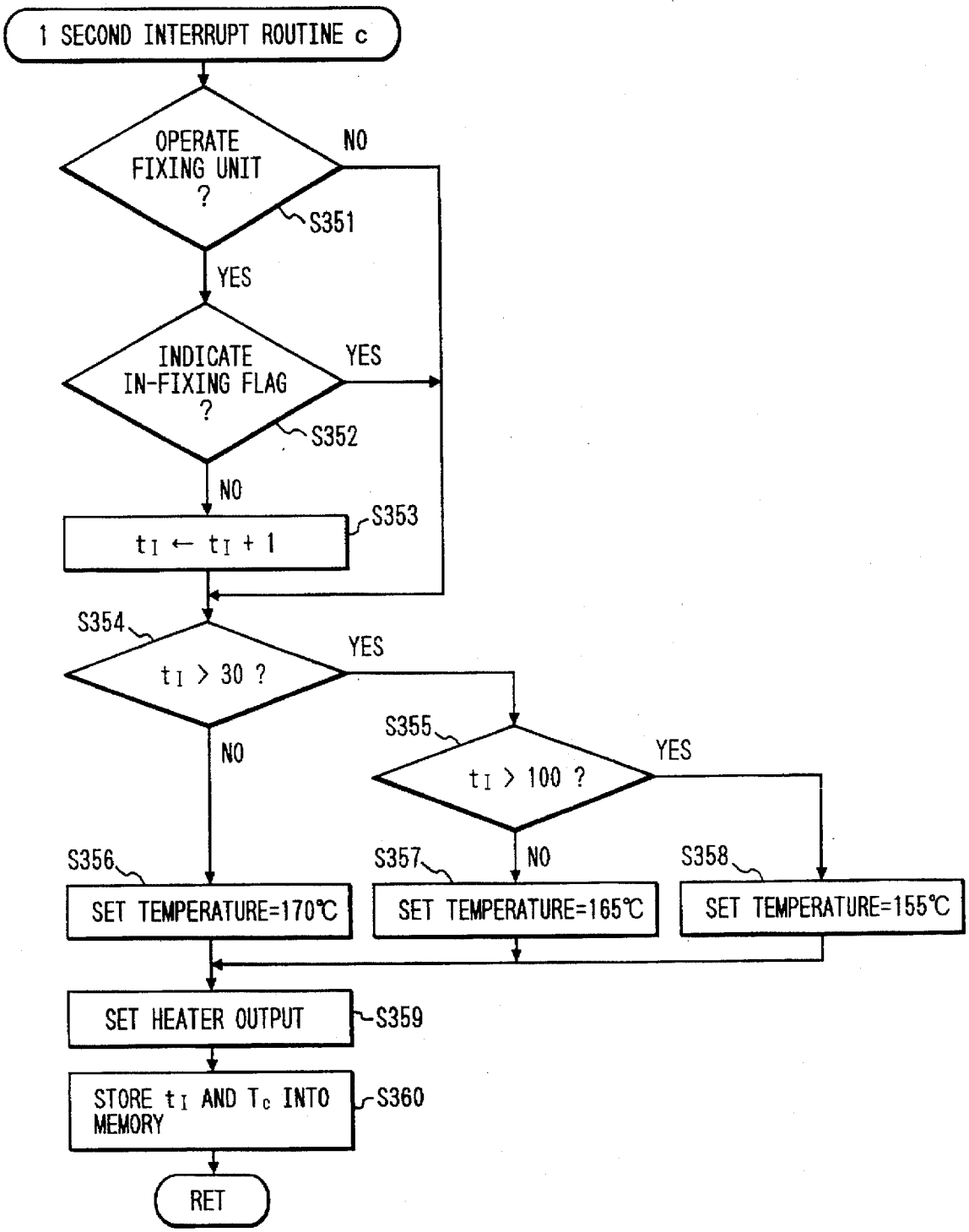
FIG. 17 is a flowchart showing an interrupt routine executed by the control system of the tenth embodiment.

Thereafter, a 1-second interrupt routine c is caused to run and the temperature control starts. FIG. 17 is a flowchart showing a control process of a 1-second interrupt routine c. The 1-second interrupt routine c is different from the 1-sec interrupt routine b of FIG. 14 only in that before the temperature control exits from the routine, in a step S360 the idle-rotation time timer $t_I$ and the set temperature Tc are recorded into the nonvolatile memory 53. Even if the power switch is turned off at a timing in a usual situation, for example, in a print rest mode, or at a timing in an abnormal situation, for example, in a power failure, no problem arises since the information on the idle-rotation time and the set temperature are stored in the memory.

Returning to FIG. 16, in a step S304 the in-print mode is set up after the 1-second interrupt routine c starts to run. The in-print process in steps S305 to S309 is substantially the same as that in the eighth embodiment, and hence description of the process is omitted. If in a step S310 the system control determines that the print operation ends, the system control stops the 1-sec interrupt routine c and the temperature control (step S311). In the print rest mode, the 1-second interrupt routine c is standstill, so that the fixing unit is not heated.

In expression (9), when a sensed temperature T of the heating roller is lower than 40° C. the idle-rotation time timer $t_I$ is reset. The temperature of 40° C. is such a temperature as to allow the heating roller to be handled as the roller having no print history. The value of this temperature is empirically obtained since it varies depending on the heat capacity of the fixing unit. In this case, it is desirable to set the temperature value to a value higher than the upper limit of the ambient temperature in a place where the printer will be used. If so set, even when the printer is used in an ambient condition at the highest temperature, the idle-rotation time timer $t_I$ can reliably be reset.

Figure 18:
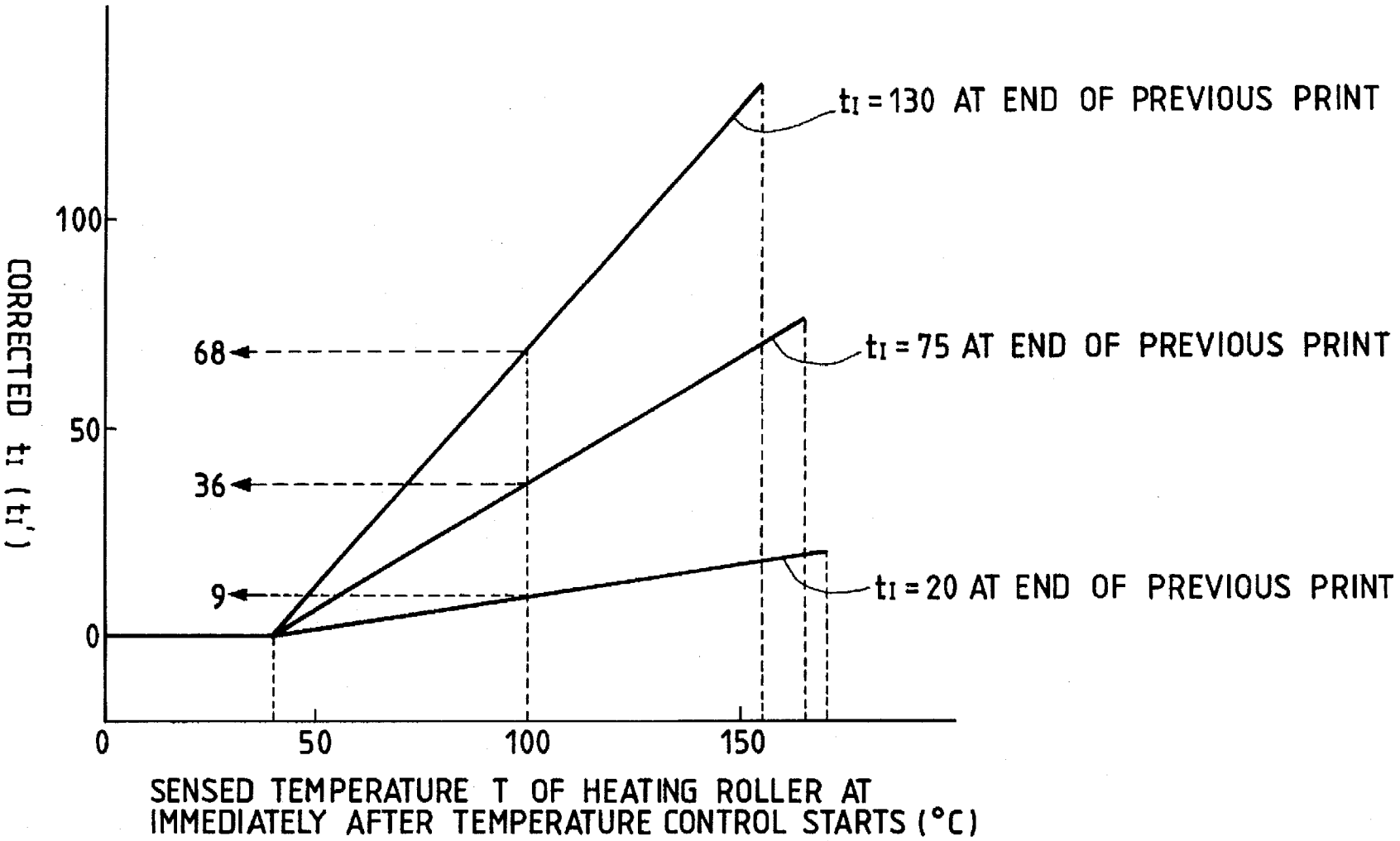
FIG. 18 is a graph showing how the value of an idle-rotation time timer is corrected by the control system in the tenth embodiment.

FIG. 18 is a graph showing how $t_I$ is corrected according to the expression (9). In the graph, three models of $t_I$, which are 130, 75, and 20 at the end of the previous print, are illustrated. A sensed temperature of the heating roller immediately after the print operation is the set temperature of the previous print. Then, when $t_I$=130, the sensed temperature immediately after the print operation is 155° C., and it gradually falls. In the correction by expression (9), even if the sensed temperature of the heating roller is higher than 40° C. which is the reset temperature, the idle-rotation time timer $t_I$ is corrected. In a case where the sensed temperature of the heating roller at the time of restarting the print operation is 100° C., the values of $t_I$ of at the end of the previous print operation are corrected as follows: 130→68; 75→36; 20→9. Thus, even if the sensed temperatures of the heating roller are the same at the time of restarting the print operation, but it is higher than the reset temperature, the quantity of correction of $t_I$ varies depending on the value of the idle-rotation time timer $t_I$, which is an estimated value of the quantity of the heat accumulated in the pressurizing roller.

As seen from the foregoing description, the printer of the tenth embodiment corrects the idle-rotation time by using the temperature of the heating roller and the print history thereof up to that time. Therefore, if the power source is turned off after the previous print, the temperature control is performed as when it is not turned off. In other words, if the power source is intentionally or accidentally turned off, a good fixing quality is ensured.

When an ambient temperature of the printer varies, the temperature falling rate of the fixing unit also slightly varies. However, the temperature control is not affected by the ambient temperature variation since the temperature falling rate is not used for the temperature control method of the present embodiment. Accordingly, a stable and good fixing quality is secured. In other words, the printer of the tenth embodiment stably operates in varying ambient conditions.

Eleventh embodiment

Figure 19:
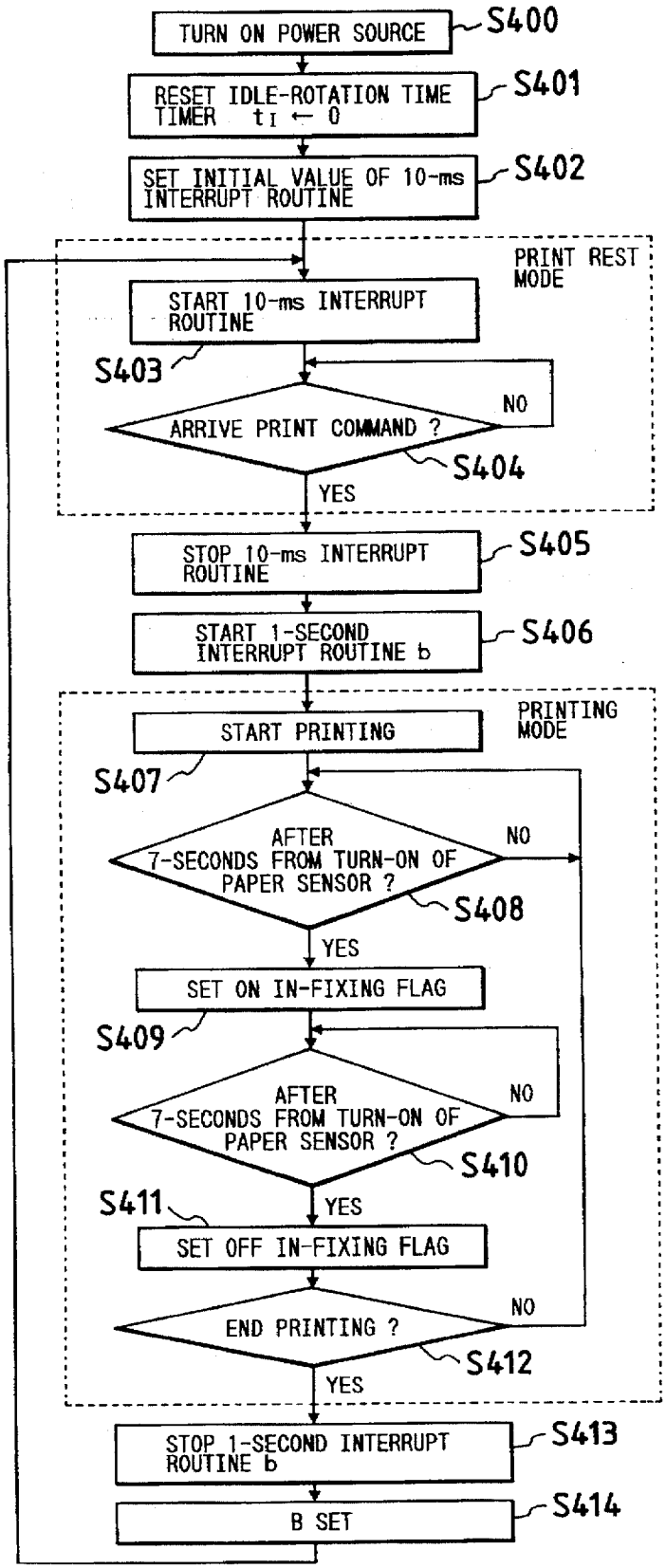
FIG. 19 is a flowchart showing a control process of a control method carried out by the control system in a eleventh embodiment according to the present invention.

In the above-mentioned method, the idle-rotation time timer is corrected when the temperature control starts in response to a print command. Alternatively, the idle-rotation time timer may gradually be corrected by an output signal of a temperature sensing element during the print rest period. FIG. 19 is a flowchart showing a control process for correcting the idle-rotation time timer, which is based on the concept of the alternative.

In the eleventh embodiment, the output signal of a thermosensor 14 of the pressurizing roller is checked every 10 ms during the print rest period. When the output signal of the thermo sensor decreases and the temperature of the heating roller falls, a value of the idle-rotation time timer is decreased by a preset value. A flow of the control process will be described with reference to FIG. 19 showing the flowchart.

Upon power on, the system control resets the idle-rotation time timer (step S401), sets the A/D conversion value of the thermo sensor as an initial value of Amin, and sets 0 (zero) as an initial value of B (step S402). These variables are used in a 10-ms interrupt routine. Then, the system control starts the 10-ms interrupt routine (step S403). In connection with the 10-ms interrupt routine which will be described later, the system control can easily exit from the 10-ms interrupt routine by merely resetting the value of idle-rotation time timer $t_I$ to 0, since a value of the idle-rotation time timer $t_I$ is 0 immediately after power on.

Then, the system control waits for a print command, and when receiving the print command, it stops the 10-ms interrupt routine (step S405), and starts a 1-sec interrupt routine b (step S406). In this routine, the temperature control process starts using the value of the idle-rotation time timer $t_I$ that is corrected by the 10-ms interrupt routine. The 1-sec interrupt routine b is the same as that used in the eighth embodiment. The control to start a print operation that is performed during the printing operation is also as in the eighth embodiment. When the print operation ends, the 1-sec interrupt routine b is stopped (step S413).

In a step S414, the system control sets a constant B, which is used in the 10-ms interrupt routine. In setting the constant B, the set temperature at the print end and the value of the idle-rotation time timer $t_I$ are put into the following expression (10). The initial value of Amin is also set to the A/D conversion value, which corresponds to the set temperature immediately before the print operation ends. Thereafter, the system control returns to the step S403. In the step, the control starts the 10-ms interrupt routine and sets up the print rest mode.

$$B=t_I/(Tc-40) \tag{10}$$

where Tc: set temperature in the previous print mode.

Figure 20:
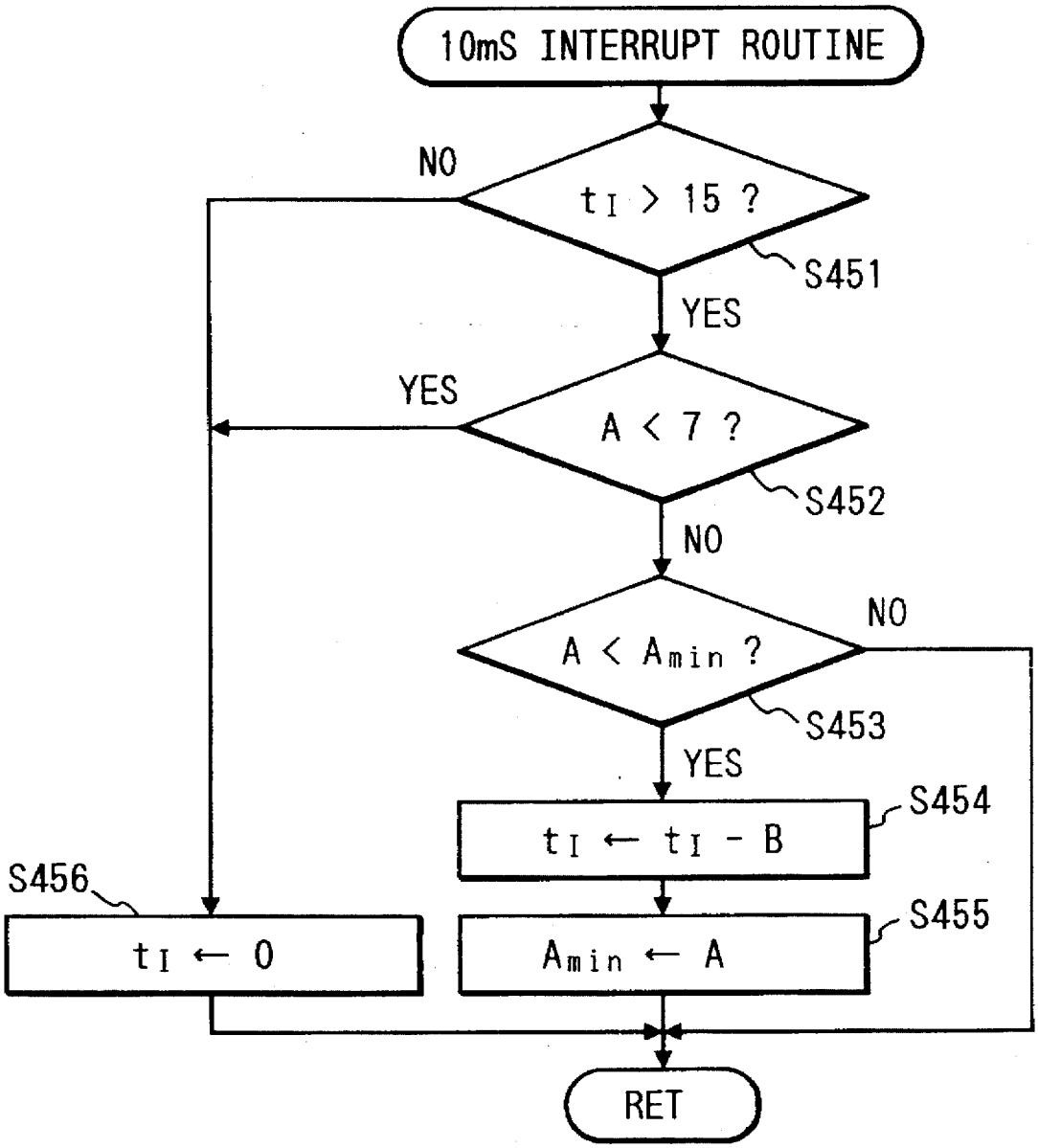
FIG. 20 is a flowchart showing an interrupt routine executed by the control system of the eleventh embodiment.

FIG. 20 is a flowchart showing a 10-ms interrupt routine. In a step S451, the control checks if the value of the idle-rotation time timer $t_I$ exceeds 15. The printer of the present embodiment is designed such that the sum of the idle-rotation times before and after the paper sheet reaches the fixing unit exceeds 15 seconds when the print operation is done, even once. When the value of the idle-rotation time timer $t_I$ is 15 or smaller, it is recognized that no print operation has been done. Accordingly, the control initializes the idle-rotation time timer $t_I$ and exits from the routine in a step S456. When the value $t_I$ is in excess of 15, the system control checks the output signal A of the thermosensor of the fixing unit in a step S452. In the instant embodiment, the A/D conversion value before it is converted into a temperature value is used for the check. By so doing, the conversion calculation may be performed every 10 ms. The load to the control is lessened.

In the temperature detecting system of the present embodiment, when the A/D conversion value A is smaller than 7 (A<7), the temperature of the fixing unit is 40° C. or lower, and the system control exits from the routine by resetting the idle-rotation time timer $t_I$. When A is equal to or larger than 7 (A≧7), the system control checks if the A/D conversion value A is smaller than the minimum value Amin (A≦Amin) in a step S453. When A≦Amin, the system control subtracts B from $t_I$, to thereby update the minimum value Amin. Within 10 ms, the quantity of a change of the A/D conversion value does not exceed 1. Accordingly, when the A/D conversion value is decremented by one (1), $t_I$ is reduced by B. As a matter of course, in some type of the printer, the temperature falling rate of the heating roller is high, and the quantity of a change of the A/D conversion value exceeds 1 within 10 ms. In this case, the interrupt interval is shortened or $t_I$ is reduced by (A−Amin)×B in a step S454.

In the present invention, the value of the idle-rotation time timer $t_I$ is corrected in the print rest mode where the load of the control is relatively small. Therefore, it is readily realized in a case where the control ability of the control system is not so high. Particularly, when the print operation starts, viz., when the related portions in the printer, such as the laser scanner, the drive motor for the printer, the high voltage power source and the like, are driven and a maximal load is coupled with the control system, the $t_I$ correction calculation is not performed. Therefore, such an advantage is obtained that there is no need of increasing the ability of the control system for the $t_I$ correction calculation. It is noted further that the temperature of the heating roller is handled in terms of the A/D conversion value. With this feature, even if the ability of the control system is low and the time assigned for the temperature control is short, the temperature can be checked by the short time interval interrupt routine, thereby providing a precise temperature control.

Twelfth embodiment

Figure 21:
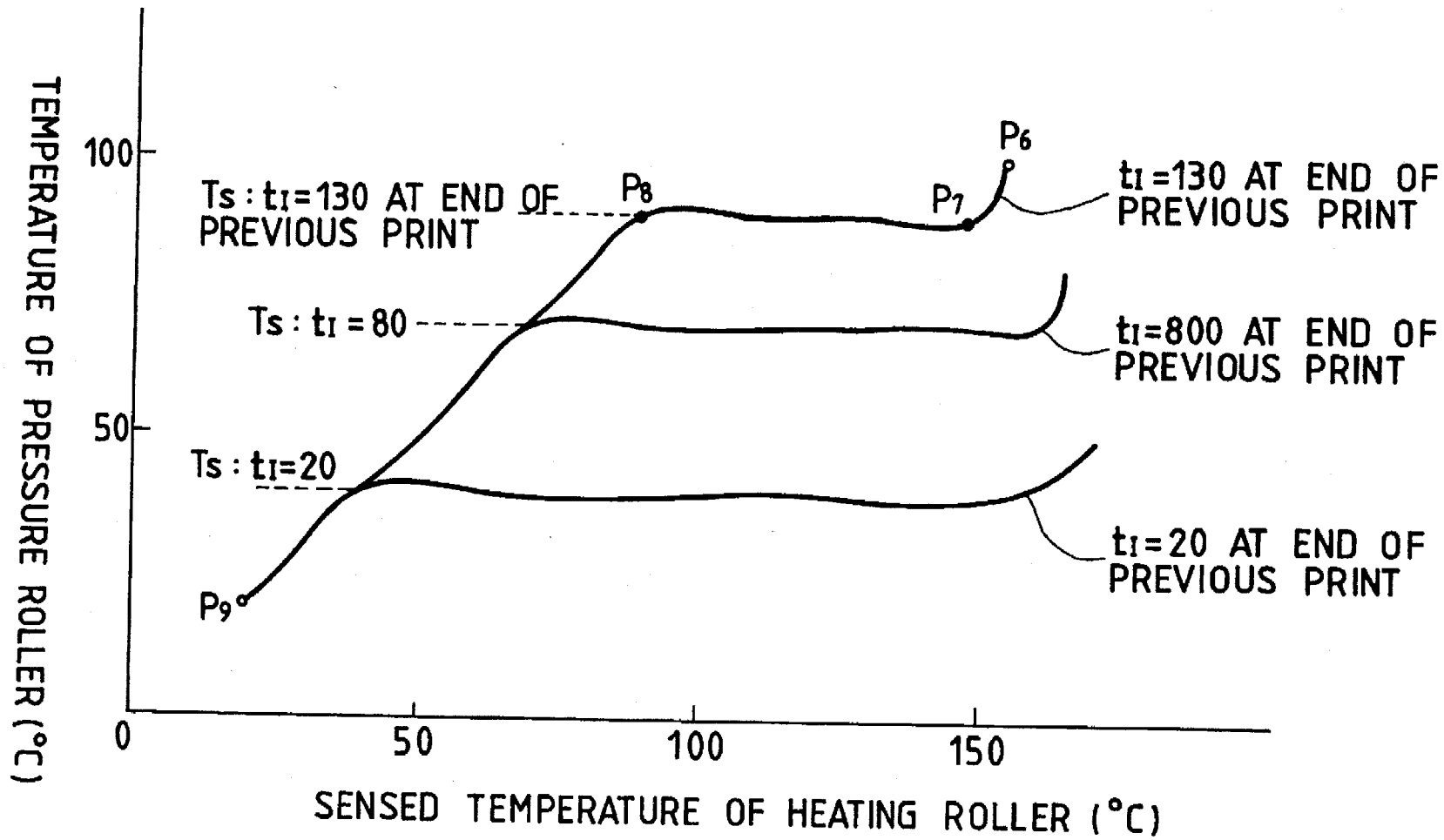
FIG. 21 are graphs showing the temperature relationship between the heating roller and the pressurizing roller in a print rest mode.
Figure 26:
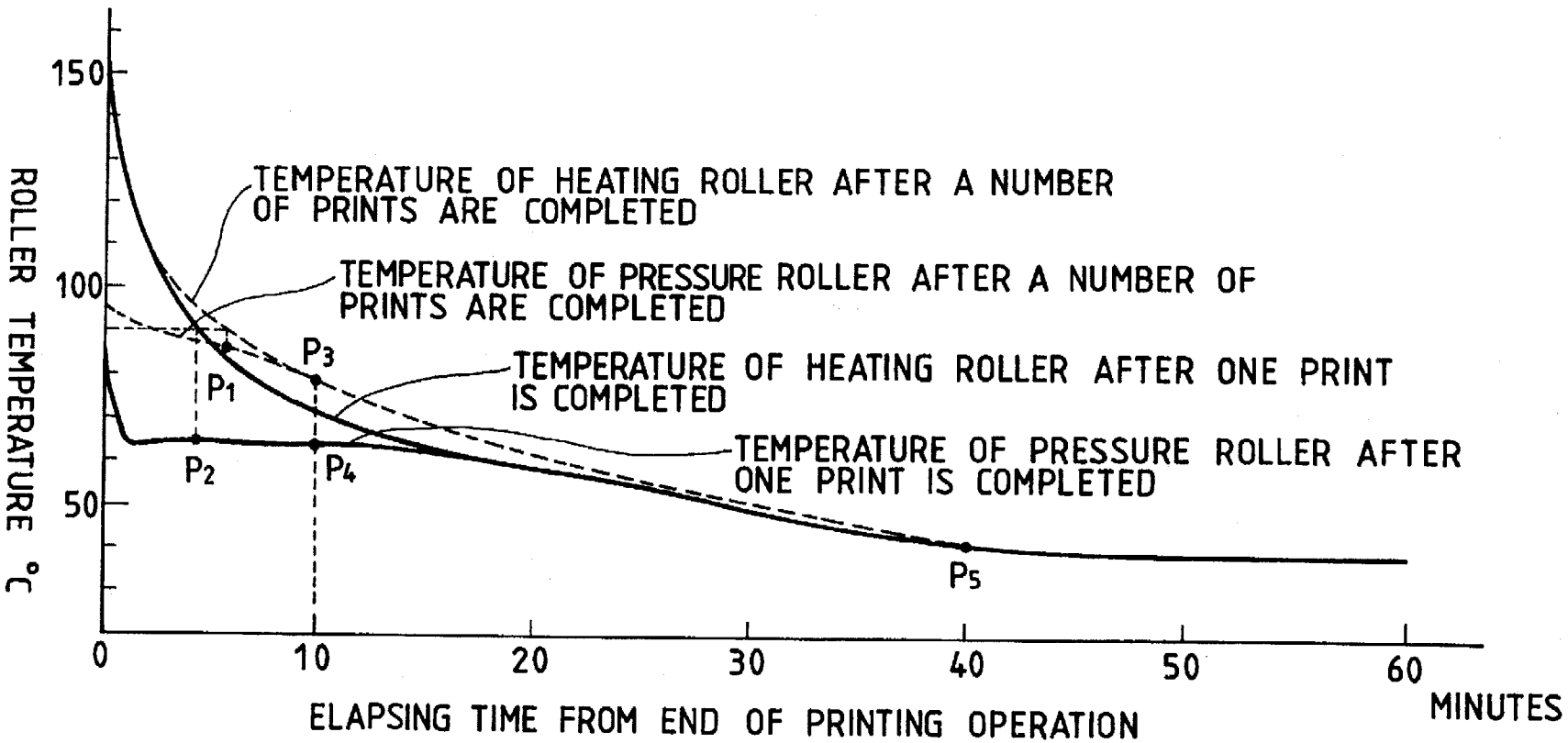
FIG. 26 is a graph showing how the temperature of the heating roller and the pressurizing roller fall in the print rest mode.

The temperature falling curves shown in FIG. 26, which represent natural heat dissipation of the heating roller and the pressurizing roller under the condition of the print rest, were examined on different idle rotation times. These curves were rearranged into the relationship between the heating roller temperature and the pressurizing roller temperature. The results were as illustrated in FIG. 21. A case where the value $t_I$ at the end of the previous print is 130 will typically be described. Temperature of the heating roller and the pressurizing roller that lies at a point P6 at the print end fall to a point P7 immediately after the print operation ends (initial temperature fall). When the temperature of the heating roller reaches a certain temperature (approximately 150° C. in this instance), the temperature of the pressurizing roller little changes while the temperature of the heating roller alone starts to fall (P7). When the temperature of the pressurizing roller at this time is denoted as Ts, a state that the temperature of the pressurizing roller little varies is continued till the temperature of the heating roller falls to the temperature Ts (P8).

When the temperature of the heating roller falls to the temperature Ts and is substantially equal to the latter, the temperature of both the heating roller and the pressurizing roller fall (P8 to P9). When the value $t_I$ at the end of the previous print operation is different, the temperature Ts is also different. Although the temperature Ts has a relation with the value $t_I$, and the temperature falling curves thereof are similar to each other in shape, irrespective of the value $t_I$ at the end of the previous print. The correction of the value $t_I$ based on the approximation of the temperature falling characteristic is very precise.

Figure 22:
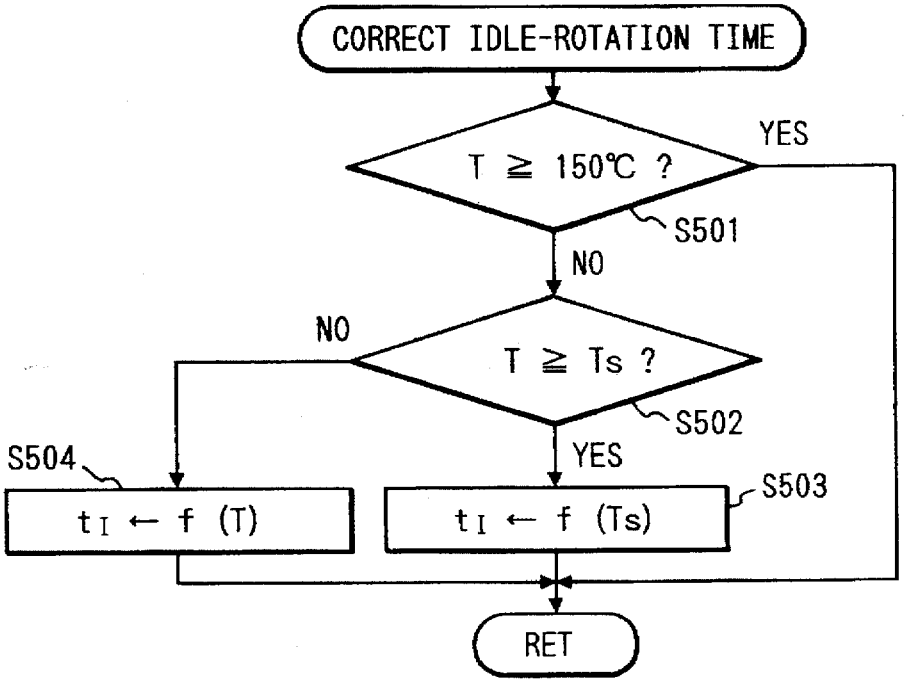
FIG. 22 is a flowchart showing the correction of the idle-rotation time timer, executed by the control system in a twelfth embodiment of the present invention.

FIG. 22 is a flowchart showing a method for correcting an idle-rotation time timer, which is based on the abovementioned concept. The idle-rotation time timer correcting method may be used in the step S204 of the ninth embodiment and in the step S303 of the tenth embodiment.

In the timer correction process of FIG. 22, the system control, checks if the sensed temperature T of the heating roller at the print start is 150° C. or higher, in a step S501. If it is 150° C. or higher, the system control determines that the rolls are in the initial temperature fall, and the pressurizing roller a little fall from the time when the previous print operation ends. Then, the idle-rotation time timer $t_I$ is not altered. When the sensed temperature is lower than 150° C., the system control checks if the sensed temperature is higher than Ts, which is defined as shown in Table 5, by the value $t_I$ at the end of the previous print (step S502).

TABLE 5

| $t_I$ at the end of the previous print | Ts (°C.) |
|---|---|
| $t_I \geqq 150$ | 90 |
| $100 \leqq t_I < 150$ | 85 |
| $70 \leqq t_I < 100$ | 80 |
| $50 \leqq t_I < 70$ | 75 |

TABLE 5-continued

| $t_I$ at the end of the previous print | Ts (°C.) |
|---|---|
| $40 \leqq t_I < 50$ | 70 |
| $30 \leqq t_I < 40$ | 65 |
| $20 \leqq t_I < 30$ | 60 |
| $15 \leqq t_I < 20$ | 55 |

If the sensed temperature T of the heating roller is equal to or higher than Ts in the step S502, the system control determines that the temperature of the pressurizing roller is approximately Ts, and advances to a step S503 where it sets the value $t_I$ to f(Ts) according to Table 6. If it is lower than Ts, the system control advances to a step S504 where it determines that the temperature of the pressurizing roller is approximately the temperature T of the heating roller, and sets the value $t_I$ to f(T) according to Table 6.

TABLE 6

| X | f(X) |
|---|---|
| $X \geqq 90$ | 100 |
| $85 \leqq X < 90$ | 80 |
| $80 \leqq X < 85$ | 60 |
| $70 \leqq X < 80$ | 45 |
| $60 \leqq X < 70$ | 30 |
| $40 \leqq X < 60$ | 15 |
| $X < 40$ | 0 |

In the printer of the present embodiment, the predetermined temperature Ts determined by $t_I$ retained as an estimated value of the quantity of heat accumulated in the pressurizing roller at the end of temperature control is compared with the sensed temperature T at the start of the temperature control. When the sensed temperature T is higher than the predetermined temperature Ts, the estimated value $t_I$ of the quantity of heat accumulated in the pressurizing roller is corrected into the value f(Ts) by the predetermined temperature Ts. When T is lower than Ts, $t_I$ is corrected into the value f(T).

Figure 23:
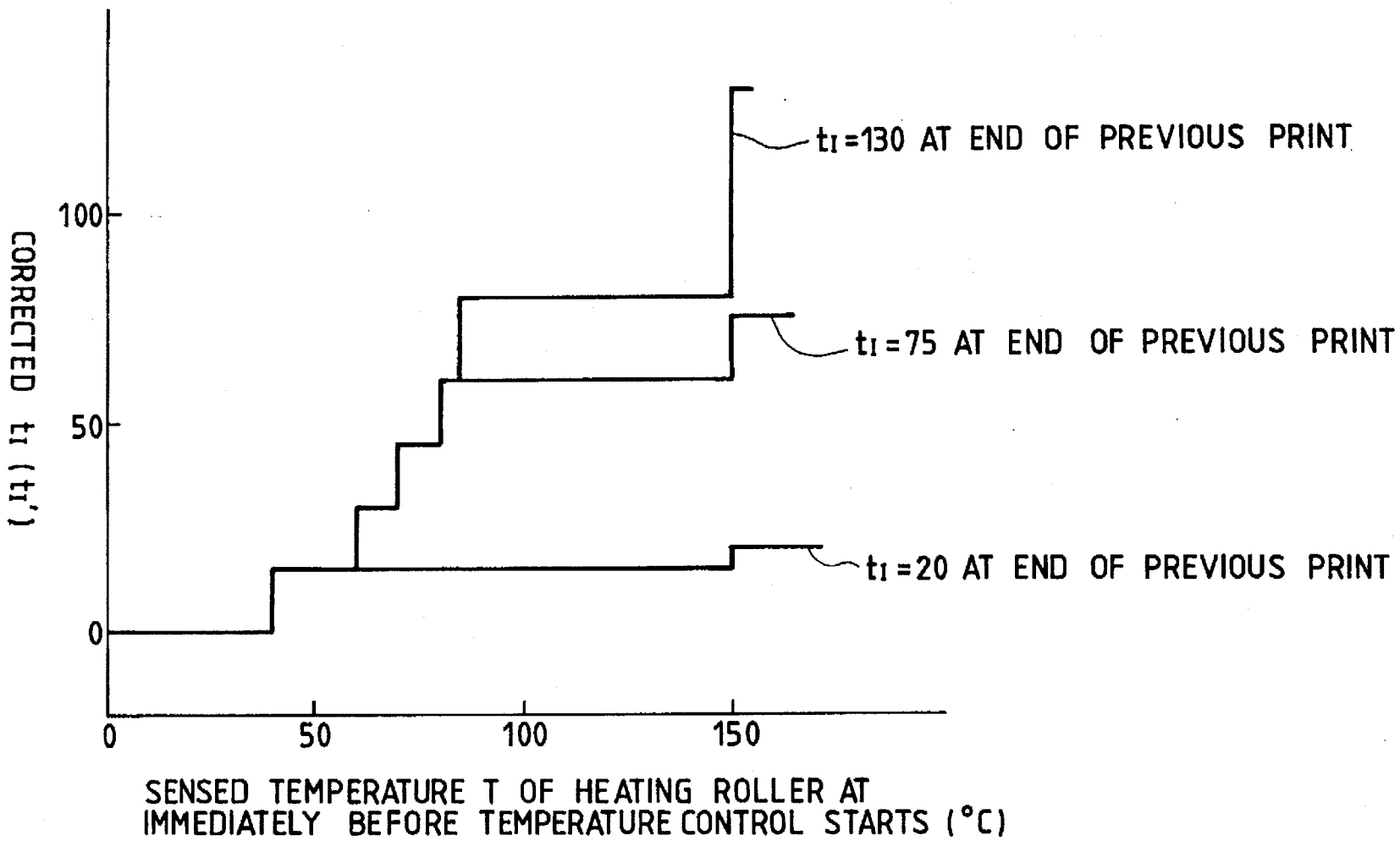
FIG. 23 is a graph showing how the value of an idle-rotation time timer is corrected by the control system in the twelfth embodiment.

FIG. 23 is a graph showing how the corrected $t_I$ is set with respect to the sensed temperature T of the heating roller at the restart of the control when the above-mentioned control is performed. Three cases where $t_I$ at the end of the previous print is 130, 75, and 20 are illustrated.

The division size of the value $t_I$ in Table 5 and that of the value X in Table 6 may be determined by a necessary predictive precision. Preferably, to gain the highest predictive precision, for $t_I$, the range from 15 to 150 is divided in the step of 1, and for X the range from 40° C. to 90° C. is divided in the step of the resolution of the A/D conversion.

The temperature of the pressurizing roller rises as the idle rotation of the fixing unit progresses, and eventually it is saturated. In the printer of the present embodiment, it was saturated for approximately 150 seconds. Therefore, the idle-rotation time timer $t_I$ capable of counting time up to 150 suffices. When the 1-sec interrupt routine that is designed such that when $t_I$ exceeds 150, $t_I$ is prohibited from being increased, is used, the memory capacity of the memory can correspondingly be reduced.

The printer of the present embodiment predicts a temperature of the pressurizing roller when its heat is naturally radiated and the printer is at a standstill, on the basis of the idle rotation time $t_I$ at the end of the previous print operation and the sensed temperature of the heating roller, and corrects the idle rotation time $t_I$ on the basis of the predicted temperature of the pressurizing roller. The printer can predict the temperature of the pressurizing roller considerably accurately, and provide an excellent fixing performance even if the print operation is intermittently repeated. The temperature falling characteristic of the pressurizing roller when its heat is naturally radiated during a period where the temperature of the heating roller falls but the temperature of the pressurizing roller does not fall is approximated to that during a period where the temperature of both the heating roller and the pressurizing roller fall. Therefore, the temperature of the pressurizing roller can be predicted by such a simple process that the tables are referred to by the sensed temperature T of the heating roller and the idle-rotation time $t_I$, not using a complicated predictive expression. Accordingly, the sensed temperature T can be predicted satisfactorily accurately even if the control ability of the CPU used in the control system is low.

The printer of the present embodiment using a 8-bit microprocessor of one-chip exhibited satisfactory performances.

The control method of the present embodiment is well adequate to a fixing unit of the type in which the heat capacity of the heating roller is smaller than that of the pressurizing roller, the temperature of the heating roller is higher than that of the pressurizing roller when the printer is in printing, and the temperature of the heating roller more quickly falls than that of the pressurizing roller. In the present embodiment, the heating roller is relatively thin, and the heat capacity ratio of the heating roller and the pressurizing roller is approximately 1:7. If the heat capacity of the pressurizing roller is five times or more as large as that of the heating roller, the heat of the heating roller is dissipated at a high temperature falling rate during a period that heat is little dissipated from the pressurizing roller, and the temperature of the heating roller is approximate to that of the pressurizing roller. Accordingly the accuracy of the temperature prediction is improved.

Thirteenth embodiment

Figure 25:
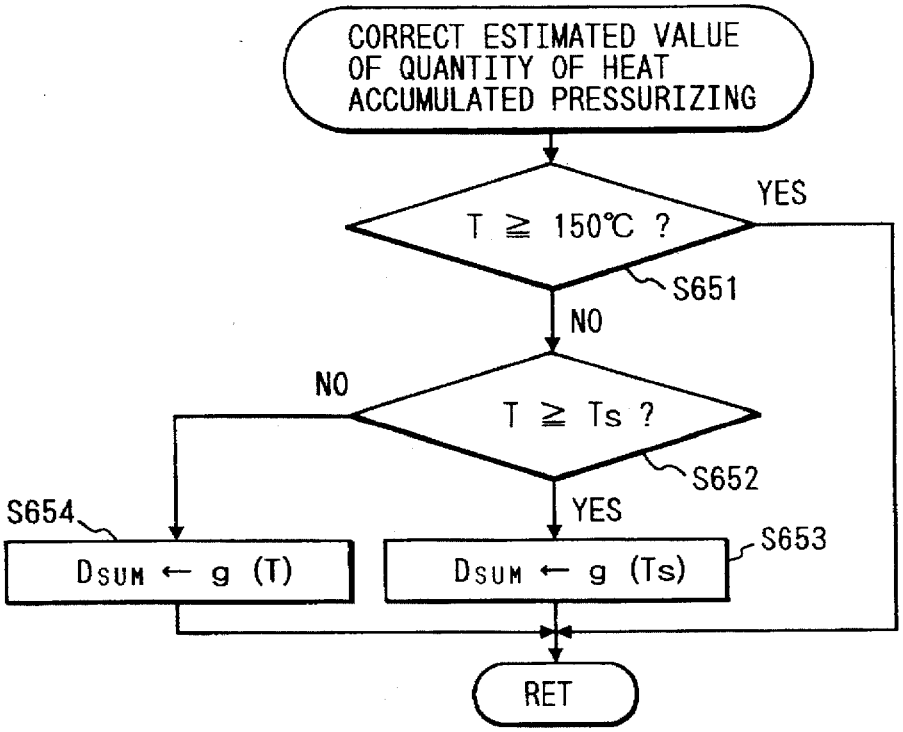
FIG. 25 is a flowchart showing a routine for correcting the estimated value of the quantity of the heat accumulated in the pressurizing roller, executed by the control system in the thirteenth embodiment.
Figure 24:
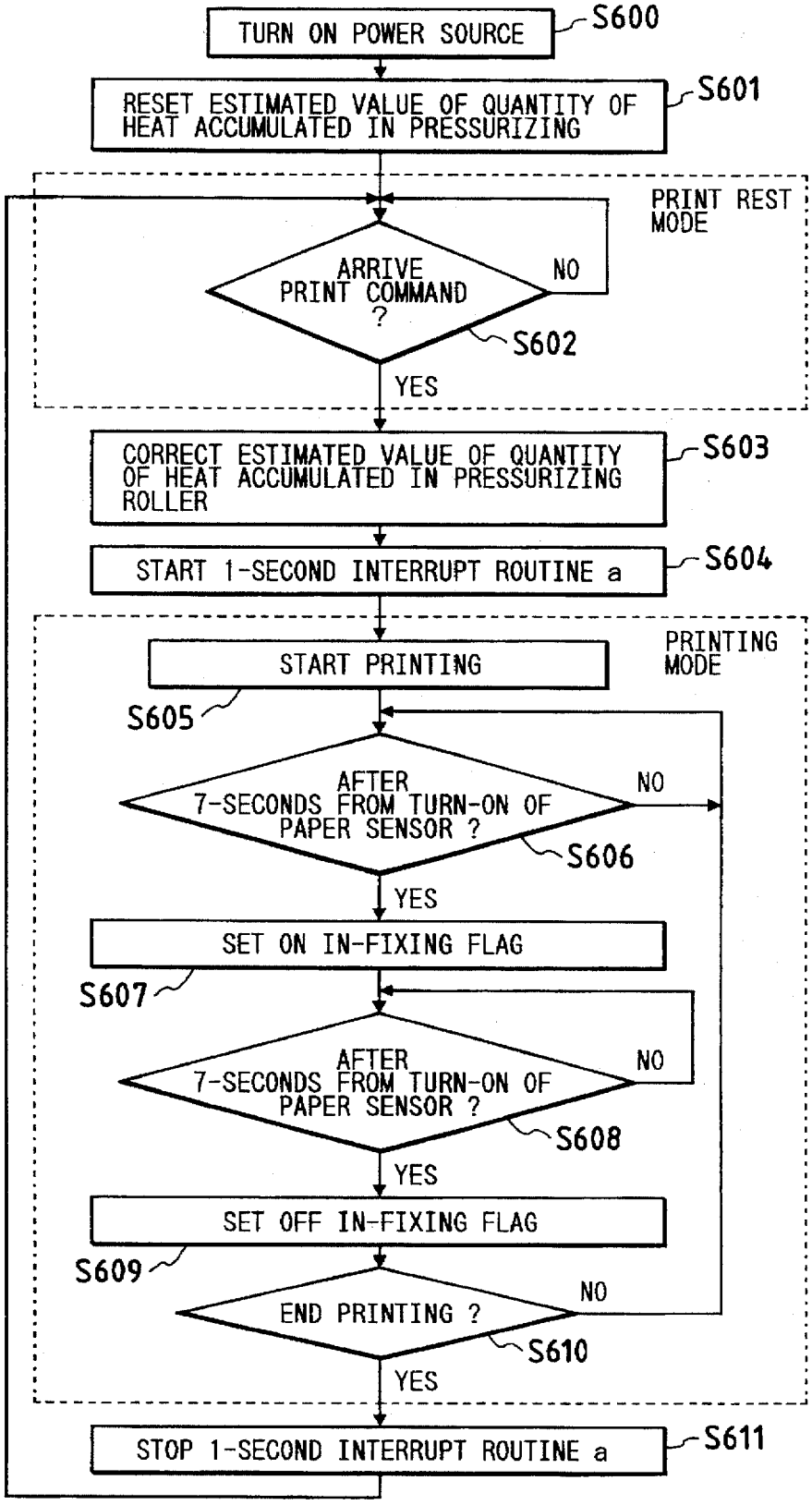
FIG. 24 is a flowchart showing a control process of a control method carried out by the control system in a thirteenth embodiment according to the present invention.

In the eighth to twelfth embodiments, the idle-rotation time is used for the estimated value of the quantity of the heat accumulated in the pressurizing roller. In the present embodiment, the integrated value of the heater output as in the seventh embodiment is used for the estimated value of the quantity of the heat accumulated in the pressurizing roller. Further, the heat dissipation during the print rest time period is used as one of the control factors, as in the twelfth embodiment. FIG. 24 is a flowchart showing a control process of a temperature control method of the seventh embodiment of the present invention. In the present embodiment, the integrated power $D_{SUM}$ when the printer is in printing, which is used in the seventh embodiment, is used in place of the idle-rotation time in the twelfth embodiment. A 1-sec interrupt routine a used in this embodiment is the same as that in the seventh embodiment. The estimated value of the quantity of the heat accumulated in the pressurizing roller is corrected (step S603) by using the correction routine of FIG. 25. The correction routine is similar to the idle-rotation time correction in the twelfth embodiment. Ts used in a step S652 of this correction routine is determined by Table 5 as stated above, and g(X) in steps S653 and S654 is determined by Table 7 given below.

TABLE 7

| X (°C.) | g(X) |
|---|---|
| X ≧ 90 | 1000 |
| 85 ≦ X < 90 | 800 |
| 80 ≦ X < 85 | 600 |

TABLE 7-continued

| X (°C.) | g(X) |
|---|---|
| 70 ≦ X < 80 | 450 |
| 60 ≦ X < 70 | 300 |
| 40 ≦ X < 60 | 150 |
| X < 40 | 0 |

In the ninth to thirteenth embodiments, the present invention is applied to the case where the fixing unit is not heated during the print rest time period. The present embodiment is adequate to a case where the quantity of heat accumulated in the pressurizing roller varies during the print rest time period, and more adequate to a case where the heating roller is controlled at a temperature lower than the fixing temperature in the print rest mode.

The idle-rotation time may be corrected on the basis of a paper passage time as the integration of the time of the in-fixing flag being set. Further, the quantity of the correction based on the paper passage time may be altered by information of paper temperature, water contents, the kind of paper, and the like. By so doing, a more accurate prediction of the temperature rise of the pressurizing roller is secured.

In the image forming apparatus of the present invention, a set temperature of the heating roller is switched to another by an estimated value of the quantity of the heat accumulated in the pressurizing roller when the fixing unit is in an idle rotation state. Therefore, a proper switching of the set temperature is possible even if the intervals of the printing operations are irregular. The result is to prevent the crinkle of the paper sheet and fixing faulty, and nonuniformity of the picture qualities, such as gloss and curl of the paper sheet.

In the image forming apparatus of the present invention, the estimated value of the quantity of the heat accumulated in the pressurizing roller is the integrated value of the quantity of heat applied to the heating roller by the control system. Accordingly, the accumulated heat can be estimated without any special means additionally used. The advantages of the apparatus are simplification of the control method and improvement of the reliability, in addition to the advantages of the apparatus.

In the image forming apparatus of the present invention, the estimated value of the quantity of the heat accumulated in the pressurizing roller is the idle-rotation time. Accordingly, the quantity of the accumulated heat can be estimated by using a simple timer. As a result, the apparatus has the following advantages in addition to the advantages of the apparatus described above. The temperature control is simplified and the load to the control by the fixing unit to the control of the whole device is lessened.

In the image forming apparatus of the present invention, the rotation of the rollers of the fixing unit is detected by the drive signal from the control system. Accordingly, the roller rotation detection is possible without any additional means. As a result, the apparatus has the following advantages in addition to the advantages of the apparatus. The control method is simplified and the reliability is improved.

In the image forming apparatus of the present invention, presence or absence of the image bearing material at the nip is detected by a signal from the paper sensor. If the timing to start the paper feed by the paper feed roller is slightly deviated, the travel of the paper sheet can reliably be monitored. Therefore, the apparatus has a useful effect that it can reliably detect the presence or absence of the sheet at the nip, in addition to the useful effects of the apparatus described above.

In the image forming apparatus of the present invention, heat dissipation of the pressurizing roller during the non-print period is taken into consideration in the temperature control. The apparatus has the following useful effects in addition to those of the apparatuses described above. That is, the energy saving is achieved, and excessive temperature rise within the apparatus is prevented.

In the image forming apparatus of the present invention, heat dissipation from the pressurizing roller during the non-print period is predicted on the basis of the information of the time elapsing from the print end. The prediction accuracy is high, and the resultant print quality is high. The apparatus has the useful effects of the apparatus described above, as a matter of course.

In the apparatus of the present invention, heat dissipation from the pressurizing roller during the non-print period is predicted on the basis of the information of the sensed temperature of the heating roller. If the power source is turned off during the non-print period, the apparatus can properly control the temperature of the heating roller after the printing operation restarts. Further, a uniform print quality is secured even if the apparatus is operated in a place where ambient temperature varies. The apparatus has the useful effects of the apparatus described above, as a matter of course.

In the image forming apparatus of the present invention, the temperature falling characteristic of the pressurizing roller when its heat is naturally radiated during a period where the temperature of the heating roller falls but the temperature of the pressurizing roller does not fall is approximated to that during a period where the temperature of both the heating roller and the pressurizing roller fall. Therefore, the temperature of the pressurizing roller can be predicted by such a simple process that the tables are referred to by the sensed temperature of the heating roller and the idle-rotation time, not using a complicated predictive expression. Accordingly, the sensed temperature can be predicted satisfactorily accurately even if the control ability of the CPU used in the control system is low. The apparatus has the useful effects of the apparatus of the present invention, as a matter of course.

In the image forming apparatus of the present invention, the estimated value of the quantity of the heat accumulated in the pressurizing roller during the print rest time period is gradually corrected. Accordingly, no load is applied at the time of starting the printing operation. At this time, the control load is at maximum. The heat dissipation of the pressurizing roller can be predicted using a CPU whose ability is not so high.

Fourteenth embodiment

The fixing apparatus of the invention senses the temperature of the heating roller, proportionally controls the electric power supplied to the halogen lamp based on the sensed result, controls the temperature of the heating roller to the target temperature, estimates the temperature of the pressurizing roller from the sensed temperature Tm and the target temperature Tc when the temperature of the heating roller is sensed, and sets the heating conditions adequate for the estimated temperature of the pressurizing roller.

Figure 27:
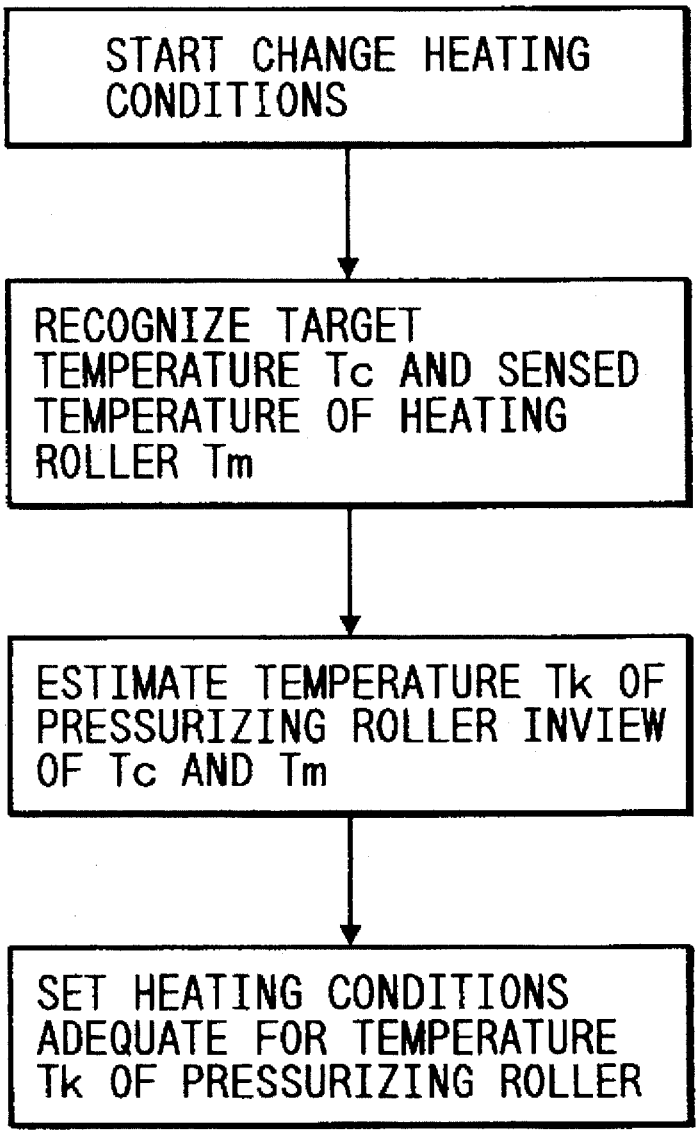
FIG. 27 is a chart of an algorithm example showing a method of setting heating conditions in the invention.

This algorithm is shown in FIG. 27. Next, an example of the invention will be described with reference to FIG. 27. When a routine for changing heating conditions is started, the target temperature Tc and the sensed temperature Tm of the heating roller are recognized. From the target temperature Tc and the sensed temperature Tm of the heating roller, the temperature Tk of the pressurizing roller is estimated, so that appropriate heating conditions for the temperature Tk of the pressurizing roller is set.

Figure 28:
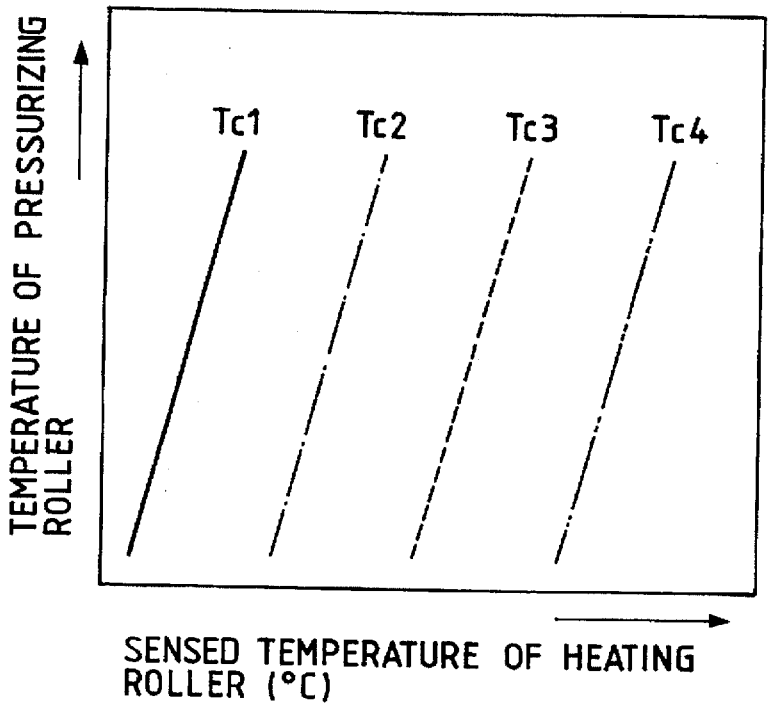
FIG. 28 is a graph showing an exemplary correlation between the sensed temperature of the heating roller and the temperature of the pressurizing roller at a certain target temperature Tc.

The electric power supplied to the halogen lamp was controlled in proportion to the deviation of the sensed temperature Tm of the heating roller from the target temperature Tc. Referring to FIG. 28, each of temperatures Tc1 to Tc4 was set as the target temperature Tc. At each target temperature, the temperature Tk of the pressurizing roller was changed, and the sensed temperature Tm of the heating roller was measured. The results shown in FIG. 28 were obtained. The abscissa in FIG. 28 indicates the sensed temperature Tm of the heating roller, and the ordinate indicates the temperature Tk of the pressurizing roller. As shown in FIG. 28, the temperature Tk of the pressurizing roller is uniquely determined from the target temperature Tc and the sensed temperature Tm, so that expression (7) described above in the Summary of Invention section of the specification is confirmed.

Accordingly, the temperature Tk of the pressurizing roller is estimated from the target temperature Tc and the sensed temperature Tm of the heating roller, and appropriate heating conditions are set for the temperature Tk of the pressurizing roller, whereby faulty fixing, paper crinkles, and offset can be prevented from occurring.

Experimental Example 5

In the experimental example, the temperature of the pressurizing roller was estimated from a target temperature and a sensed temperature of a heating roller, and a target temperature of the heating roller which was suitable for the temperature of the pressurizing roller was set again.

The fixing apparatus used in the experimental example performed the fixing in the following manner. As shown in FIG. 1, a nip between a pair of heating roller and pressurizing roller which were in contact under pressure nipped and transported a paper sheet which is an image supporting material, an image forming face of the paper sheet was in contact with the heating roller, and a halogen lamp of 400 W was disposed as a heating element (a heater) inside the heating roller.

As the heating roller, a cylinder made of aluminum (outer diameter: 18 mmϕ, and wall thickness: 0.6 mm) having a covering layer of fluororesin was used. As the pressurizing roller, a roller (outer diameter: 18 mm) in which a silicone rubber layer having 23 degrees of JIS-A hardness was formed on the outer surface of a steel shaft by injection molding was used. The heating roller and the pressurizing roller were in contact under pressure by loading means (not shown) with a total load of 6 kgf. The heating roller was rotated by a driving apparatus (not shown), and the transportation velocity was set to be 23.4 mm/sec. The ambient temperature was 20° C. and the ambient humidity was 50%.

The temperature control of the heating roller was performed by 1-second cycle, and the temperature adjustment was performed by proportionally controlling the electric power with respect to the deviation of the current temperature Tm of the heating roller from the target temperature Tc. The electric power was adjusted by the duty control in which one second was regarded as 100%. The duty (Duty) was expressed by the following control expression:

$$\text{Duty}\ (\%)=3.8\times(Tc-Tm)+23.2,$$

Tc: target temperature, and Tm: sensed temperature of the heating roller.

As the result of the calculation using the control expression, the Duty of 100% or more was regarded as 100%, and the Duty of 0% or less was regarded as 0%.

The temperature of the heating roller was sensed by the thermistor. In the example, a resistor of 1.57 kΩ was connected in series to the thermistor, and a DC voltage of 5

V was applied to the series circuit. A voltage obtained by voltage division using the thermistor and the resistors was quantized by an 8-bit analog-to-digital (A/D) converter, and then read by the CPU. The quantized value is referred to as an AD value. Accordingly, in the above control expression of the duty, Tc and Tm are given as AD values.

As described above, in the experimental example, the next Tc' is determined from Tc and Tm. The determination is performed in accordance with a table which is produced by the following steps (1) to (3):

(1) Setting of a target temperature of the heating roller;

(Based on a good-fixing range (referred to as a fixing map) which is previously obtained, a target temperature of the heating roller corresponding to the temperature of the pressurizing roller is set.)

(2) Correlation between Tm and the temperature of the pressurizing roller;

(The temperature of the heating roller is controlled to the preset target temperature Tc, and a sensed temperature Tm of the heating roller corresponding to the temperature Tk of the pressurizing roller is examined.)

(3) A target temperature of the heating roller which is to be set next is determined for the sensed temperature Tm of the heating roller during the control at each target temperature Tc.

The above-mentioned steps (1) to (3) will be described in detail.

(1) Setting of a target temperature of the heating roller

Figure 29:
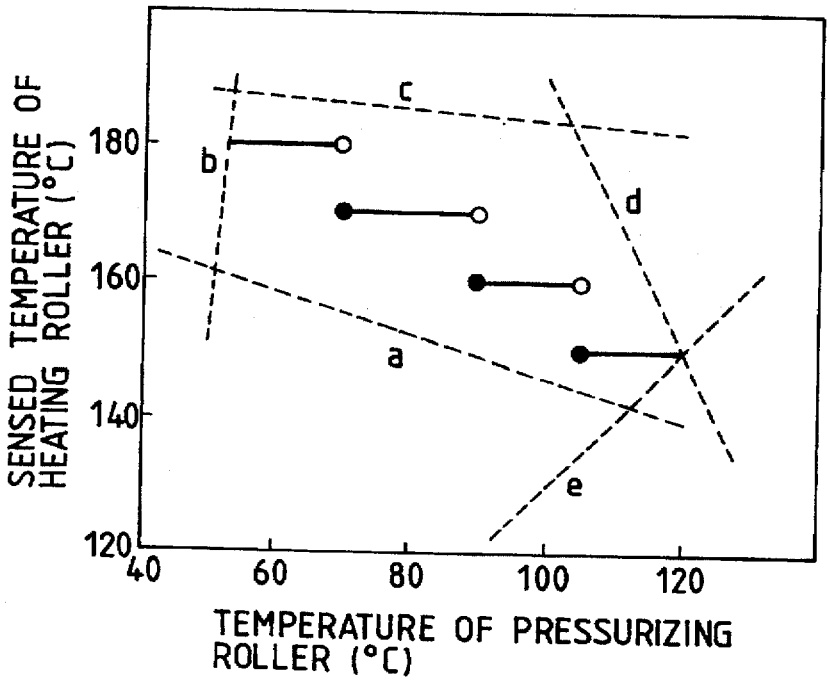
FIG. 29 is a graph showing a preset temperature of the heating roller which is suitable for the temperature of the pressurizing roller in the fixing apparatus of the embodiment of the invention.

FIG. 29 is a so-called fixing map. The abscissa in FIG. 29 indicates the temperature of the pressurizing roller, and the ordinate indicates the temperature of the heating roller.

Line a indicates a fixing ratio. The area above and including the line is an area in which fixing is satisfactorily attained.

For the first paper sheet which was used in the first printing operation in, for example, the morning (in a condition in which the fixing apparatus was completely cold), the temperature of the pressurizing roller had the lowest value when the leading edge of the first paper sheet entered the nip of the fixing apparatus. In operation, the leading edge of the first paper sheet reached the nip of the fixing apparatus after the elapse of 15 seconds from the start of the rotation driving of the fixing apparatus. The lowest temperature of the pressurizing roller depends on the temperature of the heating roller. As the temperature of the heating roller increases, the lowest temperature of the pressurizing roller is correspondingly raised. Line b indicates the temperature of the pressurizing roller obtained when the printing operation was started from lowest temperature of the pressurizing roller, i.e., in the completely cold condition in the morning, and the leading edge of the first paper sheet entered the nip of the fixing apparatus. Accordingly, after the fixing apparatus is activated, the temperature of the pressurizing roller stays in the higher-temperature side with respect to the line.

In an area above line c, high-temperature offset occurs, and hence it is necessary to set the temperatures of the two rollers to be in the lower-temperature side with respect to line c.

In an area above line d, paper crinkles occur, and hence it is necessary to set the temperatures of the two rollers to be in the lower-temperature side with respect to line d.

As described above in the "Prior Art" section, the time interval between successively fed sheets is not constant in a printer, a facsimile apparatus, and the like. The saturated temperature of the pressurizing roller is higher as the time interval between sheets increases. In the experimental example, the maximum time interval between successively fed sheets was assumed to be 12 seconds, and the saturated temperature of the pressurizing roller in this condition is indicated by line e. Accordingly, the temperature of the pressurizing roller is a temperature on the line or on the lower-temperature side with respect to the line.

For the purpose of attaining good fixing, the temperatures of the heating roller and the pressurizing roller are required to be in a pentagonal area enclosed by lines a, b, c, d, and e.

In order to always attain good printing, the temperature of the heating roller was set in four levels of temperatures indicated by solid lines in FIG. 29, in accordance with the temperature of the pressurizing roller.

Table 8 below shows the temperature of the heating roller to be set in accordance with the temperature of the pressurizing roller.

According to the invention, when the temperature of the pressurizing roller is estimated and the temperature of the heating roller is set in accordance with the table, excellent images can be always obtained.

TABLE 8

| Temperature of pressurizing roller | Temperature heating |
|---|---|
| Lower than 70° C. | Tc1 = 180° C. |
| Equal to or higher than 70° C. and lower than 90° C. | Tc2 = 170° C. |
| Equal to or higher than 90° C. and lower than 105° C. | Tc3 = 160° C. |
| Equal to or higher than 105° C. | Tc4 = 150° C. |

(2) Correlation between Tm and the temperature of the pressurizing roller

Next, the relationship between the sensed temperature Tm of the heating roller and the temperature Tk of the pressurizing roller will be described.

The relationship between the sensed temperature Tm of the heating roller and the temperature Tk of the pressurizing roller was examined while the temperature of the heating roller was controlled to the target temperature Tc and the temperature of the pressurizing roller was varied.

The examination results are listed in Tables 9 to 12 below. Tables 9 to 12 correspond to different target temperatures, respectively. The target temperatures were 150° C., 160° C., 170° C., and 180° C., respectively. The AD values were Tc1=126, Tc2=140, Tc3=154, and Tc4=166, respectively.

As the results of the examination, the temperature Tk of the pressurizing roller corresponding to the temperature Tm in column [a] was as shown in column [b].

In this way, Tk is uniquely obtained from Tc and Tm, so that the temperature of the pressurizing roller can be estimated.

(3) To determine Tc' which is to be set next and which corresponds to Tc and Tm

Next, in accordance with Table 9, Tc' which can attain good fixing and which corresponds to the estimated temperature Tk of the pressurizing roller was determined as shown in column [c]. The temperatures in column [c] correspond to the AD values shown in column [d].

As seen from the above description, for example, in the case where the temperature is controlled to 150° C., when the sensed temperature of the heating roller has the AD value in column [a] of Table 9, the value in column [d] of Table 9 is used as the next target temperature Tc' of the heating roller, whereby images with good fixing is always obtained without causing high-temperature offset and paper crinkles.

If the routine for changing the target temperature of the heating roller is performed during a preparation idle rotation after the start of printing and before first paper is fed, or in a condition in which any paper sheet is not present in the nip of the fixing apparatus, i.e., between paper sheets, the pressurizing roller is directly in contact with the heating roller, so that the temperature of the pressurizing roller can be estimated more accurately. In the case where the temperature of the pressurizing roller is not suddenly varied, it is sufficient to perform the routine for changing the target temperature of the heating roller, between paper sheets after each predetermined number of paper sheets. This does not place a burden on the processing in the CPU, so that other processing steps are not interrupted by the routine. If the fluctuation of temperature of the heating roller is large, results of two or more successive temperature sensing operations may be averaged. The temperature of the pressurizing roller is estimated by using the averaged value, and the next target value Tc' of the heating roller is set. This enables the temperature of the pressurizing roller to be estimated more accurately. Even if the environment or the quality of paper sheets is degraded, it is possible to prevent faulty fixing, paper crinkle, and offset from occurring.

TABLE 9

Tc1 = 126 (150° C.)

| [a] Tm (AD) | [b] Tk (°C.) | [c] Tc' (°C.) | [d] Tc' (AD) |
|---|---|---|---|
| 110 | 46.84 | 180 | 169 |
| 111 | 54.15 | 180 | 169 |
| 112 | 61.46 | 180 | 169 |
| 113 | 68.77 | 180 | 169 |
| 114 | 76.08 | 170 | 157 |
| 115 | 83.39 | 170 | 157 |
| 116 | 90.7 | 160 | 143 |
| 117 | 98.01 | 160 | 143 |
| 118 | 105.32 | 150 | 128 |
| 119 | 112.63 | 150 | 128 |
| 120 | 119.94 | 150 | 128 |
| 121 | 127.25 | 150 | 128 |
| 122 | 134.56 | 150 | 128 |

TABLE 10

Tc2 = 140 (160° C.)

| [a] Tm (AD) | [b] Tk (°C.) | [c] Tc' (°C.) | [d] Tc' (AD) |
|---|---|---|---|
| 128 | 40.87 | 180 | 169 |
| 129 | 48.18 | 180 | 169 |
| 130 | 55.49 | 180 | 169 |
| 131 | 62.8 | 180 | 169 |
| 132 | 70.11 | 170 | 157 |
| 133 | 77.42 | 170 | 157 |
| 134 | 84.73 | 170 | 157 |
| 135 | 92.04 | 160 | 143 |
| 136 | 99.35 | 160 | 143 |
| 137 | 106.66 | 150 | 128 |
| 138 | 113.97 | 150 | 128 |
| 139 | 121.28 | 150 | 128 |
| 140 | 128.59 | 150 | 128 |
| 141 | 135.9 | 150 | 128 |
| 142 | 143.21 | 150 | 128 |

TABLE 11

Tc3 = 154 (170° C.)

| [a] Tm (AD) | [b] Tk (°C.) | [c] Tc' (°C.) | [d] Tc' (AD) |
|---|---|---|---|
| 146 | 44.07 | 180 | 169 |
| 147 | 51.38 | 180 | 169 |
| 148 | 58.69 | 180 | 169 |
| 149 | 66 | 180 | 169 |
| 150 | 73.31 | 170 | 157 |
| 151 | 80.62 | 170 | 157 |
| 152 | 87.93 | 170 | 157 |
| 153 | 95.24 | 160 | 143 |
| 154 | 102.55 | 160 | 143 |
| 155 | 109.86 | 150 | 128 |
| 156 | 117.17 | 150 | 128 |
| 157 | 124.48 | 150 | 128 |
| 158 | 131.79 | 150 | 128 |
| 159 | 139.1 | 150 | 128 |
| 160 | 146.41 | 150 | 128 |
| 161 | 153.72 | 150 | 128 |
| 162 | 161.03 | 150 | 128 |

TABLE 12

Tc4 = 166 (180° C.)

| [a] Tm (AD) | [b] Tk (°C.) | [c] Tc' (°C.) | [d] Tc' (AD) |
|---|---|---|---|
| 162 | 50.99 | 180 | 169 |
| 163 | 58.3 | 180 | 169 |
| 164 | 65.61 | 180 | 169 |
| 165 | 72.92 | 170 | 157 |
| 166 | 80.23 | 170 | 157 |
| 167 | 87.54 | 170 | 157 |
| 168 | 94.85 | 160 | 143 |
| 169 | 102.16 | 160 | 143 |
| 170 | 109.47 | 150 | 128 |
| 171 | 116.78 | 150 | 128 |
| 172 | 124.09 | 150 | 128 |
| 173 | 131.4 | 150 | 128 |
| 174 | 138.71 | 150 | 128 |
| 175 | 146.02 | 150 | 128 |
| 176 | 153.33 | 150 | 128 |
| 177 | 160.64 | 150 | 128 |
| 178 | 167.95 | 150 | 128 |

Experimental Example 6

In the second experimental example, the temperature of the pressurizing roller was estimated from a target temperature of the heating roller and a sensed temperature of the heating roller, and the period of the rotation driving on the fixing apparatus which was to be performed before a paper sheet reached the nip of the fixing apparatus was set based on the estimated result of the temperature of the pressurizing roller.

A usual OHP sheet was introduced into the fixing apparatus shown in FIG. 1, and the fixing operation was performed. When the temperature of the pressurizing roller was lower than 130° C., the OHP sheet was rolled, i.e., the so-called curling occurred. When the OHP sheet was projected using OHP apparatus, the resulting image blurred. When the temperature was 130° C. or higher, however, the curling was very small in degree and the image blur did not occur when the sheet was projected.

Accordingly, in the case where the fixing is performed on an OHP sheet, it is necessary to set the temperature of the pressurizing roller to be 130° C. or higher.

Particularly in an on/off printer, a heater is turned off in the waiting state, so that the temperature of the pressurizing roller is lowered. For this reason, it is necessary to raise the temperature of the pressurizing roller by rotating the fixing apparatus for a predetermined time period while the temperature of the heating roller is maintained high, before the fixing operation on the OHP sheet is performed.

Figure 30:
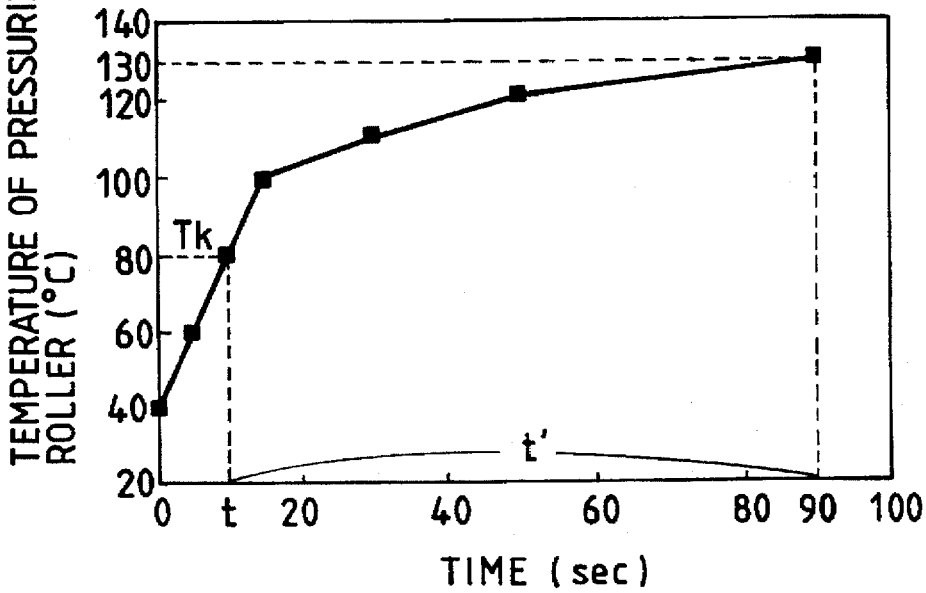
FIG. 30 is a graph showing a temperature rise characteristic of the pressurizing roller with respect to the elapsed time of idle rotation of the fixing apparatus of the embodiment of the invention.

FIG. 30 shows a temperature rise curve of the pressurizing roller when the two rollers are rotated in a state where a paper sheet is not present in the nip of the fixing apparatus (hereinafter this state is referred to as "idle rotation"). The abscissa indicates the time (seconds), and the ordinate indicates the temperature of the pressurizing roller (°C.). The target temperature of the heating roller was set to be 170° C. The temperature of the pressurizing roller reached 130° C. in 90 seconds.

The time period elapsed after the start of idle rotation is denoted by t, and the maximum of t is assumed to be 90 seconds.

When the temperature of the pressurizing roller at the time t is denoted by Tk, and a time period required for the temperature of the pressurizing roller to be raised from Tk to 130° C. is denoted by t', the following condition holds:

$$t'=90-t$$

Figure 31:
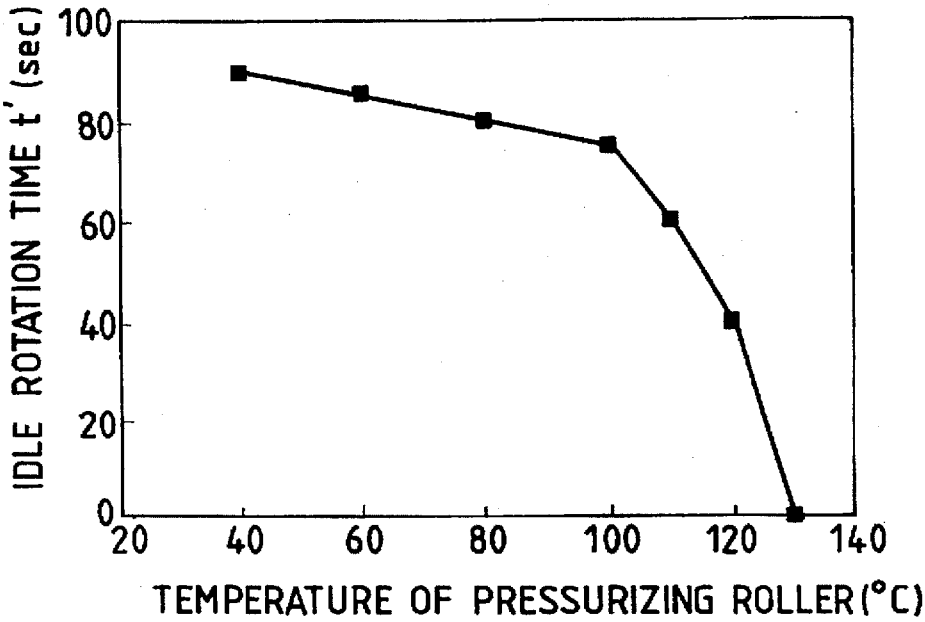
FIG. 31 is a graph showing an idle rotation time required for the temperature of the pressurizing roller to reach 130° C. when the pressurizing roller in the fixing apparatus of the embodiment of the invention is at a certain temperature.

FIG. 31 shows a time required for the pressurizing roller to reach 130° C. from a certain temperature. The time is obtained from the expression above and FIG. 30. The abscissa in FIG. 31 indicates the temperature of the pressurizing roller, and the ordinate indicates the time required for the pressurizing roller to reach about 130° C.

From FIG. 31, the idle rotation time required for the temperature of the pressurizing roller was set as shown in Table 13 below.

TABLE 13

| Temperature of pressurizing roller [°C.] | Required idle rotation time (sec) |
|---|---|
| Lower than 60° C. | 90 |
| Equal to or higher than 60° C. and lower than 80° C. | 85 |
| Equal to or higher than 80° C. and lower than 100° C. | 80 |
| Equal to or higher than 100° C. and lower than 110° C. | 75 |
| Equal to or higher than 110° C. and lower than 120° C. | 60 |
| Equal to or higher than 120° C. and lower than 130° C. | 40 |
| Equal to or higher than 130° C. | 0 |

Table 14 below shows the idle rotation time with respect to the target temperature Tc and the sensed temperature Tm of the heating roller which were used in the experimental example.

The temperature Tk of the pressurizing roller corresponding to column [a] of Table 14 is shown in column [b]. The idle rotation time required before the printing for an OHP sheet corresponding to column [b] which is read from Table 13 is shown in column [e] of Table 14.

When the transmission of printing data to a printer is started, for example, the heating roller is warmed up. When the temperature of the heating roller reaches the target, the rotation driving is started and also the routine for setting a preparation idle rotation time is started. If Tm has an AD value of 149, for example, the preparation idle rotation time is set to be 85 seconds in accordance with Table 14. The rotation driving is performed on the fixing apparatus for 85 seconds before the first paper sheet reaches the nip of the fixing apparatus.

As described above, if the idle rotation is performed before the fixing of an OHP sheet in accordance with Table 14, the curling of the OHP sheet after the fixing can be prevented, and it is not necessary to set the temperature of the heating roller to be high. Accordingly, high-temperature offset can be eliminated, and an excessive temperature rise can be prevented from occurring.

TABLE 14

| Tc = 154 (170° C.) | | |
|---|---|---|
| [a] Tm (AD) | [b] Tk (°C.) | [e] Idle rotation time (sec.) |
| 146 | 44.07 | 90 |
| 147 | 51.38 | 90 |
| 148 | 58.69 | 90 |
| 149 | 66 | 85 |
| 150 | 73.31 | 85 |
| 151 | 80.62 | 75 |
| 152 | 87.93 | 75 |
| 153 | 95.24 | 75 |
| 154 | 102.55 | 75 |
| 155 | 109.86 | 75 |
| 156 | 117.17 | 60 |
| 157 | 124.48 | 40 |
| 158 | 131.79 | 0 |
| 159 | 139.1 | 0 |
| 160 | 146.41 | 0 |
| 161 | 153.72 | 0 |
| 162 | 161.03 | 0 |

Experimental Example 7

In the seventh experimental example, a no-power supply time for the halogen lamp, the heat source disposed inside the heating roller, was set based on the target temperature of the heating roller and the sensed temperature of the heating roller.

When the fixing was performed on a 60-g paper sheet in the fixing apparatus shown in FIG. 1 under a high-temperature and high-humidity environment (35° C., and 65%), paper crinkles occurred at the temperature of the pressurizing roller of 125° C. or higher, irrespective of the temperature of the heating roller. When the printing was successively performed, the temperature of the pressurizing roller was substantially saturated after 30 paper sheets, and the saturated temperature was 135° C. Accordingly, paper crinkles occurred in the range of the temperature of the pressurizing roller from 125° to 135° C.

In the case where the temperature of the pressurizing roller was 90° C. or higher, even if the heater was forcedly turned off during the preparation idle rotation (the idle rotation before a paper sheet reached the nip of the fixing apparatus), the temperature of the pressurizing roller was maintained to be 80° C. or higher. Thus, faulty fixing did not occur.

Accordingly, at the temperature of the pressurizing roller lower than 90° C., the heater was not forcedly turned off during the preparation idle rotation, and, at the temperature of the pressurizing roller of 90° C. or higher, the heater was forcedly turned off.

Next, the experimental example will be described in accordance with a specific sequence.

When the transmission of printing data is started, the heating roller is warmed up. When the temperature of the heating roller reaches the target, the rotation is started, and the temperature of the pressurizing roller is estimated. If the temperature of the pressurizing roller is lower than 90° C., the heater is not forcedly turned off. When the printing data are set to a data ready state, a paper feeding operation is started, and the fixing is performed. If the estimation result of the temperature of the pressurizing roller is 90° C. or higher, the heater is forcedly turned off immediately after the routine for estimating the temperature of the pressurizing roller is finished. When the printing data are set to a data ready state, the paper feeding operation is started, and the forced off state of the heater is canceled before the paper sheet reaches the nip of the fixing apparatus by three seconds, and the temperature control of the heating roller is started again. The period of three seconds is a time period required for recovering the temperature of the heating roller to the predetermined target temperature.

In the case where a successive printing was performed under a high-temperature and high-humidity environment and with the maximum time interval between sheets (12 seconds), satisfactory fixing was attained even when the temperature of the pressurizing roller was low. The pressurizing roller reached the saturated temperature (120° C.) after 30 paper sheets were fed, but the saturated temperature of the pressurizing roller was lower by 15° than that obtained in the case where the heater was not forcedly turned off. Accordingly, it was possible to prevent paper crinkles from occurring.

According to the fixing apparatus of the invention, a difference is created between a target temperature and an actually sensed temperature when the proportional control is performed on a heating roller, the temperature of a pressurizing roller can be accurately estimated from these temperatures, and the temperature of the heating roller can appropriately be changed depending on the temperature of the pressurizing roller. Accordingly, in the case where the electric power supplied to the heater is cut off in a nonprinting period for the purpose of saving the electric power, or in the case where the time interval between sheets is not constant, the temperature of the pressurizing roller which is inconsistently varied can be estimated based on the history, and hence satisfactory fixing can be performed.

During the nonprinting operation, the heater can be turned off, so that the temperature in a copy machine or a printer can be kept low. The low temperature improves the storing property of toner, and the life of toner is increased. In addition, since the temperature in the printer can be kept low, it is unnecessary to drive a fan for lowering the temperature in the printer, so that it is possible to attain low noise and low power consumption.

Further, according to the invention, the temperature of the heating roller can appropriately be set in accordance with the temperature of the pressurizing roller, so that faulty fixing and paper crinkles are prevented from occurring.

Additionally, the preparation idle rotation time can appropriately be set in accordance with the temperature of the pressurizing roller, so that the printing on an OHP sheet can be performed after the temperature of the pressurizing roller is sufficiently raised. Thus, it is possible to suppress the occurrence of curling of the OHP sheet.

Also, the heater can be turned off in the preparation idle rotation in accordance with the temperature of the pressurizing roller, so that the saturated temperature of the pressurizing roller can be lowered. Even under the high-temperature and high-humidity environment, therefore, paper crinkles and faulty fixing can be prevented from occurring.

Still further, according to the invention, the temperature of the pressurizing roller can be estimated while the temperature sensing means is not in contact with the pressurizing roller under pressure, so that the pressurizing roller can be prevented from wearing or being broken. Thus, the case where the pressure application is not partially conducted does not occur, so that faulty fixing and paper crinkles can be prevented from occurring.

Furthermore, the temperature of the pressurizing roller can be estimated while the electric power supply to the heating element is continued, and hence it is unnecessary to perform the control operation for once lowering the temperature of the heating member and then raising it up to the target temperature. Accordingly, the waste consumption of electric power and time can be suppressed.

According to the invention, the temperature of the pressurizing member is sensed while the electric power is supplied to the heat generating member, so that the temperature of the heating member at the time when a paper sheet enters the fixing apparatus can easily be set to an appropriate predetermined temperature. If the temperature of the pressurizing member is appropriate for the predetermined temperature of the heating member, the fixing can be immediately performed, so that a quick start can be realized. Even when the temperature of the pressurizing roller is low, the temperature of the heating roller can be raised in accordance with the temperature of the pressurizing roller, thereby conducting compensation. Accordingly, faulty fixing can be prevented, and the quick start can be realized. The invention is effective particularly in a fixing apparatus with a large thermal capacity.

If the apparatus of the invention is applied to an image forming apparatus such as a printer, a facsimile apparatus, or a copy machine, the effects of the invention can be effectively attained. The occurrence of paper crinkles and high-temperature offset is suppressed even in a high-temperature state of a pressurizing roller, and satisfactory image fixing property is ensured even in a state where the pressurizing roller is cold.

We claim:

1. An image forming apparatus comprising:

a process unit for forming an unfixed toner image on a sheet;

a fixing unit for fixing the unfixed toner image onto said sheet, said fixing unit comprising a heating member and a pressurizing member which are in contact with each other under pressure to form a fixing nip;

temperature detection means for detecting a temperature of said heating member of said fixing unit;

control means for controlling the temperature of said heating member based on an output from said temperature detection means;

estimation means for estimating an amount of heat transferred from said heating member to said pressurizing member; and fixing condition changing means for changing a fixing condition of said fixing unit based on the amount of transferred heat estimated by said estimation means, wherein said control means determines a control target temperature of said heating member and proportionally controls an amount of electric power supplied to said heating member in proportion to a difference between said detected temperature of said heating member and said target temperature, and wherein said estimation means estimates the amount of heat transferred to said pressurizing member based on the control target temperature of said control means and the temperature of said heating member which is detected by said temperature detection means.

2. An image forming apparatus according to claim 1, wherein said fixing condition changing means estimates a temperature of said pressurizing member based on the amount of transferred heat estimated by said estimation means, and changes the fixing condition based on the estimated result.

3. An image forming apparatus according to claim 1, wherein said fixing condition changing means changes the control target temperature of said control means.

4. An image forming apparatus according to claim 1, wherein said pressurizing member is a rotating body, and said fixing condition changing means adjusts a rotation time of said rotating body which is elapsed before the sheet reaches said fixing nip.

5. An image forming apparatus according to claim 1, wherein said fixing condition changing means adjusts a time period during which electric power supply to said heating member is cut off, irrespective of a control output of said control means in the proportional control.

6. An image forming apparatus according to claim 1, wherein said control means controls the temperature of said heating member to a control target temperature by controlling an electric power supplied to said heating member, and said apparatus further comprises sheet detection means for detecting whether said sheet is present in said fixing nip, and wherein said estimation means estimates the amount of heat transferred from said heating member to said pressurizing member, by measuring the amount of electric power supplied to said heating member by said control means during a period when said sheet detecting means is not detecting the presence of the sheet in said fixing nip, and said fixing condition changing means changes the control target temperature of said control means.

7. An image forming apparatus according to claim 6, wherein said apparatus further comprises sheet transportation judging means for judging whether a sheet is being transported toward said fixing unit, and said estimation means estimates the amount of heat transferred to said pressurizing member by measuring the amount of electric power supplied to said heating member by said control means during a period, said period continuing from an elapse of a predetermined time after a time when said transportation judging means judges that a sheet is transported, to a time when said sheet enters said fixing unit.

8. An image forming apparatus according to claim 6, wherein said estimation means estimates the amount of heat transferred to said pressurizing member based on the temperature of said heating member which is detected by said temperature detection means.

9. An image forming apparatus according to claim 1, wherein:

said heating member is a heating roller having an electric heat generating element disposed inside said roller, said pressurizing member is a pressurizing roller, said control means controls a temperature of said heating roller to a control target temperature, by controlling an electric power supplied to said heating roller, and wherein said apparatus further comprises:

sheet detection means for detecting whether a sheet is present in said fixing nip;

and rotation detection means for detecting whether said pressurizing roller is rotating, said estimation means estimates an amount of heat transferred to said pressurizing roller in a period during which no sheets are present in said fixing unit and said pressurizing roller is rotating, and said fixing condition changing means changes the control target temperature of said control means.

10. An image forming apparatus according to claim 9, wherein said estimation means estimates the amount of transferred heat by integrating an electric power supplied to said heating roller by said control means.

11. An image forming apparatus according to claim 9, wherein said estimation means estimates the amount of transferred heat by integrating a time during which no sheets are present in said fixing unit and said pressurizing roller is rotating.

12. An image forming apparatus according to claim 9, wherein said control means generates a signal for driving one of said heating roller and said pressurizing roller, and said rotation detection means detects the rotation based on the driving signal from said control means.

13. An image forming apparatus according to claim 9, wherein said apparatus further comprises a sheet-feeding means for feeding said sheet between said heating roller and said pressurizing roller, and wherein said sheet detection means includes a sheet-feeding sensor disposed in said sheet-feeding unit for detecting whether said sheet is present.

14. An image forming apparatus according to claim 9, wherein said estimation means stores the estimated value of the amount of transferred heat at an end of temperature control, and corrects an estimated value of the amount of transferred heat when the temperature control is started again, by using the stored estimated value.

15. An image forming apparatus according to claim 14, wherein said estimation means corrects the estimated value of the amount of transferred heat based on an elapsed time after the end of temperature control.

16. An image forming apparatus according to claim 14, wherein said estimation means corrects the estimated value of the amount of transferred heat based on the temperature of said heating roller detected when the temperature control is restarted.

17. An image forming apparatus according to claim 14, wherein said estimation means stores the estimated value of the amount of transferred heat to said pressurizing roller at the end of temperature control of said heating roller, and corrects an estimated value of the amount of transferred heat when the temperature control is restarted, by comparing a predetermined temperature which is determined by the stored estimated value of the amount of transferred heat, with the detected temperature of said heating roller, and by, if the detected temperature is higher than the predetermined temperature, using the predetermined temperature, and, if the detected temperature is lower than the predetermined temperature, using the detected temperature.

18. An image forming apparatus according to claim 9, wherein said estimation means performs the estimation by gradually changing the estimated value of the amount of transferred heat based on an output of said temperature detection means of said heating roller in a period during which the temperature control of said heating roller is not performed.

19. An image forming apparatus comprising:

a process unit for forming an unfixed toner image on a sheet;

a fixing unit for fixing the unfixed toner image onto said sheet, said fixing unit comprising a heating member and a pressurizing member which are in contact with each other under pressure to form a fixing nip;

temperature detection means for detecting a temperature of said heating member of said fixing unit;

control means for controlling the temperature of said heating member based on an output from said temperature detection means;

estimation means for estimating an amount of heat transferred from said heating member to said pressurizing member; and fixing condition changing means for changing a fixing condition of said fixing unit based on the amount of transferred heat estimated by said estimation means, wherein said heating member is a heating roller having an electric heat generating element disposed inside said roller, said pressurizing member is a pressurizing roller, said control means controls a temperature of said heating roller to a control target temperature, by controlling an electric power supplied to said heating roller, and wherein said apparatus further comprises:

sheet detection means for detecting whether a sheet is present in said fixing nip; and rotation detection means for detecting whether said pressurizing roller is rotating, said estimation means estimates an amount of heat transferred to said pressurizing roller in a period during which no sheets are present in said fixing unit and said pressurizing roller is rotating, and said fixing condition changing means changes the control target temperature of said control means, and wherein said estimation means stores the estimated value of the amount of transferred heat at an end of temperature control, and corrects an estimated value of the amount of transferred heat when the temperature control is started again, by using the stored estimated value.

20. An image forming apparatus according to claim 19, wherein said estimation means corrects the estimated value of the amount of transferred heat based on an elapsed time after the end of temperature control.

21. An image forming apparatus according to claim 19, wherein said estimation means corrects the estimated value of the amount of transferred heat based on the temperature of said heating roller detected when the temperature control is restarted.

22. An image forming apparatus according to claim 19, wherein said estimation means stores the estimated value of the amount of transferred heat to said pressurizing roller at the end of temperature control of said heating roller, and corrects an estimated value of the amount of transferred heat when the temperature control is restarted, by comparing a predetermined temperature which is determined by the stored estimated value of the amount of transferred heat, with the detected temperature of said heating roller, and by, if the detected temperature is higher than the predetermined temperature, using the predetermined temperature, and, if the detected temperature is lower than the predetermined temperature, using the detected temperature.

23. An image forming apparatus comprising:

a process unit for forming an unfixed toner image on a sheet;

a fixing unit for fixing the unfixed toner image onto said sheet, said fixing unit comprising a heating member and a pressurizing member which are in contact with each other under pressure to form a fixing nip;

temperature detection means for detecting a temperature of said heating member of said fixing unit;

control means for controlling the temperature of said heating member based on an output from said temperature detection means;

estimation means for estimating an amount of heat transferred from said heating member to said pressurizing member; and fixing condition changing means for changing a fixing condition of said fixing unit based on the amount of transferred heat estimated by said estimation means, wherein said control means controls the temperature of said heating member to a control target temperature by controlling an electric power supplied to said heating member, and said apparatus further comprises sheet detection means for detecting whether said sheet is present in said fixing nip, and wherein said estimation means estimates the amount of heat transferred from said heating member to said pressurizing member, by measuring an amount of electric power supplied to said heating member by said control means during a period when said sheet detecting means is not detecting the presence of the sheet in said fixing nip, and said fixing condition changing means changes the control target temperature of said control means.

24. An image forming apparatus according to claim 23, wherein said apparatus further comprises sheet transportation judging means for judging whether a sheet is being transported toward said fixing unit, and said estimation means estimates the amount of heat transferred to said pressurizing member by measuring the amount of electric power supplied to said heating member by said control means during a period, said period continuing from an elapse of a predetermined time after a time when said transportation judging means judges that a sheet is transported, to a time when-said sheet enters said fixing unit.

25. An image forming apparatus according to claim 23, wherein said estimation means estimates the amount of heat transferred to said pressurizing member based on the temperature of said heating member which is detected by said temperature detection means.

26. An image forming apparatus comprising:

a process unit for forming an unfixed toner image on a sheet;

a fixing unit for fixing the unfixed toner image onto said sheet, said fixing unit comprising a heating member and a pressurizing member which are in contact with each other under pressure to form a fixing nip;

temperature detection means for detecting a temperature of said heating member of said fixing unit;

control means for controlling the temperature of said heating member based on an output from said temperature detection means;

estimation means for estimating an amount of heat transferred from said heating member to said pressurizing member; and fixing condition changing means for changing a fixing condition of said fixing unit based on the amount of transferred heat estimated by said estimation means, wherein said heating member is a heating roller having an electric heat generating element disposed inside said roller, said pressurizing member is a pressurizing roller, said control means controls a temperature of said heating roller to a control target temperature, by controlling an electric power supplied to said heating roller, and wherein said apparatus further comprises:

sheet detection means for detecting whether a sheet is present in said fixing nip; and rotation detection means for detecting whether said pressurizing roller is rotating, wherein said estimation means estimates an amount of heat transferred to said pressurizing roller in a period during which no sheets are present in said fixing unit and said pressurizing roller is rotating, and said fixing condition changing means changes the control target temperature of said control means, and wherein said estimation means estimates the amount of transferred heat by integrating an electric power supplied to said heating roller by said control means.

27. An image forming apparatus according to claim 26, wherein said control means generates a signal for driving one of said heating roller and said pressurizing roller, and said rotation detection means detects the rotation based on the driving signal from said control means.

28. An image forming apparatus according to claim 26, wherein said apparatus further comprises a sheet-feeding means for feeding said sheet between said heating roller and said pressurizing roller, and wherein said sheet detection means includes a sheet-feeding sensor disposed in said sheet-feeding unit for detecting whether said sheet is present.

29. An image forming apparatus according to claim 26, wherein said estimation means performs the estimation by gradually changing the estimated value of the amount of transferred heat based on an output of said temperature detection means of said heating roller in a period during which the temperature control of said heating roller is not performed.

30. An image forming apparatus comprising:

a process unit for forming an unfixed toner image on a sheet;

a fixing unit for fixing the unfixed toner image onto said sheet, said fixing unit comprising a heating member and a pressurizing member which are in contact with each other under pressure to form a fixing nip;

temperature detection means for detecting a temperature of said heating member of said fixing unit;

control means for controlling the temperature of said heating member based on an output from said temperature detection means;

estimation means for estimating an amount of heat transferred from said heating member to said pressurizing member; and fixing condition changing means for changing a fixing condition of said fixing unit based on the amount of transferred heat estimated by said estimation means, wherein said heating member is a heating roller having an electric heat generating element disposed inside said roller, said pressurizing member is a pressurizing roller, said control means controls a temperature of said heating roller to a control target temperature, by controlling an electric power supplied to said heating roller, and wherein said apparatus further comprises:

sheet detection means for detecting whether a sheet is present in said fixing nip; and rotation detection means for detecting whether said pressurizing roller is rotating, wherein said estimation means estimates an amount of heat transferred to said pressurizing roller in a period during which no sheets are present in said fixing unit and said pressurizing roller is rotating, and said fixing condition changing means changes the control target temperature of said control means, and wherein said estimation means estimates the amount of transferred heat by integrating a time during which no sheets are present in said fixing unit and said pressurizing roller is rotating.

31. An image forming apparatus according to claim 30, wherein said control means generates a signal for driving one of said heating roller and said pressurizing roller, and said rotation detection means detects the rotation based on the driving signal from said control means.

32. An image forming apparatus according to claim 30, wherein said apparatus further comprises a sheet-feeding means for feeding said sheet between said heating roller and said pressurizing roller, and wherein said sheet detection means includes a sheet-feeding sensor disposed in said sheet-feeding unit for detecting whether said sheet is present.

33. An image forming apparatus according to claim 30, wherein said estimation means performs the estimation by gradually changing the estimated value of the amount of transferred heat based on an output of said temperature detection means of said heating roller in a period during which the temperature control of said heating roller is not performed.

* * * * *